US007712853B2

(12) United States Patent
Ashizaki et al.

(10) Patent No.: US 7,712,853 B2
(45) Date of Patent: May 11, 2010

(54) PRINTER-EQUIPPED DISK RECORDING AND/OR REPRODUCING APPARATUS

(75) Inventors: Koji Ashizaki, Tokyo (JP); Tatsumi Ito, Kanagawa (JP); Makoto Ando, Tokyo (JP); Takahiro Toyoda, Tokyo (JP); Minoru Takeda, Tokyo (JP); Seiji Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/350,362

(22) Filed: Jan. 8, 2009

(65) Prior Publication Data

US 2009/0201324 A1 Aug. 13, 2009

(30) Foreign Application Priority Data

Jan. 11, 2008 (JP) ..... 2008-004968

(51) Int. Cl.
*B41J 3/00* (2006.01)

(52) U.S. Cl. ..... 347/2; 347/3; 347/6; 347/7

(58) Field of Classification Search ..... 347/2
See application file for complete search history.

(56) References Cited

U.S. PATENT DOCUMENTS 5,518,325 A * 5/1996 Kahle ..... 400/70
6,517,175 B2 * 2/2003 Kanaya et al. ..... 347/7
6,902,248 B2 * 6/2005 Koguchi ..... 347/12

* cited by examiner

*Primary Examiner*—Matthew Luu
*Assistant Examiner*—Brian J Goldberg
(74) *Attorney, Agent, or Firm*—Wolf, Greenfield & Sacks, P.C.

(57) ABSTRACT

A printer-equipped disk recording and/or reproducing apparatus includes: a disk drive; a printer; a single light-emitting indicator unit able to luminously indicate colors; an ink tank containing color inks of which the number corresponds to the number of colors the light-emitting indicator unit can indicate; an ink level detection unit that detects color ink levels in the ink tank and outputs detected signals; a printing operation detection unit that detects a printer operation and outputs a detected signal; a drive operation detection unit that detects a disk drive operation and outputs a detected signal; and a first light emission control unit that controls a luminous color and state of the light-emitting indicator unit in accordance with the printer operation, the disk drive operation and the color ink levels on the basis of the detected signals from the ink level detection unit, printing operation detection unit and drive operation detection unit.

5 Claims, 31 Drawing Sheets

· INK LEVEL INDICATION
○ CYAN, MAGENTA, AND YELLOW INKS ARE SUBSTANTIALLY FULL

· INK LEVEL INDICATION
○ CYAN AND MAGENTA INKS ARE ABOUT 50%, AND YELLOW INK IS SUBSTANTIALLY FULL

· INK LEVEL INDICATION
○ CYAN INK IS ABOUT 50%, AND MAGENTA AND YELLOW INKS ARE ABOUT 25%

· INK LEVEL INDICATION
○ CYAN, MAGENTA AND YELLOW INKS ARE SUBSTANTIALLY OUT

PRINTER-EQUIPPED DISK RECORDING AND/OR REPRODUCING APPARATUS

CROSS REFERENCES TO RELATED APPLICATIONS

The present invention contains subject matter related to Japanese Patent Application JP 2008-004968 filed in the Japanese Patent Office on Jan. 11, 2008, the entire contents of which are incorporated herein by reference.

BACKGROUND OF THE INVENTION

1. Field of the Invention

The invention relates to a printer-equipped disk recording and/or reproducing apparatus that includes a disk drive that records information signals into and/or reproduces information signals from a disk-shaped recording medium and a printer that performs printing on a label surface of the disk-shaped recording medium using multiple color inks contained in an ink tank. More specifically, the invention relates to a printer-equipped disk recording and/or reproducing apparatus that performs an indication by changing an indication mode with a single indicator lamp on the basis of the states of inks in the ink tank.

2. Description of the Related Art

Generally, an ink jet printer desirably provides convenience such that the user is able to reliably recognize the ink levels, and when an ink is low in an ink tank, a spare ink is purchased in advance, and then when the ink becomes out, it may be immediately replaced with the new ink. For this reason, a number of techniques are provided, such as a technique for accurately detecting the ink levels in the ink tank and a technique for providing user-friendly indication of the detected ink levels to the user.

The above techniques for indicating the ink levels in the ink tank is, for example, known as described in Japanese Unexamined Patent Application Publication No. 4-275156. JP-A-4-275156 describes an ink jet printer and an ink cartridge used in this printer that allow the user to recognize time for replacement of the ink cartridge, which integrates an ink head and a print head, before the printing quality deteriorates. The ink jet printer described in JP-A-4-275156 (hereinafter, referred to as "first existing example") includes a counter that counts the number of times the print head is energized, a storage device that stores accumulation of counts by the counter, and an indicator that indicates the ink levels in the ink tank on the basis of the value stored in the storage device.

In addition, for example, Japanese Unexamined Patent Application Publication No. 2006-116956 describes this type of existing technique for indicating the ink levels. JP-A-2006-116956 describes an indication controller, a printer and a method of indicating the position of a cartridge for replacement, for instructing an indicator to indicate the position of a cartridge for replacement when cartridge replacement is desired in accordance with a reduction in recording agent level in the cartridge The indication controller described in JP-A-2006-116956 (hereinafter, referred to as "second existing example") is an indication controller for instructing an indicator to indicate information regarding cartridges mounted on a printer that includes a cartridge accommodation units, which accommodate the cartridges containing recording agents, at plurality of portions, the indication controller including a detector that separately detects the recording agent levels in the respective cartridges; and an indication control unit that, when the recording agent level is lower than a threshold on the basis of a value detected by the detector, instructs the indicator to indicate positional information of the cartridge accommodation unit in which the cartridge for replacement is accommodated.

However, the above described first existing example relates to a monofunctional printer only for printing, and there has been no apparatus that combines a printer with a disk recording and/or reproducing apparatus, which is provided with an ink level indication mechanism. In addition, the above monofunctional printer counts the number of times the print head is energized with an energization counter, accumulates the counts in an EEPROM, and then determines a near end and an ink end on the basis of the accumulated value. Then, when the accumulated value reaches a near end determination value, a near end indication LED lights up, and when the accumulated value reaches an ink end determination value, an ink end indication LED lights up. Thus, there has been a problem that the number of indication LEDs corresponding to the number of ink colors may be required and, therefore, it is not only uneconomical because of an increased number of indicator elements but also it may require a large space for arranging all the indicator elements so as to be easily visible.

In addition, the second existing example also relates to a monofunctional printer. The printer includes an ink level management unit that manages the ink level of each ink cartridge color by color; and an indication control unit that controls an indication of a display. When the ink level of any one of ink cartridges accommodated in a plurality of cartridge accommodation units is lower than a threshold and an ink end is recognized, an ink end screen appears on the display and then shows the position of the cartridge for replacement, color identification code, color model number, and the like. Therefore, because the display may be required as an indicator, expensive components may be required. Thus, it is not only uneconomic but also it may require a large space for arranging the display. Particularly, there has been a problem that an indicator or an indication method may be inappropriate when used in a small disk recording and/or reproducing apparatus.

SUMMARY OF THE INVENTION

The present invention addresses the above-identified, and other problems associated with the existing apparatuses, in which it is uneconomical because the number of indication LEDs corresponding to the number of ink colors may be required or a large space may be required for arranging a display, and it may be inappropriate for an indicator or an indication method used in a small disk recording and/or reproducing apparatus.

A printer-equipped disk recording and/or reproducing apparatus according to an embodiment of the invention includes: a disk drive that detachably sets a disk-shaped recording medium and that records information signals into and/or reproduces information signals from an information recording portion of the disk-shaped recording medium by rotating the disk-shaped recording medium; a printer that performs printing by discharging ink droplets onto a label surface of the disk-shaped recording medium, which is on a side opposite to the information recording portion; a single light-emitting indicator unit that is able to luminously indicate a plurality of colors; an ink tank that contains color inks of which the number corresponds to the number of colors the light-emitting indicator unit is able to indicate; an ink level detection unit that detects the levels of a plurality of color inks contained in the ink tank for the respective ink colors and that outputs respective detected signals; a printing operation detection unit that detects an operation of the printer and that outputs a detected signal; a drive operation detection unit that detects an operation of the disk drive and that outputs a detected signal; and a first light emission control unit that controls a luminous color and a luminous state of the light-emitting indicator unit in accordance with the operation of the printer, the operation of the disk drive and the levels of the color inks on the basis of the detected signals from the ink level detection unit, the detected signal from the printing operation detection unit and the detected signal from the drive operation detection unit.

BRIEF DESCRIPTION OF THE DRAWINGS

FIG. 12A to FIG. 12D are views illustrating examples of an indication mode of a light-emitting indicator unit according to the embodiment of the printer-equipped disk recording and/or reproducing apparatus of the invention, in which FIG. 12A shows an indication of a recording and reproducing operation, FIG. 12B shows an indication of a printing operation, FIG. 12C shows an ink low indication and an ink out indication, and FIG. 12D shows another example of an ink low indication and an ink out indication;

DESCRIPTION OF THE PREFERRED EMBODIMENTS

In a disk recording and/or reproducing apparatus equipped with a disk drive and a printer, a single light-emitting indicator unit, an ink tank, an ink level detection unit, a printing operation detection unit, a drive operation detection unit and a light emission control unit are provided. Thus, a printer-equipped disk recording and/or reproducing apparatus is able to luminously indicate the degree of an ink level or the presence or absence of an ink by changing an indication mode using the single light-emitting indicator unit with a simple structure.

FIG. 1 to FIG. 31 are views illustrating examples of an embodiment of the invention. Hereinafter, examples of the embodiment of the invention will be described with reference to the accompanying drawings.

FIG. 1 to FIG. 7 show an optical disk apparatus 1 according to a first embodiment of the printer-equipped disk recording and/or reproducing apparatus of the invention. The optical disk apparatus 1 is a disk tray type printer-equipped recording/reproducing apparatus that is able to record (write) new information signals into an information recording surface of an optical disk 2, which is a specific example of a printed target disk-shaped recording medium, such as a CD-R (Recordable), a DVD-RW (Rewritable), a Blu-ray Disc (trademark), and an HD-DVD, and is able to reproduce (read) previously recorded information signals, while making it possible to print visual information, such as a character, a symbol, a photograph, a picture, and a pattern, onto a label surface, which is a printing surface, of the optical disk 2.

However, the printer-equipped disk recording and/or reproducing apparatus of the invention is not limited to the optical disk apparatus that is able to both record and reproduce information. Of course, the printer-equipped disk recording and/or reproducing apparatus of the invention may be applied to a disk recording apparatus that is able to merely record information signals, or may be applied to a disk reproducing apparatus that is able to merely reproduce information signals instead. In addition, the disk-shaped recording medium is not limited to the optical disk that records or reproduces information signals using a laser beam. The disk-shaped recording medium may employ various disk-shaped recording media, of which the outer shape is a disk shape, such as an optical disk that uses near field light, a magneto-optical disk that uses light and magnetism and a magnetic disk that merely uses magnetism, as a recording medium.

Figure 1:
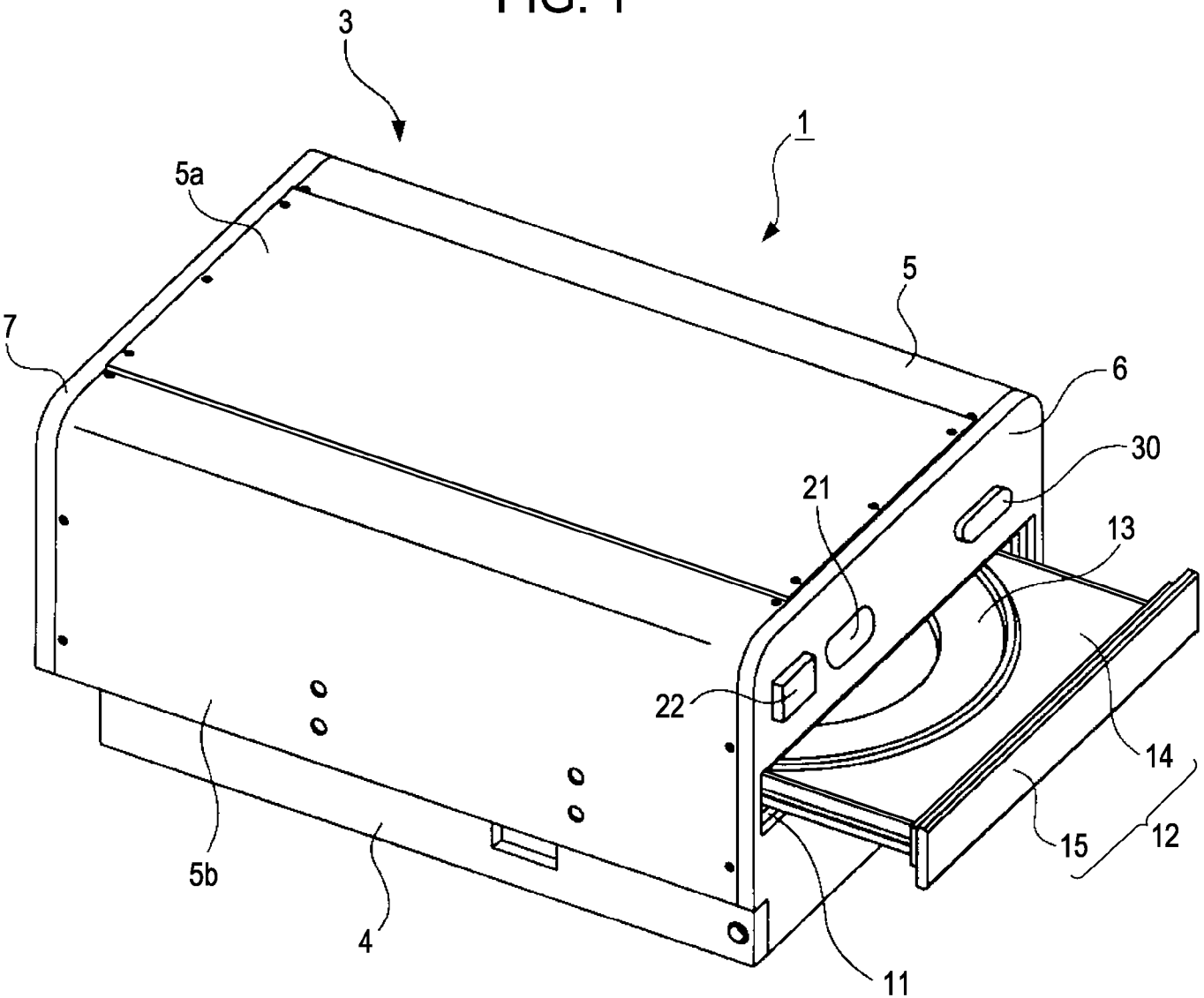
FIG. 1 is a perspective view of a disk tray type optical disk apparatus in a state where a disk tray is ejected according to a first embodiment of a printer-equipped disk recording and/or reproducing apparatus of the invention.
Figure 2:
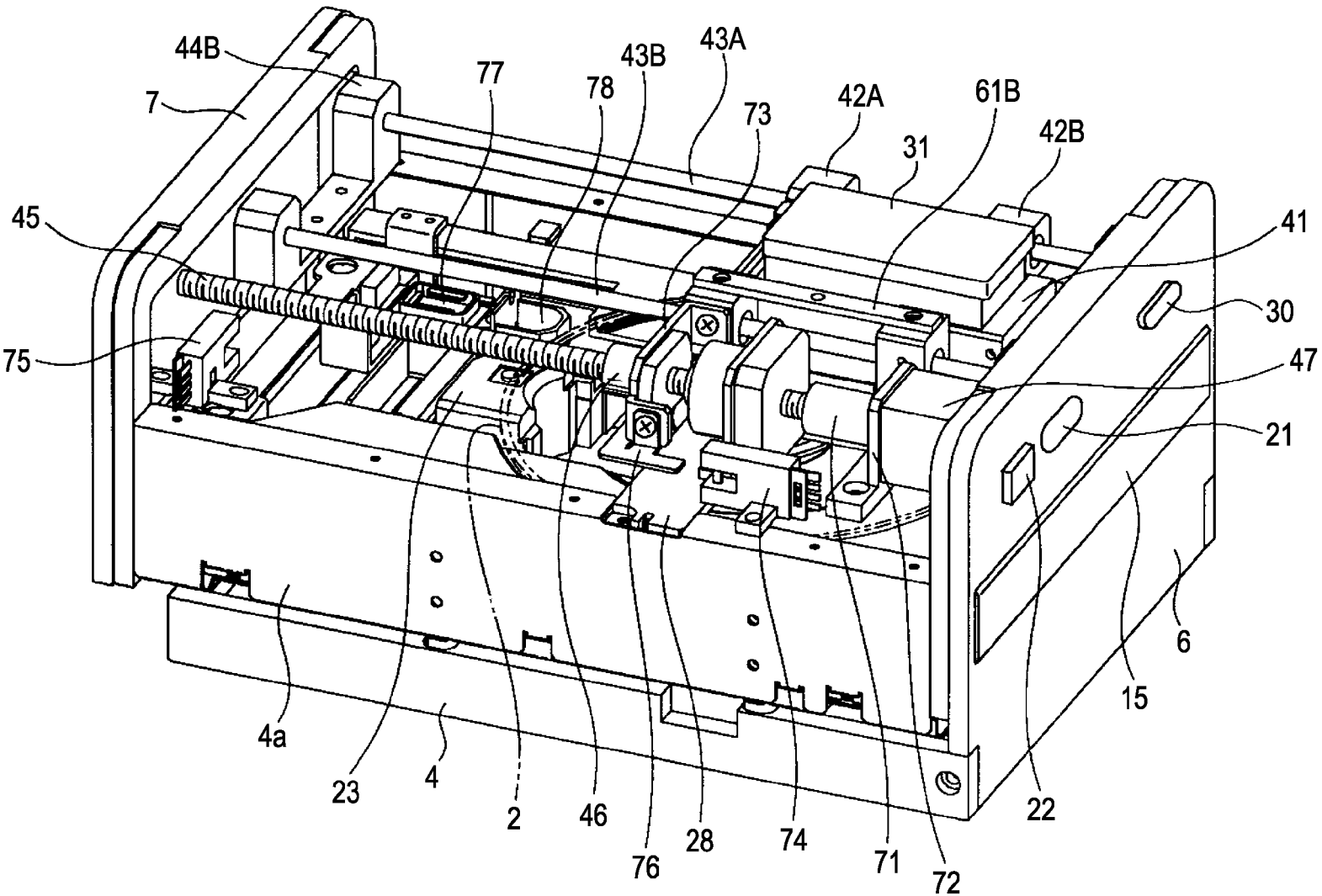
FIG. 2 is a perspective view of the optical disk apparatus in a state where an upper panel of a casing is removed according to the first embodiment of the printer-equipped disk recording and/or reproducing apparatus of the invention.
Figure 3:
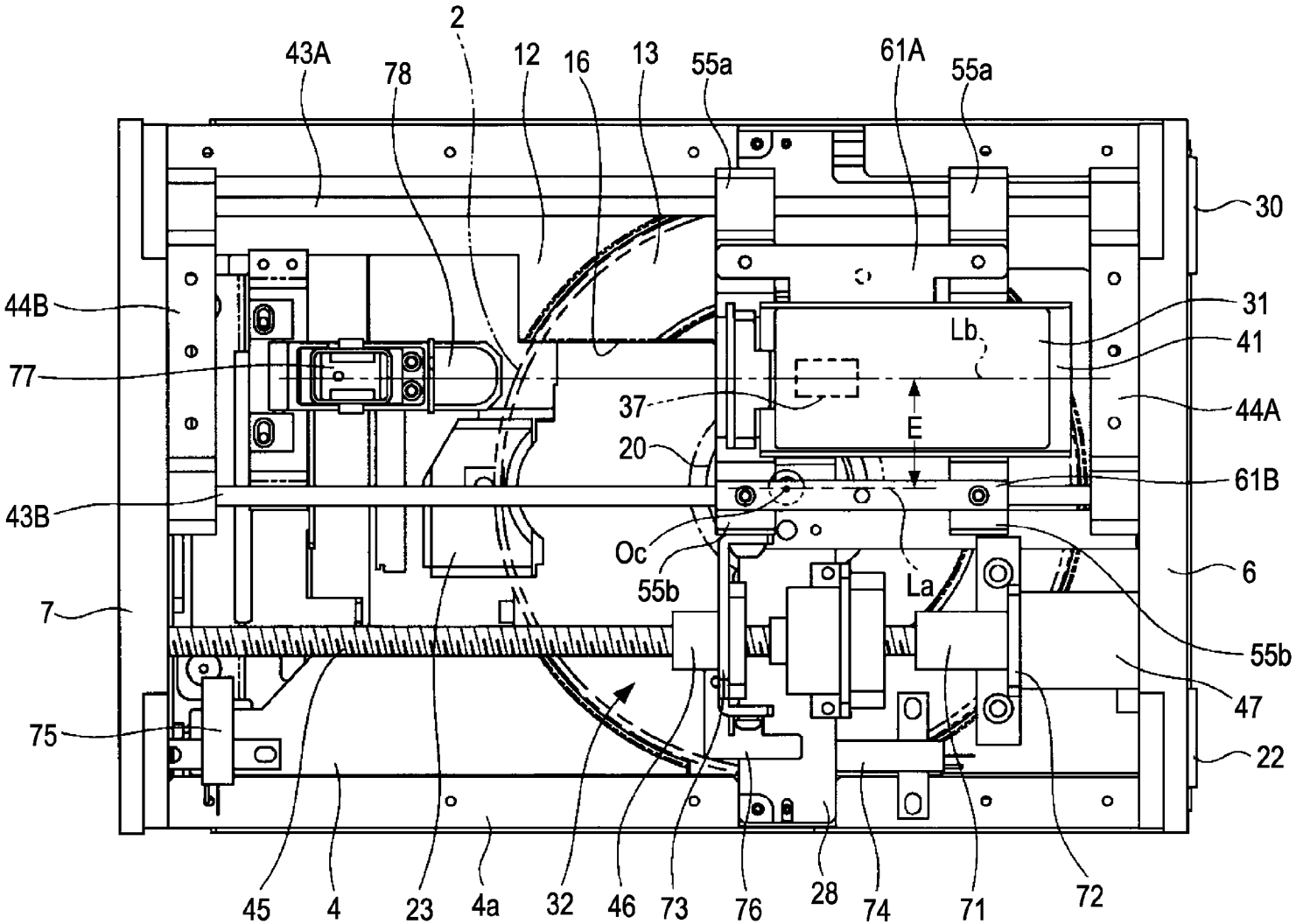
FIG. 3 is a plan view of the optical disk apparatus in a state where the upper panel of the casing is removed according to the first embodiment of the printer-equipped disk recording and/or reproducing apparatus of the invention.

FIG. 1 is an external perspective view of the optical disk apparatus 1. FIG. 2 is a perspective view of the optical disk apparatus 1 in a state where an upper panel 5 of a casing 3 is removed. FIG. 3 is a plan view of the optical disk apparatus 1 in a state where the upper panel 5 is removed in the similar manner. As shown in FIG. 1 to FIG. 3, the optical disk apparatus 1 includes the casing 3 formed of a hollow case, an apparatus body 8 accommodated in the casing 3, an input device, such as a remote controller (not shown), and the like. An external device, such as an image display device or an audio output device (which are not shown), may be electrically connected to the optical disk apparatus 1, and information read from an information recording portion of the optical disk 2 may be displayed or indicated by an image, a sound, or the like. The image display device may, for example, employ a liquid crystal display device, an organic EL display device, a plasma display device, or the like. In addition, the audio output device may, for example, employ a speaker device, or the like.

The casing 3 of the optical disk apparatus 1 includes a rectangular base panel 4, an upper panel 5 that covers the upper face of the base panel 4, a front panel 6 that covers the front face, and a rear panel 7 that covers the rear face, thus forming a hollow case as a whole. Side portions 4*a* are provided respectively at both widthwise sides of the base panel 4 of the casing 3. Each side portion 4*a* extends longitudinally of the base panel 4 at a predetermined height. The upper panel 5 includes a rectangular upper portion 5*a* and right and left side portions 5*b* that are formed continuously at both widthwise sides of the upper portion 5*a* and that respectively cover the side faces. The upper panel 5 is mounted on the base panel 4 in such a manner that both side portions 5*b* are respectively fixed to the side portions 4*a* with fixation screws (not shown). A tubular front opening and a tubular rear opening are defined by the upper panel 5 and the base panel 4. The front opening is closed by the front panel 6, and the rear opening is closed by the rear panel 7. Then, the front panel 6 and the rear panel 7 are screwed to the base panel 4 and the upper panel 5 by fixation screws (not shown).

A disk insertion opening 11 is provided at substantially the vertically middle of the front panel 6 so as to extend in the widthwise direction. A disk tray 12 is mounted in the disk insertion opening 11 so that it is insertable or ejectable. The disk tray 12 selectively transports the optical disk 2, placed on the disk accommodating portion 13, between a disk ejected position outside the casing 3 and a disk setting position of the disk drive 9, at which information signals are recorded (written) into or reproduced (read) from the optical disk 2 inside the casing 3. The disk tray 12 is formed of a tray body 14 and a screen panel 15. The tray body 14 is formed of a plate-like material having a rectangular shape in plan view with a size slightly larger than that of the optical disk 2. The screen panel 15 is fixed to a longitudinal one end of the tray body 14. The disk accommodating portion 13 is formed on the upper face, which is one of the planar faces of the tray body 14. The disk accommodating portion 13 has a circular recess for accommodating the optical disk 2.

In addition, a cutout portion 16 is formed in the tray body 14 so as to avoid contact with a disk setting portion, which will be described later. The cutout portion 16 is formed so that the disk tray 12 is widely cut out from its one short side to the center of the disk accommodating portion 13. The screen panel 15 is integrally formed at another short side of the tray body 14, which is the side opposite to the cutout portion 16. The screen panel 15 serves as a lid that closes the disk insertion opening 11 when the disk tray 12 is moved to the disk setting position. The screen panel 15 is formed into a horizontally-oriented rectangular shape that conforms to the shape of the disk insertion opening 11, and is detachably fitted to the disk insertion opening 11.

Furthermore, an indicator lamp 21, an ink level information button 22, and an eject button 30 are provided at the upper side of the front panel 6 with respect to the disk insertion opening 11. The indicator lamp 21 is a specific example of a light-emitting indicator unit (access lamp/ink level indicator unit). The ink level information button 22, which is a second light emission control unit, controls a luminous color and luminous state of the indicator lamp 21. The eject button 30 inserts and ejects the disk tray 12. The indicator lamp 21 lights up or blinks multiple colors of light, and assigns an emission color, lighting time or blinking time of each color, a change of color, and the like, to corresponding meanings to thereby indicate a recording/reproducing operation on the optical disk 2 by the disk drive 9, a printing operation on the optical disk 2, or an ink level, such as the amount of ink or the presence or absence of ink, and the like. Note that as in the case of a first example embodiment and a second example embodiment of control of an ink level indication, which will be described later, it is possible to separately handle the case in which no ink level information button 22 is provided and the case in which the ink level information button 22 is provided.

The indicator lamp 21 is desirably a light-emitting element that is able to luminously indicate at least four colors of light. However, even with three or two luminous colors, the embodiment of the invention may be carried out, and it is preferable that a light-emitting element luminously indicate four or more luminous colors. The above indicator lamp 21 may be, for example, a product named "full-color LED (type name: NSTM515)" produced by Nichia Corporation. The "full-color LED" is a full-color light-emitting element that is able to luminously indicate R (red), G (green), and B (blue) with a shell-shaped light-emitting portion. The indicator lamp 21 lights up and blinks colored light to indicate a status of recording/reproducing operation on the optical disk and a print function operation, such as an ink level, in regard to the printer, which will be described later.

The operation indication pattern of a recording/reproducing operation on the optical disk 2 by the disk drive 9, for example, lights up (state that light is emitted continuously for a certain period of time) or blinks (state that light is intermittently emitted at certain intervals) at the time of operation, such as disk insertion, disk ejection, recording, and reproducing. In addition, the indication pattern in association with a printing operation on the optical disk 2 by the printer, for example, determines the indication pattern of a luminous color and lighting or blinking in order to indicate a status of a printing operation and a status of the printer, such as an ink level. Specifically, the indicator lamp 21 is controlled to light or blink at the time of operation, such as a printing operation and a cleaning operation, and/or state, such as a state that the ink level is low, a state that the ink is out, and a state that an ink tank is not installed. In this case, under an abnormal state, such as a status that the ink is out and a status that an ink tank is not installed, it is desirable for the indicator lamp 21 to continuously perform an indication when power is on irrespective of whether the printing operation is in progress.

Figure 11:
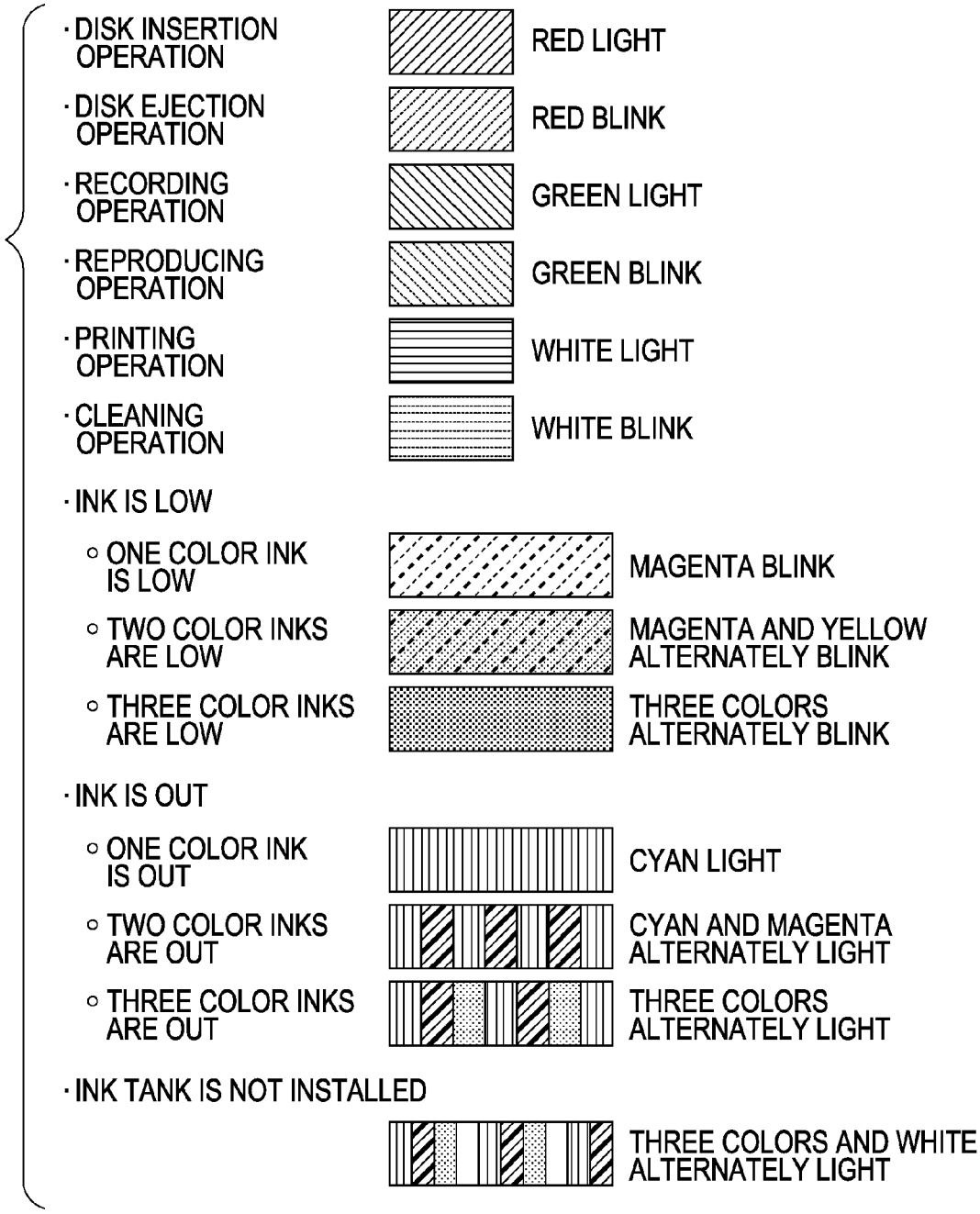
FIG. 11 is a view illustrating an example of indication modes of a light-emitting indicator unit according to the embodiment of the printer-equipped disk recording and/or reproducing apparatus of the invention.

The pattern of an operation indication by the indicator lamp 21 may be illustrated, for example, as shown in FIG. 11. The recording/reproducing operation of the optical disk may be, for example, indicated as follows at the time of respective operations. The indicator lamp 21 lights up in red at the time of disk insertion (red lighting). The indicator lamp 21 blinks in red at the time of disk ejection (red blinking). The indicator lamp 21 blinks in green at the time of recording operation (green blinking). Then, the indicator lamp 21 lights up in green at the time of reproducing operation (green lighting). In addition, the printing operation on the optical disk and/or its status may be, for example, indicated as follows. The indicator lamp 21 lights up in white at the time of printing operation (white lighting). The indicator lamp 21 blinks in white at the time of cleaning operation (white blinking).

The indication of a status that the ink level is low may be as follows. For example, in a state where an ink tank containing three colors, that is, magenta (M), cyan (C), and yellow (Y), is used, when the ink level of one color (for example, magenta) is low, red and blue are emitted at the same time to thereby emit magenta light and blink the magenta light (magenta blinking). In addition, when the ink levels of two colors (for example, magenta and yellow) are low, magenta light (red and blue are emitted at the same time) and yellow light (red and green are emitted at the same time) alternately blink (magenta and yellow blinking). Furthermore, when the ink levels of three colors (magenta, yellow, and cyan all) are low, three magenta light (red and blue are emitted at the same time), yellow light (red and green are emitted at the same time) and cyan light (blue and green are emitted at the same time) alternately blink (magenta, yellow and cyan blinking).

The indication of a status that the ink is out may be as follows. For example, when the ink of one color (for example, cyan) is out, red and blue are emitted at the same time to thereby emit magenta (M) light and the magenta (M) light continues to light up (magenta lighting). In addition, when the inks of two colors (for example, cyan and magenta) are out, cyan (C) light and magenta (M) light alternately light up for a certain period of time (cyan and magenta alternate lighting). Furthermore, when the inks of all three colors (magenta, yellow and cyan all) are out, three cyan (C) light, magenta (M) light and yellow (Y) light alternately light up for a certain period of time (cyan, magenta and yellow alternate lighting). In addition, the indication of a status that an ink tank is not installed may be as follows. For example, four red (R) light, blue (B) light, green (G) light and white (W) light (red, blue and green are emitted at the same time) alternately light up for a certain period of time (three colors and white alternate lighting).

Figure 12A:
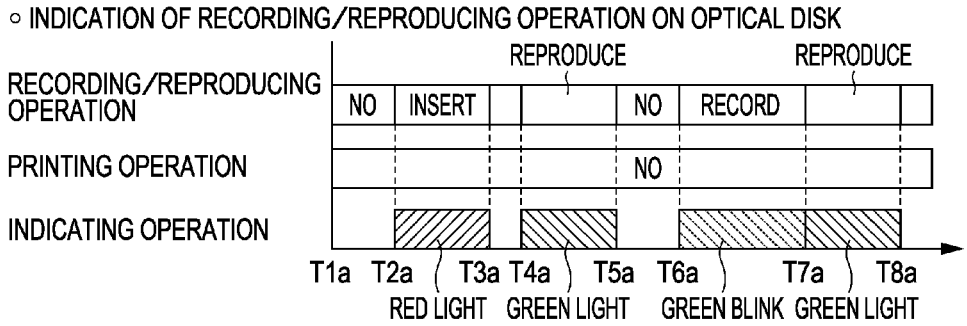

FIG. 12A to FIG. 12D are views that show examples of the operation indication of the disk drive 9 and printer in order of time with the abscissa axis representing a lapse of time. FIG. 12A is a view that shows the operation indication at the time of recording/reproducing on the optical disk 2 by the disk drive 9. In an initial status, at time T1*a* at which the optical disk 2 is not set in the disk drive 9, the indicator lamp 21 neither lights up nor blinks but it remains turned off. When the optical disk 2 is inserted in the disk drive 9 at time T2*a*, the indicator lamp 21 lights up in red. The indicator lamp 21 continues to light up in red until the insertion operation at time T3*a* ends. After that, when the reproducing operation starts at time T4*a*, the indicator lamp 21 lights up in green. The indicator lamp 21 continues to light up in green when the reproducing operation ends at time T5*a*.

Next, when the recording operation starts at time T6*a*, the indicator lamp 21 blinks in green. The indicator lamp 21 continues to blink in green until the recording operation ends at time T7*a*. Then, when the reproducing operation starts at time T7*a*, the indicator lamp 21 lights up in green. The indicator lamp 21 continues to light up in green until the reproducing operation ends at time T8*a*. In this case, the printing operation is not performed from time T1*a*, at which the operation is started, to time T8*a*, at which the operation is completed.

Figure 12B:
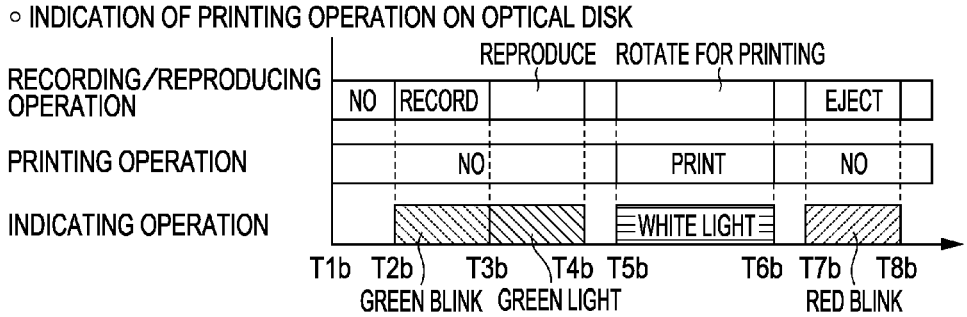

FIG. 12B is a view that shows the indication of a recording/reproducing operation and printing operation at the time of printing on the optical disk 2. In an initial status, at time T1*b* at which the optical disk 2 is not set in the disk drive 9, the indicator lamp 21 neither lights up nor blinks but it remains turned off. When the disk drive 9 starts the recording operation on the optical disk 2 at time T2*b*, the indicator lamp 21 blinks in green. The indicator lamp 21 continues to blink in green until the recording operation ends at time T3*b*. Subsequently, when the reproducing operation starts at time T3*b*, the indicator lamp 21 lights up in green. The indicator lamp 21 continues to light up in green until the reproducing operation ends at time T4*b*.

Next, when the optical disk 2 is controlled to rotate for printing by the disk drive 9, as will be described later, at time T5*b*, the printer starts the printing operation. At time T5*b*, the indicator lamp 21 lights up in white. The indicator lamp 21 continues to light up in white until the printing operation ends at time T6*b*. Then, when the ejecting operation of the optical disk 2 starts at time T7*b*, the indicator lamp 21 blinks in red. The indicator lamp 21 continues to blink in red until the ejecting operation ends at time T8*b*.

Here, the operation to control the optical disk 2 to rotate for printing around time T5*b* is characteristic because, in the example embodiment according to the configuration of FIG. 1 to FIG. 3, a so-called Rθ printing method based on the rotational movement of the optical disk 2 and the translational movement of the print head 31 is employed. In the Rθ printing method, the optical disk 2 is controlled to rotate appropriate for the purpose of printing, and the print head 31 is controlled to move to above the label surface of the optical disk 2, and then the printing operation is started. Because an Rθ printing structure is employed in the example embodiment shown in FIG. 1 to FIG. 3, the printer-equipped disk recording and/or reproducing apparatus according to the embodiment of the invention may be reduced in size.

Of course, the indication method for an operation and a status using the indicator lamp 21 in the printer-equipped disk recording and/or reproducing apparatus according to the embodiment of the invention does not limit the printing method to the Rθ method. The indication method may also be used in a so-called XY printing method in which the print head 31 biaxially performs translational movement with respect to the optical disk 2. That is, even in the case of the XY printing method, the print head 31 is controlled to move to above the label surface of the optical disk 2 and then the printing operation is started. Thus, the lighting status of the indicator lamp 21 is controlled in accordance with those operations.

Figure 12C:
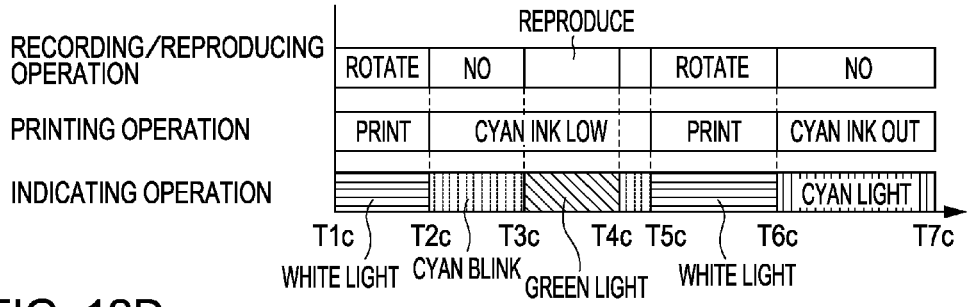

FIG. 12C is a view that shows the indication of a recording/reproducing operation, printing operation, and ink low and ink out at the time when printing is performed on the optical disk 2. In an initial status, at time T1*c* at which the disk drive 9 drives the optical disk 2 for rotation at a printing speed, that is, the indicator lamp 21 lights up in white. When the printing ends at time T2*c*, the disk drive 9 stops and enters an unoperated state. At this time, for example, if it is detected that the ink level of cyan (C) is low, the indicator lamp 21 blinks in cyan (C). The indicator lamp 21 continues to blink in cyan until, for example, the reproducing operation starts at time T3*c*. When the reproducing operation starts at time T3*c*, the indicator lamp 21 lights up in green. The indicator lamp 21 continues to light up in green until the reproducing operation ends at time T4*c*.

It has been already detected at time T4*c* that the cyan (C) ink level is low, and the indicator lamp 21 blinks in cyan (C) because the above low cyan (C) ink level is not resolved. The indicator lamp 21 continues to blink in cyan until, for example, the rotation operation for printing starts at the following time T5*c*. Next, when the optical disk 2 is rotated at a speed for printing by the disk drive 9 at time T5*c*, the printer starts a printing operation. The indicator lamp 21 lights up in white from time T5*c*. The indicator lamp 21 continues to light up in white until the printing operation ends at time T6*c*. Then, when the disk drive 9 is stopped at time T6*c*, the cyan (C) ink level is reduced from the status in which the cyan (C) ink level is low because of printing, and then it is detected that the cyan (C) ink is out. Thus, the indicator lamp 21 lights up in cyan (C). The indicator lamp 21 continues to light up in cyan until the status that the cyan (C) ink is out is resolved or another operation indication is started.

Figure 12D:
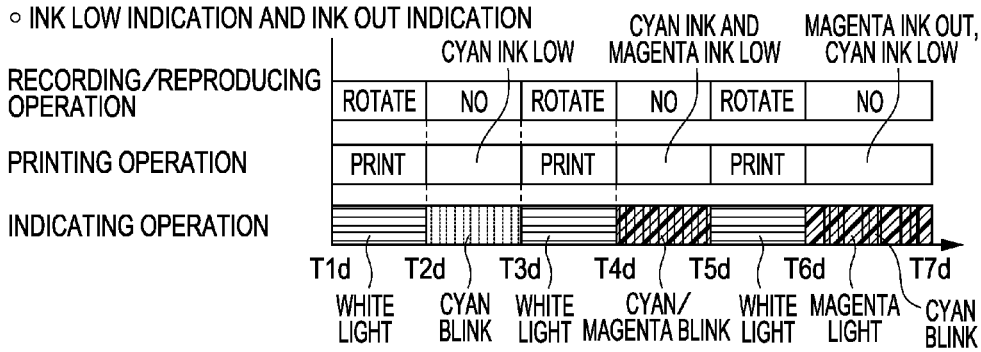

In addition, FIG. 12D shows the indication of the recording/reproducing operation, printing operation, and ink low and ink out at the time of printing on the optical disk 2 in the status that the magenta (M) ink is out in addition to the cyan (C) ink level is low from a status similar to that before the operation of the example embodiment of FIG. 12C. The operation from time T1*d* through time T2*d* to time T3*d* is similar to that of the example embodiment of FIG. 12C. Next, when the printing operation starts again at time T3*d*, the indicator lamp 21 lights up in white. Then, if it is detected, for example, that the cyan (C) ink level is low and the magenta (M) ink level is low when the printing ends and the disk drive 9 is stopped at time T4*d*, the indicator lamp 21 alternately blinks in cyan and magenta. The indicator lamp 21 continues to alternately blink in cyan and magenta until the printing operation starts again at time T5*d*.

When the printing operation starts again at time T5*d*, the indicator lamp 21 lights up in white again. Then, if it is detected, for example, that the cyan (C) ink level is low and the magenta (M) ink is out when the printing ends and the disk drive 9 is stopped at time T6*d*, the indicator lamp 21 lights up in magenta for a certain period of time and blinks in cyan alternately at a predetermined cycle until time T7*d*. Note that, after that, the above status of light emission of the indicator lamp 21 continues until the status in which the cyan (C) ink level is low and the magenta (M) ink is out is resolved or another operation indication is started.

When the ink level information button 22 is held pressed (switched on), the indicator lamp 21 blinks in an ink level indication mode. The ink level information button 22 indicates the degree of ink level in two or more stages to minutely indicate how much the ink level is. In the case of the above described example embodiment, a two-stage indication, that is, a status "ink level is low" and a status "ink is out", is employed and the amount of ink is not known quantitatively; however, by setting the indication with three or more stages, it is possible to further minutely manage the ink level. Note that when the ink level information button 22 is not pressed, the indicator lamp 21 lights up or blinks in accordance with the above described operation indication mode.

Figure 13A:
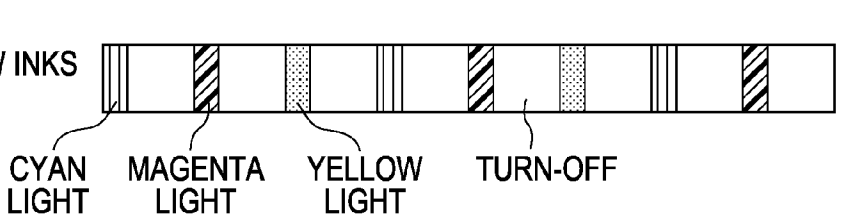
FIG. 13A to 13D are views illustrating examples of pattern of an ink level indication mode of the light-emitting indicator unit according to the embodiment of the printer-equipped disk recording and/or reproducing apparatus of the invention.
Figure 13B:
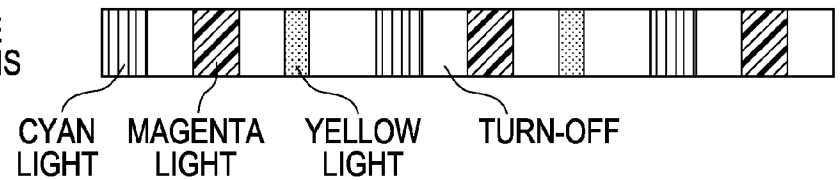
Figure 13C:
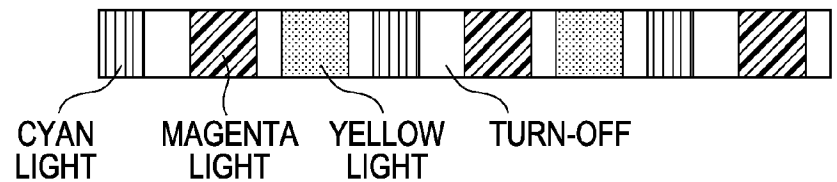
Figure 13D:
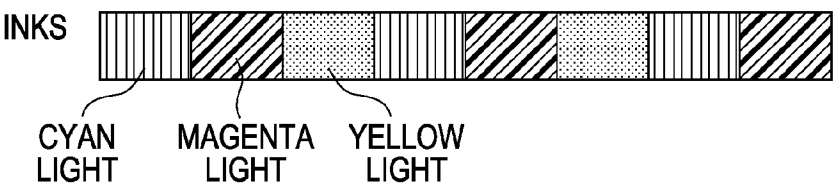
Figure 14:
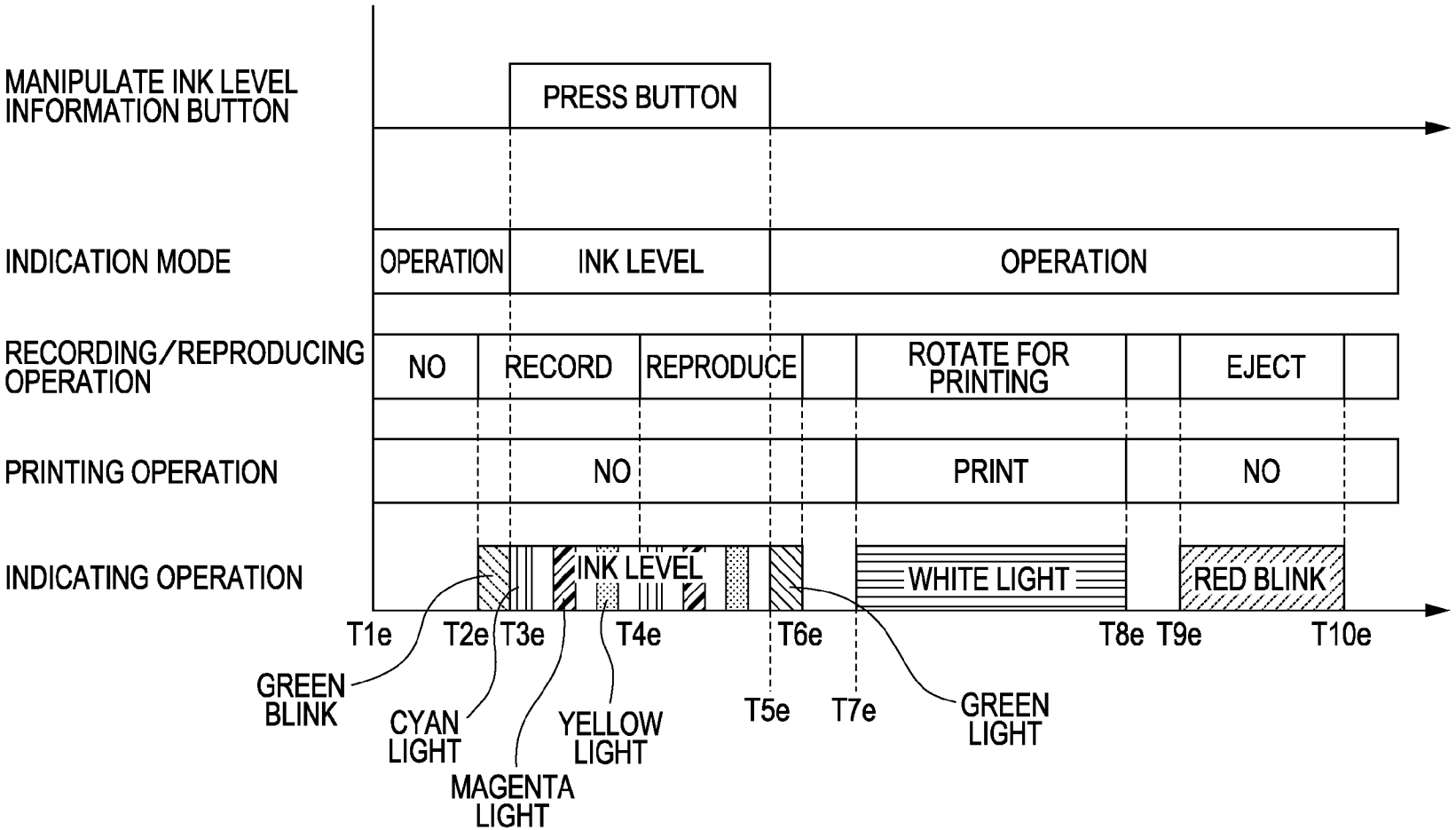
FIG. 14 is a view illustrating an example of an ink level indication mode and operation indication mode of the light-emitting indicator unit according to the embodiment of the printer-equipped disk recording and/or reproducing apparatus of the invention.

When the ink level information button 22 is pressed, an ink level indication is performed, for example, as shown in FIG. 13A to FIG. 14. FIG. 13A is a view that shows an ink level indication when cyan (C) ink, magenta (M) ink and yellow (Y) ink are substantially full. In this case, for example, the indicator lamp 21 lights up in cyan (C) for 0.5 seconds and is then turned off for 1.5 seconds, the indicator lamp 21 lights up in magenta (M) for 0.5 seconds and is then turned off for 1.5 seconds, and subsequently, the indicator lamp 21 lights up in yellow (Y) for 0.5 seconds and is then turned off for 1.5 seconds. This will be repeated. FIG. 13B is a view that shows an ink level indication when cyan (C) ink and magenta (M) ink are reduced to substantially half (50%) and yellow (Y) ink is substantially full. In this case, for example, the indicator lamp 21 lights up in cyan (C) for 1.0 second and is then turned off for 1.0 second, the indicator lamp 21 lights up in magenta (M) for 1.0 second and is then turned off for 1.0 second, and subsequently, the indicator lamp 21 lights up in yellow (Y) for 0.5 seconds and is then turned off for 1.5 seconds. This will be repeated.

FIG. 13C is a view that shows an ink level indication when cyan (C) ink is reduced to substantially half (50%) and magenta (M) ink and yellow (Y) ink are reduced to substantially a quarter (25%). In this case, for example, the indicator lamp 21 lights up in cyan (C) for 1.0 second and is then turned off for 1.0 second, the indicator lamp 21 lights up in magenta (M) for 1.5 seconds and is then turned off for 0.5 seconds, and subsequently, the indicator lamp 21 lights up in yellow (Y) for 1.5 seconds and is then turned off for 0.5 seconds. This will be repeated. In addition, FIG. 13D shows an ink level indication when cyan (C) ink, magenta (M) ink and yellow (Y) ink all are substantially out. In this case, for example, the indicator lamp 21 lights up in cyan (C) for 2.0 seconds, then lights up in magenta (M) for 2.0 seconds and, subsequently, lights up in yellow (Y) for 2.0 seconds. This will be repeated. In this way, for example, by showing the turn-on time and turn-off time of the indicator lamp 21 in association with the ink levels, the user is able to recognize ink level information in further detail.

FIG. 14 is a view that shows the relationship between manipulation of the ink level information button 22 and the above described operation indication modes. In FIG. 14, in an initial status, at time T1*e* at which the disk drive 9 neither performs recording nor performs reproducing on the optical disk 2, the indicator lamp 21 neither lights up nor blinks, but it remains turned off. At this time, the printing operation is also not performed, and the indication mode is associated with the operation. Next, when the disk drive 9 starts the recording operation on the optical disk 2 at time T2*e*, the indicator lamp 21 blinks in green.

Next, when the user manipulates (turns on) the ink level information button 22 at time T3*e*, the indication mode is switched into the ink level indication. Thus, the indication of the indicator lamp 21 becomes an ink level indication. In this ink level indication, for example, the indications shown in the above FIG. 13A to FIG. 13D are performed. The ink level indication in this state continues without any changes even when the recording operation is switched to the reproducing operation at time T4*e*. After that, when the user releases (turns off) the ink level information button 22 to stop manipulation at time T5*e*, the indication mode is switched from the ink level indication mode to the operation indication mode. Thus, the indicator lamp 21 lights up in green to indicate the reproducing operation.

Next, when the reproducing operation ends at time T6*e*, the green lighting of the indicator lamp 21 turns off. Subsequently, when the disk drive 9 rotates the optical disk 2 for printing at time T7*e*, the printing operation is started. Thus, the indicator lamp 21 lights up in white. The indicator lamp 21 continues to light up in white until the printing operation ends at time T8*e*. Then, when the ejecting operation of the optical disk 2 starts at time T9*e*, the indicator lamp 21 blinks in red. The indicator lamp 21 continues to blink in red until the ejecting operation ends at time T10*e*. As described above, with the ink level information button 22, it is possible to notify the user in further detail of the operation or status of the optical disk apparatus 1 according to the embodiment of the invention.

The apparatus body 8 of the optical disk apparatus 1 includes the disk drive 9, a printer 10, a controller 80 (see FIG. 10), and the like. The disk drive 9 records new information by writing information signals in an information recording portion of the provided optical disk 2 or reads and reproduces information that is previously recorded in the information recording portion. In addition, the printer 10 prints out and displays matters in association with information that is previously recorded in the information recording portion, newly recorded information, or the like, onto the label surface of the provided optical disk 2, a label sheet adhered on the label surface, or the like, as visual information such as a character, a numeral, a photograph, a picture, and a pattern. Furthermore, the controller controls these disk drive 9 and printer 10 and, if needed, another device, to make the disk drive 9 perform a predetermined recording/reproducing operation and other operations, and to make the printer 10 perform a predetermined printing operation and other operations. Then, the above indicator lamp 21 notifies the user of the predetermined recording/reproducing operation and other operations, the predetermined printing operation and other operations, or the status within the apparatus.

Figure 4:
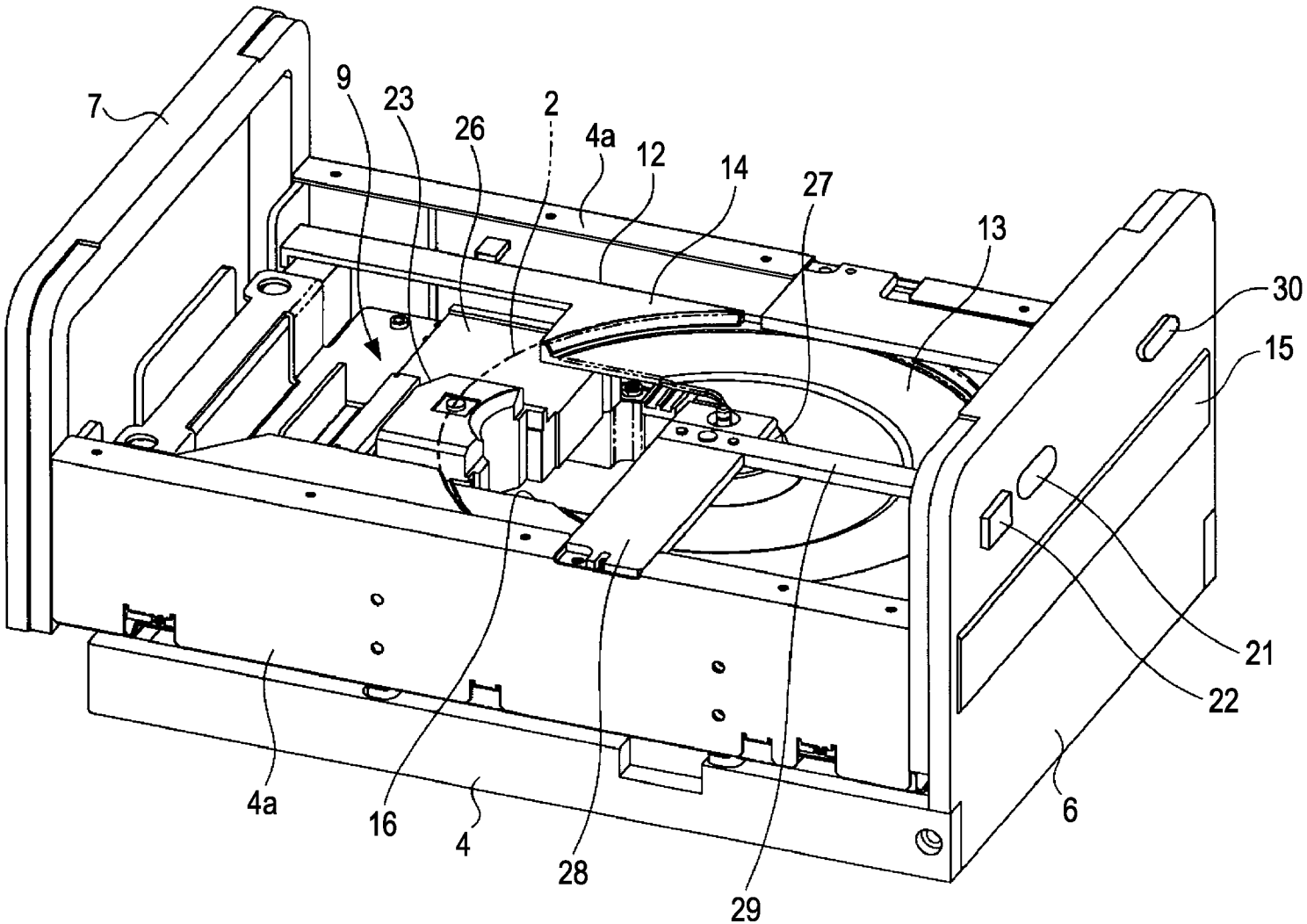
FIG. 4 is a perspective view of the optical disk apparatus in a state where a printer is further removed from the optical disk apparatus shown in FIG. 2.
Figure 5:
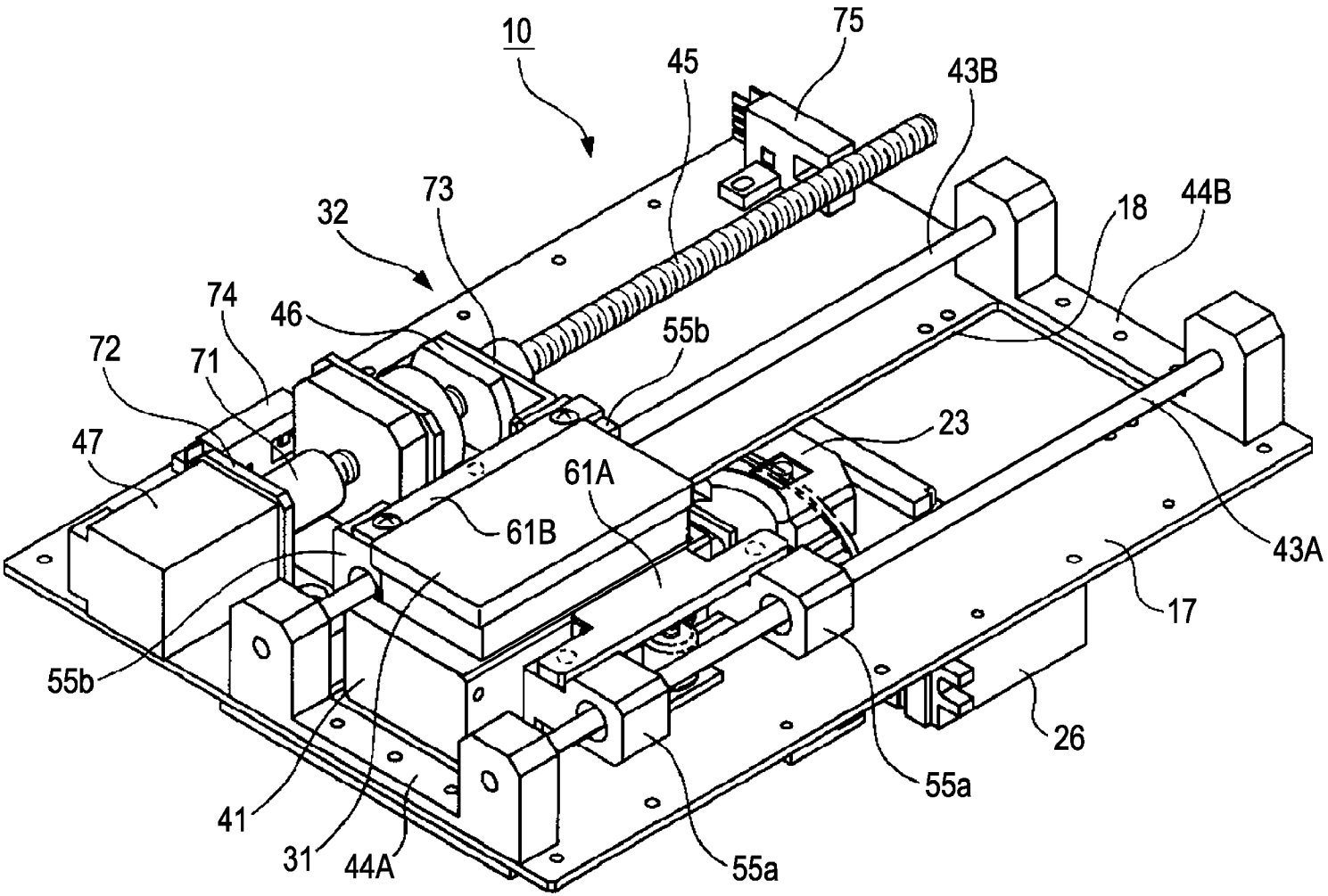
FIG. 5 is a perspective view of the printer of the optical disk apparatus according to the first embodiment of the printer-equipped disk recording and/or reproducing apparatus of the invention.

FIG. 4 is a perspective view of the optical disk apparatus 1 in a state where the printer 10 is removed from the optical disk apparatus 1. In this example embodiment, the disk drive 9 is arranged at the lower side inside the casing 3, and the printer 10 is arranged at the upper side inside the casing 3. To achieve this arrangement, a chassis plate 17 is arranged inside the casing 3 so as to vertically partition the space inside the casing 3. FIG. 5 is a perspective view that shows a state in which the printer 10 is mounted on the chassis plate 17. The chassis plate 17 is formed of a rectangular plate that is slightly smaller than the base panel 4, and has a rectangular opening 18 formed to extend through the front and rear faces of the chassis plate 17. The rectangular opening 18 with predetermined width extends longitudinally of the chassis plate 17. The printer 10 is mounted on the upper face, which is one of the faces, of the chassis plate 17, and the disk drive 9 is arranged so as to be located a distance from the lower face of the chassis plate 17, which is the other one of the faces.

The configuration of the disk drive 9 is similar to that typically used in this type of optical disk apparatus, so the configuration, and the like, are simply described. The disk drive 9 includes a disk rotation mechanism, a disk setting portion elevating mechanism, the optical pick-up 23, a pick-up actuating mechanism, a drive control circuit, and the like. The disk rotation mechanism has a disk setting portion 20 (see FIG. 3) to which the optical disk 2 is detachably set. The mounting portion elevating mechanism raises or lowers the disk setting portion 20 to chuck or release the optical disk 2. The optical pick-up 23 is a specific example of a pick-up device that records information signals into and reproduces information signals from the optical disk 2. The pick-up actuating mechanism moves the optical pick-up 23 radially of the optical disk 2. The drive control circuit drives these mechanisms, and the like.

The disk rotation mechanism, for example, includes a spindle motor and a turntable. The spindle motor employs a stepping motor or a DC servomotor. The turntable is fixed to the rotational shaft of the spindle motor. The turntable serves as the disk setting portion 20 to which the optical disk 2 is detachably set. The stepping motor equipped with the turntable is arranged so that, when the disk tray 12 is transported to the disk setting position, the stepping motor is located at substantially the center of the disk accommodating portion 13. The turntable has a disk fitting portion and a disk support portion. The disk fitting portion is detachably fitted into the center hole of the optical disk 2. The disk support portion supports the surrounding portion of the center hole of the optical disk 2.

The disk setting portion elevating mechanism raises or lowers the disk rotation mechanism at the disk setting position to thereby set the optical disk 2 to the turntable or release the set optical disk 2. The disk setting portion elevating mechanism includes, for example, a motor base, a cam mechanism, an electric motor, and the like. A spindle motor is mounted on the motor base, and the motor base is swingably supported by the base panel 4 of the casing 3. The cam mechanism swings the motor base. The electric motor actuates the cam mechanism to raise or lower the spindle motor. A chucking plate 27 is arranged above the spindle motor. The chucking plate 27 is attracted by a magnet, incorporated in the turntable, to press the optical disk 2 raised by the elevating operation of the spindle motor from above. The chucking plate and the turntable hold the optical disk 2 to prevent the optical disk 2 from slipping out from the turntable and/or sliding on the turntable.

The chucking plate 27 is rotatably supported by a plate supporting plate 28 that is fixed to the upper end of the side portion 4*a* of the base panel 4. The plate supporting plate 28 is formed of a rectangular plate-like member, and the chucking plate 27 is rotatably supported at a longitudinal one end of the plate supporting plate 28. The plate supporting plate 28 is attached in a cantilever manner such that the longitudinal other end of the plate supporting plate 28 is fixed to the upper end of the side portion 4*a* of the base panel 4. The plate supporting plate 28 is supported by an auxiliary plate 29 so that it is difficult to bend. The position of the chucking plate 27 supported by the plate supporting plate 28 corresponds to the disk setting position at which information signals are recorded (written) to and reproduced (read) from the optical disk 2 by the optical pick-up 23.

The disk tray 12 may be transported by a tray transport mechanism between the disk setting position and the disk ejected position outside the casing 3. The tray transport mechanism has a configuration similar to the one typically used in this type of optical disk apparatus, so the configuration, and the like, are simply described. The tray transport mechanism includes, for example, a rack portion, a pinion, an electric motor, and the like. The rack portion is provided in the disk tray 12. The pinion engages the rack portion. The electric motor drives the pinion for rotation. By driving the electric motor to rotate the pinion, the rotational force is transmitted to the rack portion. By so doing, in accordance with the rotational direction of the electric motor, the disk tray 12 is transported from the disk setting position to the disk ejected position or transported from the disk ejected position to the disk setting position.

While the tray transport mechanism is being operated, the optical pick-up 23 of the disk drive 9, particularly, a pick-up lens and its adjacent portions that face the information recording portion of the optical disk 2, are located inside the cutout portion of the disk tray 12. Then, when the optical disk 2 placed on the disk accommodating portion 13 of the disk tray 12 is set to the turntable and raised by a predetermined amount, the optical pick-up 23 enters to below the optical disk 2. Thus, the optical pick-up 23 is able to write information signals to the information recording portion of the optical disk 2 and read information signals from the information recording portion of the optical disk 2. Note that the reference numeral 30 shown in FIG. 4 is an eject button for instructing the tray transport mechanism to perform an ejecting operation.

In this way, when the disk tray 12 is transported to the disk setting position, the motor base is raised by the disk setting portion elevating mechanism to move the spindle motor upward. At this time, the disk fitting portion of the turntable is fitted into the center hole of the optical disk 2, and the optical disk 2 is raised from the disk accommodating portion 13 by a predetermined distance. Then, the chucking plate is attracted by the magnet incorporated in the turntable, and the chucking plate and the turntable hold the optical disk 2. In addition, by actuating the disk setting portion elevating mechanism in the opposite direction to lower the motor base, the disk fitting portion of the turntable slips out from the center hole of the optical disk 2. Thus, the optical disk 2 slips out from the turntable and is placed on the disk accommodating portion 13.

The optical pick-up 23 includes, for example, a photodetector, an objective lens, a biaxial actuator that actuates the objective lens to face the information recording portion of the optical disk 2, and the like. The photodetector of the optical pick-up 23 is formed of a semiconductor laser, which serves as a light source for emitting a light beam, a light-receiving element that receives a returned light beam, and the like. The optical pick-up 23 emits a light beam from the semiconductor laser, collects the emitted light beam by the objective lens and then irradiates the collected light beam to the information recording portion of the optical disk 2, while the photodetector receives a returned light beam reflected on the information recording portion. Thus, the optical pick-up 23 is able to record (write) information signals into the information recording portion and reproduce (read) information signals that are previously recorded in the information recording portion.

The optical pick-up 23 is mounted on a sliding member 26, and is integrally moved with the sliding member 26. In addition, two mutually parallel guide shafts (not shown) are slidably inserted into the sliding member 26. The two guide shafts are arranged substantially parallel to a principal plane that serves as a front face of the information recording portion of the optical disk 2 and extends in a direction in which the disk tray 12 moves. The sliding member 26, which is held slidably by the two guide shafts, is movable radially of the optical disk 2 by the pick-up actuating mechanism.

The pick-up actuating mechanism may, for example, employ a feed screw mechanism formed of a combination of a feed screw and a feed nut. However, the pick-up actuating mechanism is not limited to the feed screw mechanism, and may, for example, employ a rack-and-pinion mechanism, a belt feed mechanism, a wire feed mechanism, or other mechanisms. When the sliding member 26 is moved by the pick-up actuating mechanism, the optical pick-up 23 records information signals into or reproduces information signals from the information recording portion of the optical disk 2.

As shown in FIG. 2 and FIG. 3, the printer 10 of the optical disk apparatus 1 includes the print head 31, a head actuator 32, a distance detector, a cleaning mechanism (not shown), a printing and other operation control circuit (not shown), and the like. The print head 31 accommodates an ink tank. The head actuator 32 moves the print head 31 along a printing surface of the optical disk 2. The distance detector detects a distance between the print head 31 and the printing surface. The cleaning mechanism cleans a sensing element, and the like, of the distance detector. The printing and other operation control circuit controls the operations of these print head 31, head actuator 32, distance detector, cleaning mechanism, and the like.

The print head 31 has a hollow head casing. The head casing accommodates the ink tank having an accommodating portion of one color (for example, black) or accommodating portions of two or more colors (for example, three colors of magenta, cyan and yellow, four colors of magenta, cyan, yellow and black, or the like), and an ink discharge mechanism (not shown) that separately discharges colors from nozzles. The head casing is formed so that a rectangular parallelepiped extended portion is provided on substantially half of one face of another rectangular parallelepiped in the longitudinal direction. An ink discharging unit 37 is provided at substantially the middle of the extended portion for discharging ink. The ink discharging unit 37 has a large number of nozzles having fine diameter holes (several hundreds of holes having a diameter of several μm to several tens of μm). These nozzles are arranged in the same number of columns as the number of colors used. For example, when the print head uses three colors of magenta, cyan and yellow, three columns of nozzles are provided.

The thus configured print head 31 is movable by the head actuator 32 along the printing surface of the optical disk 2. The head actuator 32 includes a head holder 41 that holds the print head 31, a head slider 42 that movably supports the head holder 41, two head guide shafts 43A and 43B that movably support the head slider 42, two guide shaft supports 44A and 44B that fixedly support the two head guide shafts 43A and 43B, a feed screw shaft 45 and a feed nut 46 that move the print head 31, a head feed motor 47 that drives the feed screw shaft 45 for rotation, and the like.

Figure 9:
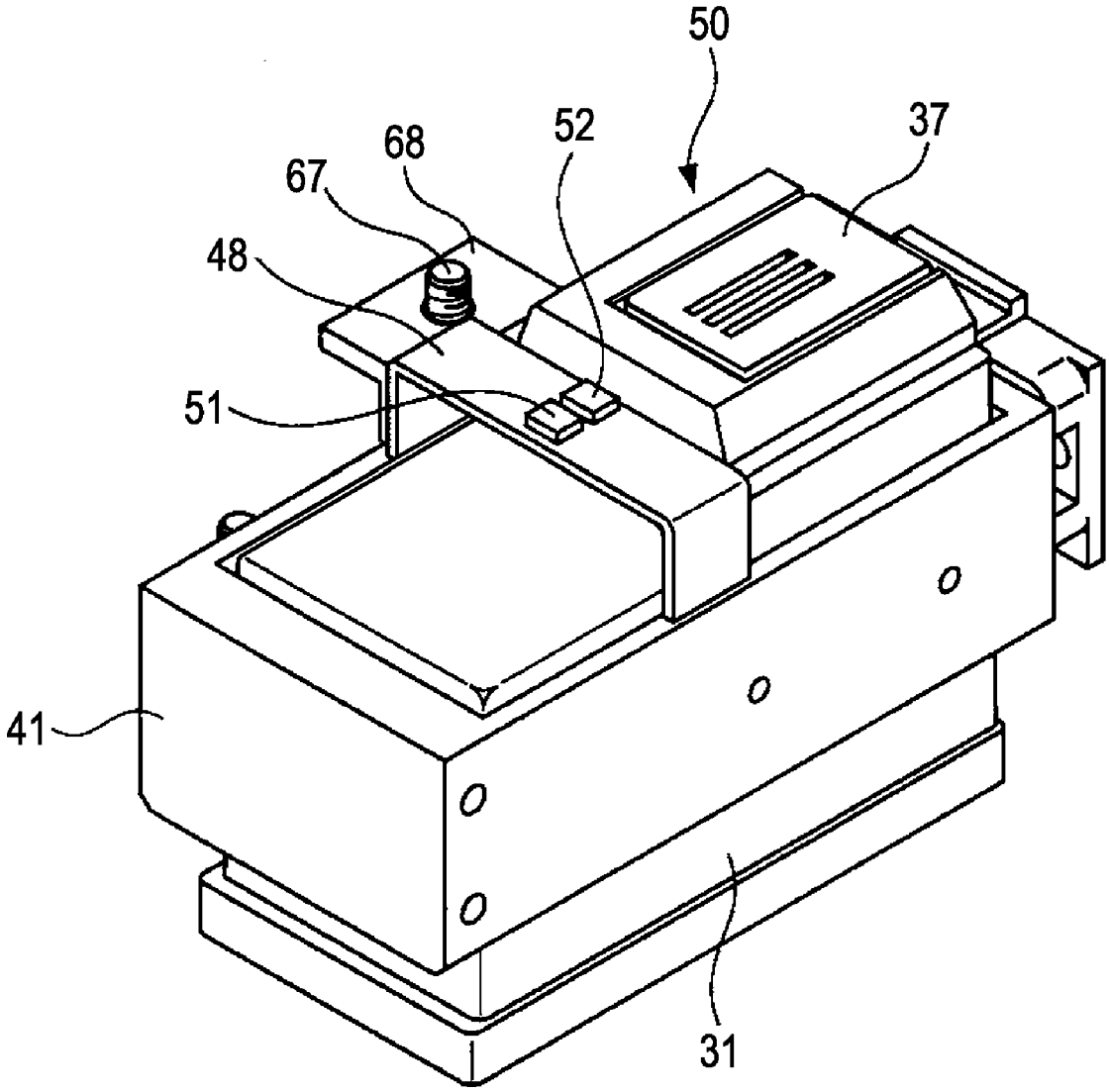
FIG. 9 is a perspective view of the print head assembly of the printer of the optical disk apparatus according to the first embodiment of the printer-equipped disk recording and/or reproducing apparatus of the invention as viewed from the side of an ink discharging unit.

The head holder 41 is a rectangular frame-shaped member to which the print head 31 is fitted. FIG. 9 is a perspective view that illustrates a print head assembly 50, which is formed by fitting the print head 31 into the head holder 41 as viewed obliquely from the side of the ink discharging unit 37 of the print head 31. When the print head 31 is assembled, the ink discharging unit 37 extends through the head holder 41 and protrudes downward from the lower face, which is one of the faces of the head holder 41. A portal U-shaped fitting bracket 48 is provided at the lower face of the head holder 41 so as to extend downward.

Two distance detection sensors 51 and 52, that is, a first distance detection sensor 51 and a second distance detection sensor 52, which are one specific example of the distance detector, are fixedly arranged side by side at substantially the middle of the lower face of the fitting bracket 48. The first and second distance detection sensors 51 and 52 detect a distance between the surface of the ink discharging unit 37 of the print head 31 and the printing surface of the optical disk 2, which is set to the disk setting portion 20 and rotated. The first and second distance detection sensors 51 and 52 may employ any sensors that are able to detect a distance between the ink discharging unit 37 and the printing surface of the optical disk 2, and may desirably be, for example, a reflective photointerrupter.

The photointerrupter is an optical sensor formed of a set of a light-emitting diode (LED) and a photodiode, and mainly uses infrared rays. The photointerrupter includes a reflective type and a transmissive type. The reflective-type interrupter may be used in the embodiment of the invention. The reflective photointerrupter emits light from a LED and detects a reflected light, and the like, with the photodiode to obtain the light reflectance of an object, thus making it possible to accurately detect a distance from the object. A specific example of the reflective photointerrupter may be, for example, a reflective photointerrupter SG-105 produced by Kodenshi Corp. The reflective photointerrupter SG-105 has a light-emitting element and a light-receiving element arranged on the same face, and is able to detect a distance to a target object using light reflected from the object.

The two distance detection sensors 51 and 52 are arranged side by side at portions on the radially inner side of the ink discharging unit 37 of the print head 31 and on the upstream side in the rotational direction of the optical disk 2 with respect to the optical disk 2. The reason why the two distance detection sensors 51 and 52 are arranged on the upstream side in the rotational direction of the optical disk 2 is because part of ink discharged from the ink discharging unit 37 becomes mist to float in the air and, therefore, the mist is prevented from adhering on detecting portions of the distance detection sensors. In this example embodiment, the two distance detection sensors 51 and 52 are arranged on an extension from the substantially middle portion of the ink discharging unit 37 and on the rotational center side of the optical disk 2.

Note that the printing surface of the optical disk 2 is a label surface 2*a*, which serves as one of the faces of the optical disk 2. In addition, when a label sheet 53 is adhered on the label surface 2*a* of the optical disk 2, a surface 53*a* of the adhered label sheet 53 is the printing surface. The head holder 41, to which the print head 31 is assembled, is movably supported by the head slider 42.

Figure 6:
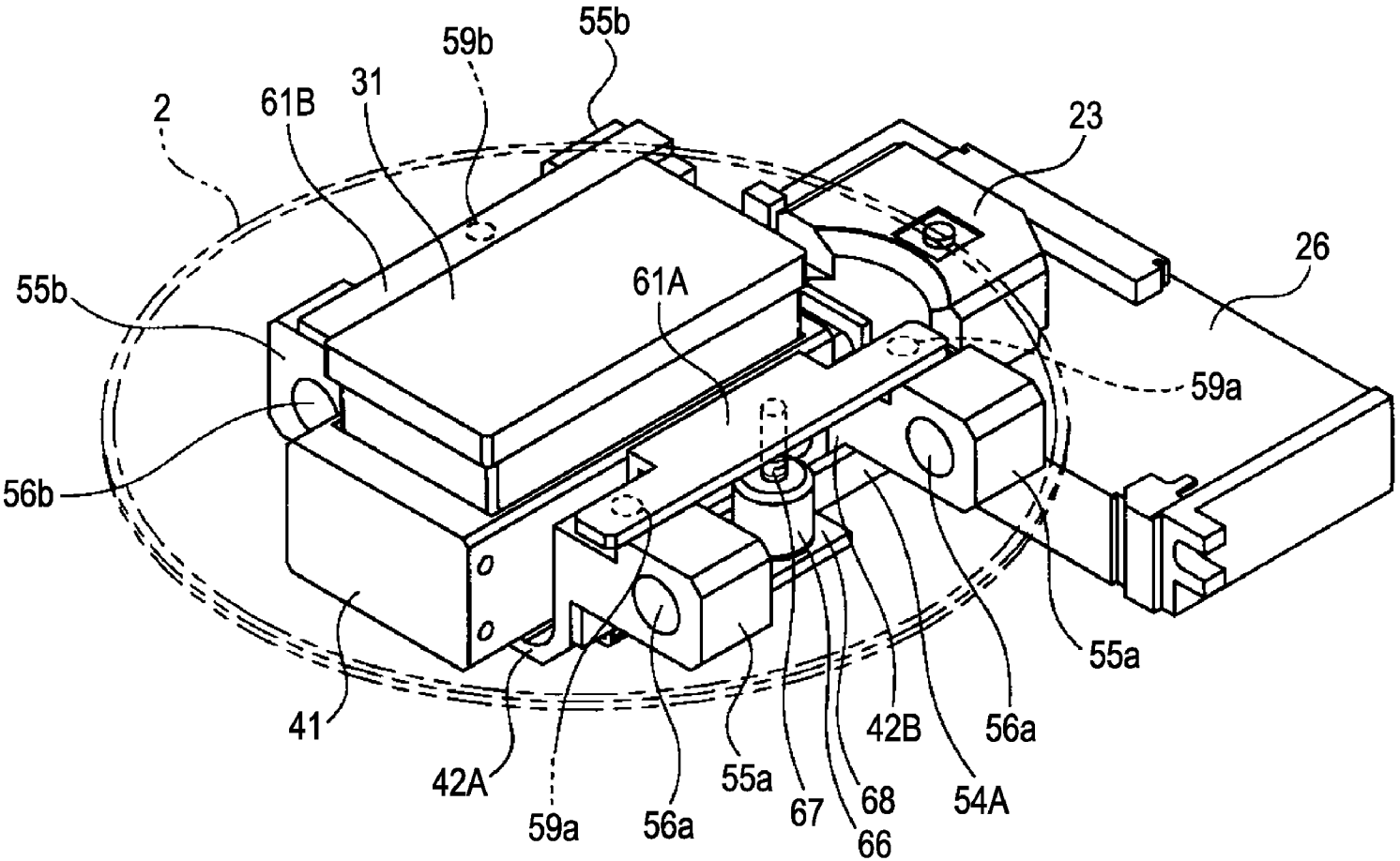
FIG. 6 is a perspective view illustrating the positional relationship among a print head of the printer, an optical pick-up of a disk drive, and an optical disk in the optical disk apparatus according to the first embodiment of the printer-equipped disk recording and/or reproducing apparatus of the invention.
Figure 7:
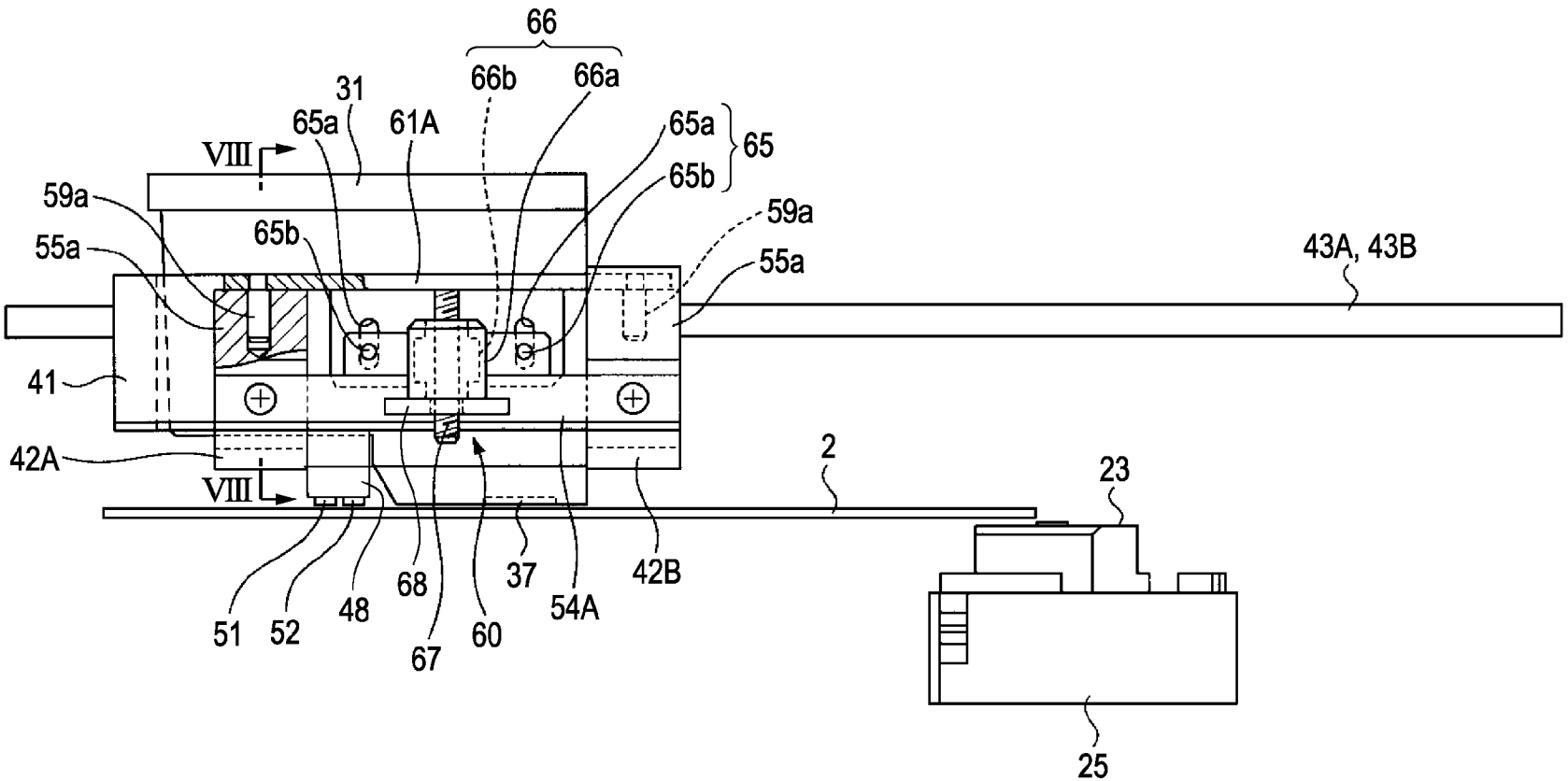
FIG. 7 is a side view illustrating the positional relationship among the print head of the printer, the optical pick-up of the disk drive, and the optical disk in the optical disk apparatus according to the first embodiment of the printer-equipped disk recording and/or reproducing apparatus of the invention.

FIG. 6 is a view that illustrates the head holder 41 and the head slider 42 that supports the head holder 41. In addition, FIG. 7 is a view that illustrates the positional relationship in level among the print head 31, the optical disk 2 and the optical pick-up 23. As shown in FIG. 6 and FIG. 7, the optical disk 2 faces the head slider 42 from below at a predetermined gap. At this time, the optical disk 2 is set to the turntable (not shown) of the disk rotation mechanism of the disk drive 9 that is arranged on the opposite side of the chassis plate 17, and the optical pick-up 23 is able to approach and leave the turntable in a direction perpendicular to the direction of the principal plane of the optical disk 2.

The head slider 42 includes a front-side member 42A, a rear-side member 42B, and right and left connecting members 54A and 54B. The front-side member 42A and the rear-side member 42B are arranged at an interval therebetween in the fore-and-aft direction, that is, the longitudinal direction of the print head 31. The right and left connecting members 54A and 54B are arranged at an interval therebetween in the transverse direction and connect the front-side member 42A with the rear-side member 42B. The front-side member 42A and the rear-side member 42B each extend upward from both side ends at a predetermined interval in the transverse direction that intersects with the longitudinal direction. Then, first bearing portions 55*a* are provided at the distal ends of one upright sides so as to protrude laterally, and second bearing portions 55*b* are provided at the distal ends of the other upright sides so as to protrude laterally in the opposite direction.

The first bearing portions 55*a* each have a first bearing hole 56*a*. The two first bearing holes 56*a* are aligned on the same axis. Similarly, the second bearing portions 55*b* each have a second bearing hole 56*b*. The two second bearing holes 56*b* are aligned on the same axis. Then, bearing members 58 are respectively fitted in the first bearing holes 56*a* and the second bearing holes 56*b*, and fixed by a fixation manner such as press fitting. Two guide shafts 43A and 43B are slidably inserted into these bearing members 58.

Figure 8:
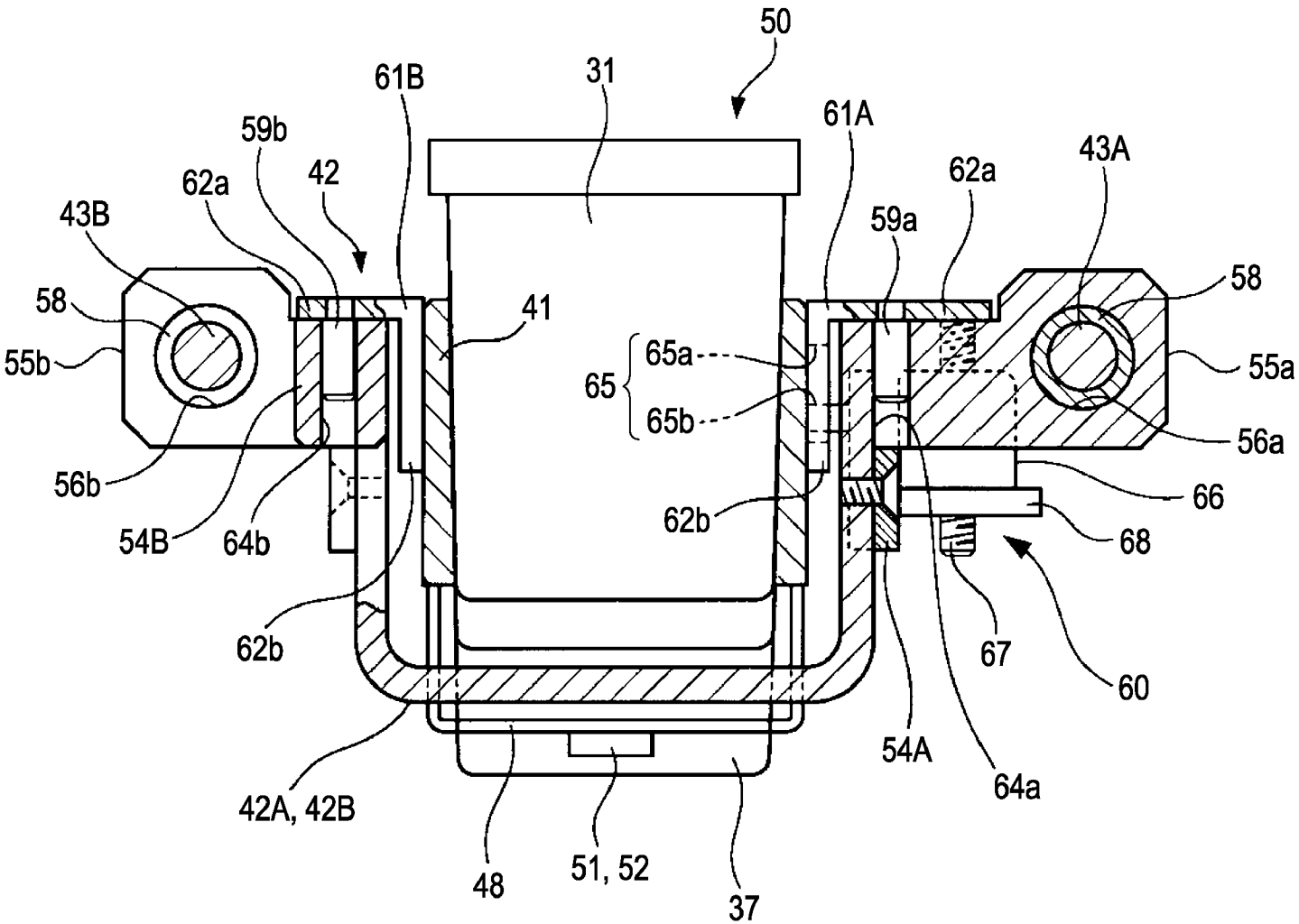
FIG. 8 is a cross-sectional view illustrating a print head assembly, taken along the line VIII-VIII in FIG. 7.

FIG. 8 is a view that illustrates a state in which the print head 31 is held by the head holder 41 and a state in which the head holder 41 is supported movably with respect to the head slider 42 through three guide pins 59*a* and 59*b*. A first support plate 61A is attached to one long side portion of the head holder 41, and a second support plate 61B is attached to the other long side portion of the head holder 41. The two support plates 61A and 61B each have an upper face portion 62*a* and a side portion 62*b*, and is formed to have an L-shaped cross section by connecting the end of the upper face portion 62*a* with the end of the side portion 62*b*.

The two support plates 61A and 61B each are united with the head holder 41 by fixing the side portion 62*b* to the long side portion of the head holder 41. Thus, the upper face portion 62*a* of the first support plate 61A faces the upper faces of the first bearing portions 55*a* that are arranged at a predetermined interval in the fore-and-aft direction at a widthwise one side of the print head 31. Then, the upper face portion 62*a* of the second support plate 61B faces the upper faces of the second bearing portions 55*b* that are arranged at a predetermined interval in the fore-and-aft direction at the widthwise other side of the print head 31.

The guide pins 59*a* are provided at both longitudinal ends of the upper face portion 62*a* of the first support plate 61A so as to extend downward, that is, a direction substantially parallel to the side portion 62*b* of the first support plate 61A. The two guide pins 59*a* are slidably inserted respectively in guide holes 64*a* that are provided so as to open at the upper faces of the two bearing portions 55*a*. In addition, the single guide pin 59*b* is provided at a longitudinally middle portion of the upper face portion 62*a* of the second support plate 61B so as to extend downward, that is, a direction substantially parallel to the side portion 62*b* of the second support plate 61B. The guide pin 59*b* is slidably inserted in a guide hole 64*b* that is provided so as to open at the upper face of the connecting member 54B. These guide pins 59*a* and 59*b* and guide holes 64*a* and 64*b* constitute a first guide mechanism that serves to regulate movement of the head holder 41 to move the head holder 41 substantially parallel to the head slider 42.

Furthermore, in order to enhance the parallel movement operation of the head holder 41 with respect to the head slider 42, in this example embodiment, a second guide mechanism 65 is provided. The second guide mechanism 65 is formed of two oblong holes 65*a* and two protrusions 65*b* that are slidably engaged with the oblong holes 65*a*. The two oblong holes 65*a* are formed in the side portion 62*b* of the first support plate 61A. The oblong holes 65*a* are arranged at a predetermined interval in the transverse direction and are formed so as to extend in the vertical direction. In correspondence with the oblong holes 65*a*, the two protrusions 65*b* are provided on the inner face of the first connecting member 54A at a predetermined interval so as to protrude inward.

The reason why two types of guide mechanisms for moving the head holder 41 substantially parallel to the head slider 42 are provided is because an electric motor, which is a power source for actuating the head holder 41, may be required to be arranged at a horizontal one side of the print head 31. That is, an adjustment motor 66, such as a stepping motor, for moving the head holder 41 with respect to the head slider 42 is arranged at a widthwise one side of the head holder 41.

The adjustment motor 66 includes a fixing portion 66*a* fixed to the side of the head slider 42, a rotating portion 66*b* having a feed nut that is rotatably held by the fixing portion 66*a*, and a screw shaft 67 that extends through the rotating portion 66*b*. The fixing portion 66*a* of the adjustment motor 66 is mounted on a shelf plate 68, which is provided and integrally fixed on the first connecting member 54A. In addition, the screw shaft 67 is attached to the head holder 41 in such a manner that one end of the screw shaft 67 is fixed to the lower surface of the first support plate 61A. The screw shaft 67 extends vertically through the middle portion of the adjustment motor 66 and protrudes downward of the shelf plate 68.

The above described adjustment motor 66 and screw shaft 67 constitute a distance adjustment unit 60 that adjusts a distance S by moving the print head 31 so as to approach or leave the printing surface. Thus, when the adjustment motor 66 is driven, rotation of the feed nut based on the rotation of the rotating portion 66*b* axially moves the screw shaft 67 in accordance with the rotational direction thereof. The movement of the screw shaft 67 moves the print head 31 together with the head holder 41 that is fixed through the first support plate 61A in a direction (a direction normal to the principal plane of the optical disk 2) normal to a direction in which the head slider 42 moves (fore-and-aft direction).

At this time, the adjustment motor 66 is arranged at one side of the print head 31, and the axis of the screw shaft 67 is located remote from the middle portion of the print head 31. Thus, a rotation moment is generated at the print head 31 due to a moving force of the screw shaft 67 that is axially movable, and a component force applied in a direction perpendicular to the above normal direction acts on the print head 31. This perpendicular component force acts as a resistance force that inhibits smooth movement of the print head 31 in the normal direction.

In contrast, in this example embodiment, the two support plates 61A and 61B are fixed to the head holder 41, and the guide pins 59*a* and 59*b* are provided for the support plates 61A and 61B. Then, the guide pins 59*a* are slidably engaged with the guide holes 64*a* formed in the front-side member 42A and rear-side member 42B of the head slider 42 and the guide pin 59*b* is slidably engaged with the guide hole 64*b* formed in the second support plate 61B. Moreover, these three guide pins 59*a* and 59*b* are arranged in a well-balanced manner so as to form a triangle, so the three guide pins 59*a* and 59*b* may be slid in the same condition. As a result, it is possible to smoothly move the head holder 41 parallel to the normal direction while maintaining substantially the horizontal state of the head holder 41.

Furthermore, the two oblong holes 65*a* are formed in the side portion 62*b* of the first support plate 61A, and the two protrusions 65*b* engaged slidably with these oblong holes 65*a* are provided on the first connecting member 54A. Thus, it is possible to further accurately maintain the horizontal state of the head holder 41, and it is possible to reliably and smoothly move the head holder 41 in the normal direction.

The print head 31 provided with the thus configured distance adjustment unit 60 is movably supported by the two head guide shafts 43A and 43B. As shown in FIG. 5, the first head guide shaft 43A is slidably inserted into the bearing members 58 in the two bearing holes 56*a* of the first bearing portions 55*a* provided at one side of the head slider 42. Then, the second guide shaft 43B is slidably inserted into the bearing members 58 in the two bearing holes 56*b* of the second bearing portion 55*b* provided at the other side of the head slider 42.

The two guide shafts 43A and 43B extend longitudinally of the opening 18 formed in the chassis plate 17, and are arranged parallel to each other at a predetermined interval. Then, the two guide shafts 43A and 43B are fixedly supported by the two guide shaft supports 44A and 44B at both ends. The two guide shaft supports 44A and 44B are arranged on the longitudinal both sides of the opening 18, and each are fixed to the chassis plate 17 with a fixation screw.

The feed screw shaft 45 is arranged at a predetermined interval on the outer side of the one guide shaft 43B. The feed screw shaft 45 is provided parallel to the two guide shafts 43A and 43B, and is coupled to the rotating shaft of the head feed motor 47 by a joint 71 attached to one axial end of the feed screw shaft 45. The head feed motor 47 is fixed to a motor bracket 72. The motor bracket 72 is fixed to the chassis plate 17 by a fixation manner such as a fixation screw. The feed nut 46 is screwed to the feed screw shaft 45. A nut fitting plate 73 is fixed to the feed nut 46. The nut fitting plate 73 is fixed to the head slider 42 by a fixation screw.

Thus, when the head feed motor 47 is driven, rotational force of the rotating shaft is transmitted through the joint 71 to the feed screw shaft 45 and further transmitted to the feed nut 46. At this time, the feed nut 46 does not rotate because it is fixed to the head slider 42 through the nut fitting plate 73, but the head slider 42 is axially movable so that it is guided by the two head guide shafts 43A and 43B. Thus, the feed nut 46 selectively moves in a direction to approach the head feed motor 47 or a direction to leave the head feed motor 47 in accordance with the rotational direction of the feed screw shaft 45. By so doing, the head slider 42 integrally moves with the feed nut 46 and, as a result, the print head 31 is moved in the fore-and-aft direction, which is the same direction as the axial direction of the feed screw shaft 45.

Movement of the print head 31 in the fore-and-aft direction is detectable by two position detection sensors 74 and 75. The first position detection sensor 74 detects a disk inner stop position at which the ink discharging unit 37 of the print head 31 is located after the ink discharging unit 37 of the print head 31 moves radially inward of the optical disk 2 and passes a portion closest to the center portion by a predetermined distance. In addition, the second position detection sensor 75 detects a disk outer stop position at which the ink discharging unit 37 of the print head 31 is located farthest from the center portion after the ink discharging unit 37 of the print head 31 moves radially outward of the optical disk 2.

In order to detect these positions, a position detection piece 76 is attached to the nut fitting plate 73. When the first position detection sensor 74 detects the position detection piece 76, the disk inner stop position is detected and the print head 31 is stopped at that position. Similarly, when the second position detection sensor 75 detects the position detection piece 76, the disk outer stop position is detected, and the print head 31 is stopped at that position.

FIG. 3 shows a state in which the printer 10 is accommodated inside the casing 3 and is overlapped with the disk tray 12, and the like, with the chassis plate 17 removed. In the optical disk apparatus 1, a head center line Lb that passes through the ink discharging unit 37 located substantially in the middle of the print head 31 of the printer 10 is set at a position offset by a distance E from a body center line La that passes through a rotation center Oc of the disk setting portion (turntable) 20, which is the middle portion of the disk drive 9. Thus, the print head 31 executes a printing operation on the printing surface of the optical disk 2 while moving on the locus of the head center line Lb offset by the distance E from the rotation center Oc.

Figure 28:
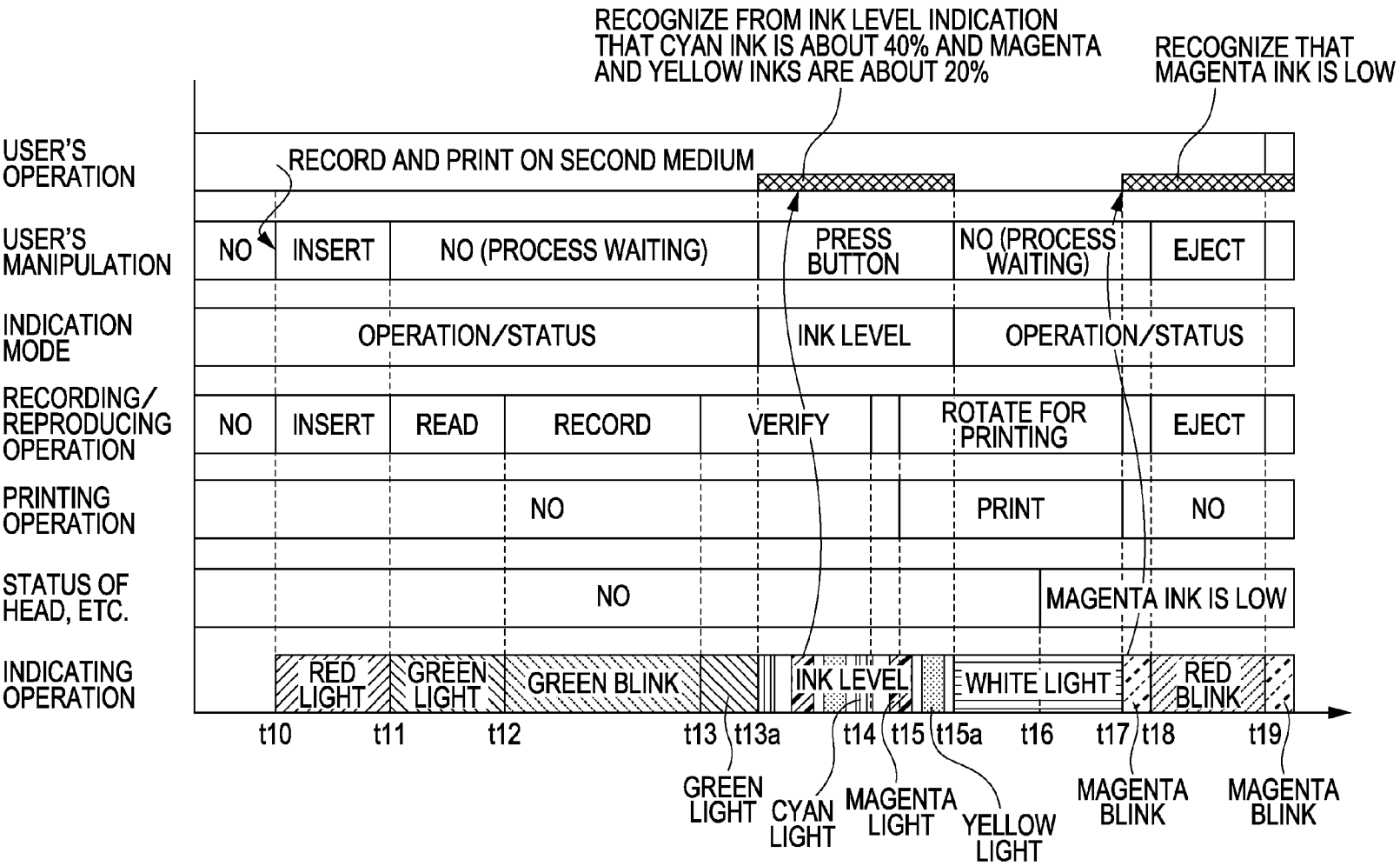
FIG. 28 is a view illustrating a second example embodiment of control with an ink level information button in the control unit of the optical disk apparatus according to the first embodiment of the printer-equipped disk recording and/or reproducing apparatus of the invention.

In addition, a head cap 77 and an ink reservoir 78 are arranged in the rear side of the casing 3 on the head center line Lb. The head cap 77 is assembled to the ink discharging unit 37 of the print head 31. The head cap 77 prevents drying of the nozzles of the ink discharging unit 37 to thereby prevent ink from being clogged in the nozzles. In addition, the ink reservoir 78 prevents a print error that no ink is discharged by performing idle discharge so as not to entrap air into the nozzles of the ink discharging unit 37. FIG. 28 is a view that illustrates definition of direction of the optical disk 2. That is, the radial direction Y of the optical disk 2 corresponds to a radial direction, and the tangential direction X perpendicular to the radial direction Y corresponds to a tangential direction.

Figure 10:
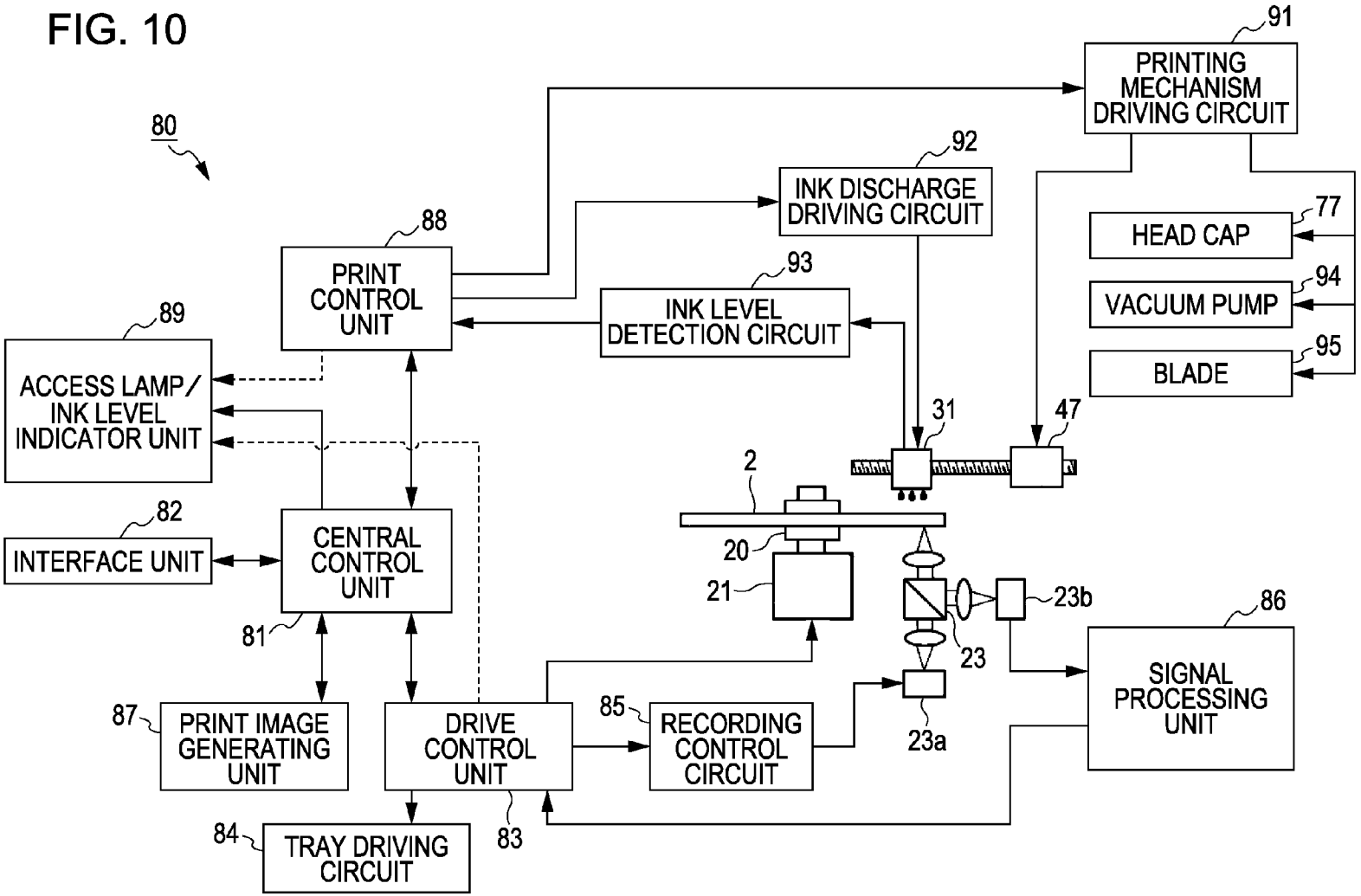
FIG. 10 is a block diagram illustrating a schematic configuration of a control unit of the optical disk apparatus according to the first embodiment of the printer-equipped disk recording and/or reproducing apparatus of the invention.

FIG. 10 is a block diagram that shows the flow of signals in the optical disk apparatus 1. The controller 80 of the optical disk apparatus 1 includes a central control unit 81, an interface unit 82, a drive control unit 83, a tray driving circuit 84, a recording control circuit 85, a signal processing unit 86, a print image generating unit 87, a print control unit 88, a distance sensor driving circuit 90, a printing mechanism driving circuit 91, an ink discharge driving circuit 92, an ink level detection circuit 93, and the like.

The central control unit 81 controls the drive control unit 83, the print image generating unit 87 and the print control unit 88. The central control unit 81 outputs a record data signal, supplied from the interface unit 82, to the drive control unit 83. In addition, the central control unit 81 outputs an image data signal, supplied from the interface unit 82, and a positional data signal, supplied from the drive control unit 83, to the print image generating unit 87 and the print control unit 88.

The interface unit 82 is a connecting portion that electrically connects an external device, such as a personal computer and a DVD recorder, with the optical disk apparatus 1. The interface unit 82 outputs a signal, supplied from the external device, to the central control unit 81. The signal supplied to the central control unit 81 corresponds to externally stored information that is stored in the external device, and may be, for example, a record data signal corresponding to recording information to be recorded in the information recording portion of the optical disk 2, an image data signal corresponding to visual information to be printed on the printing surface of the optical disk 2 (the surface of the optical disk 2 or the surface of a label sheet). Furthermore, the interface unit 82 outputs a reproduce data signal, which is read from the information recording portion of the optical disk 2 by the optical disk apparatus 1, to the external device. An example of specifications of such electrical connection with the external device may be, for example, the ATA standard (AT Attachment), the Serial ATA standard (SATA), the SCSI standard (Small Computer System Interface), or the USB standard (Universal Serial Bus).

The drive control unit 83 controls rotation of the spindle motor 21 of the disk rotation mechanism, and controls operation of the tray driving circuit 84 and operation of the recording control circuit 85. That is, the drive control unit 83 outputs a control signal on the basis of a control signal supplied from the central control unit 81 to thereby drive the spindle motor 21. Thus, the optical disk 2 set to the turntable 20 of the spindle motor 21 is, for example, rotated at a constant linear velocity. Furthermore, in order to control operation of the tray driving circuit 84 and operation of the recording control circuit 85, the drive control unit 83 outputs control signals to the tray driving circuit 84 and the recording control circuit 85. In addition, the drive control unit 83 outputs a position data signal, supplied from the signal processing unit 86, to the central control unit 81.

The tray driving circuit 84 controls rotation of a drive motor (not shown) of the tray transport mechanism. The tray drive motor is driven on the basis of a control signal output from the tray driving circuit 84. Thus, the disk tray 12 is transported between the disk setting position inside the casing 3 and the disk ejected position outside the casing 3. In addition, the recording control circuit 85 controls the optical pick-up 23 to record a record data signal, reproduce a reproduce data signal, and the like.

The optical pick-up 23 has a laser light source 23*a* and a light-receiving element 23*b*. A light beam emitted from the laser light source 23*a* and irradiated from the pick-up lens is reflected on the information recording portion of the optical disk 2 and then received by the light-receiving element 23*b*. The recording control circuit 85 outputs, to the optical pick-up 23, a control signal for executing a track servo and a focus servo in such a manner that the light beam tracks a track provided in the information recording portion. The pick-up drive motor is driven on the basis of a control signal supplied from the recording control circuit 85. Thus, the optical pick-up 23 is moved radially of the optical disk 2 together with the sliding member.

The signal processing unit 86 demodulates an RF (Radio Frequency) signal supplied from the optical pick-up 23, performs error detection, and the like, to generate a reproduce data signal. In addition, the signal processing unit 86 detects a signal having a specific pattern, such as a synchronization signal and a position data signal as a signal that indicates position data of the optical disk 2 on the basis of the RF signal. The position data signal may be, for example, a rotation angle signal that indicates a rotation angle of the optical disk 2 and a rotation position signal that indicates a rotation position of the optical disk 2. These reproduce data signal and position data signal are output to the drive control unit 83.

The print image generating unit 87 generates a print image on the basis of a control signal supplied from the central control unit 81. In addition, the print control unit 88 controls the print head 31 of the printer 10, a head driving mechanism that actuates the print head 31, the distance detector that detects a distance between the print head and the printing surface, a cleaning mechanism, which will be described later, that cleans the print head 31 and the distance detector, and the like, on the basis of control signals supplied from the central control unit 81.

The print control unit 88 generates ink discharge data on the basis of image data obtained through image data signals that are generated by the print image generating unit 87 and supplied from the central control unit 81. Then, the print control unit 88 generates control signals for controlling the printer 10 on the basis of the generated discharge data and position data signals supplied from the central control unit 81, and outputs the control signals to the printing mechanism driving circuit 91 and the ink discharge driving circuit 92. The print control unit 88 controls the printing mechanism driving circuit 91 and the ink discharge driving circuit 92 to thereby print out desired visual information on the printing surface of the optical disk 2 through control of the print head 31.

The access lamp/ink level indicator unit 89 is formed of the above described indicator lamp 21. The access lamp/ink level indicator unit 89 is supplied with a control signal from the central control unit 81, a control signal from the drive control unit 83, and a control signal from the print control unit 88. Then, through these control signals, the indicator lamp 21 is controlled to light up or blink in a predetermined color as described above.

The printing mechanism driving circuit 91 drives the head feed motor 47, the head cap 77, a vacuum pump 94, and a blade 95 on the basis of control signals supplied from the print control unit 88. At this time, when the head feed motor 47 is driven, the print head 31 is moved from radially inner side of the optical disk 2 toward the outer side. The direction in which the print head 31 moves may be set opposite to this example embodiment, that is, the print head 31 may be moved from the radially outer side of the optical disk 2 toward the inner side.

The ink discharge driving circuit 92 drives the print head 31 on the basis of control signals supplied from the print control unit 88. Thus, ink droplets are discharged from discharge nozzles of the ink discharging unit 37 of the print head 31, and the ink droplets are adhered onto the printing surface of the rotated optical disk 2. The print head 31, for example, accommodates three colors, that is, C (cyan), Y (yellow), and M (magenta). With a combination of these three types of ink, visual information formed of image data expressed by gray-scale levels that represent brightness of each color of R (red), G (green), and B (blue) is displayed.

The ink discharge driving circuit 92 detects the ink levels contained in the print head 31, and indicates the degrees of the ink levels with an indicator. The ink level is detected for each ink used; however, the amount of ink consumed depends on printing conditions, so normally, when any one of the ink levels is reduced to a predetermined amount or below, the low ink level is indicated.

Generally, not all ink droplets discharged from the print head 31 of the printer 10 land on the printing surface. Non-landed ink droplets become mist to float in the air inside the apparatus and then contaminate internal mechanisms and devices. In order to reduce the mist, it is desirable that the distance between the print head 31 and the printing surface is reduced. However, because the optical disk 2 may undergo surface runout, if the distance is reduced too much (the print head 31 is brought close to the printing surface too much), the print head 31 may possibly collide with the printing surface. In addition, the optical disk 2 has specifications in thickness, and the like, so the optical disk 2 having a predetermined thickness or above is not normally used.

Figure 15:
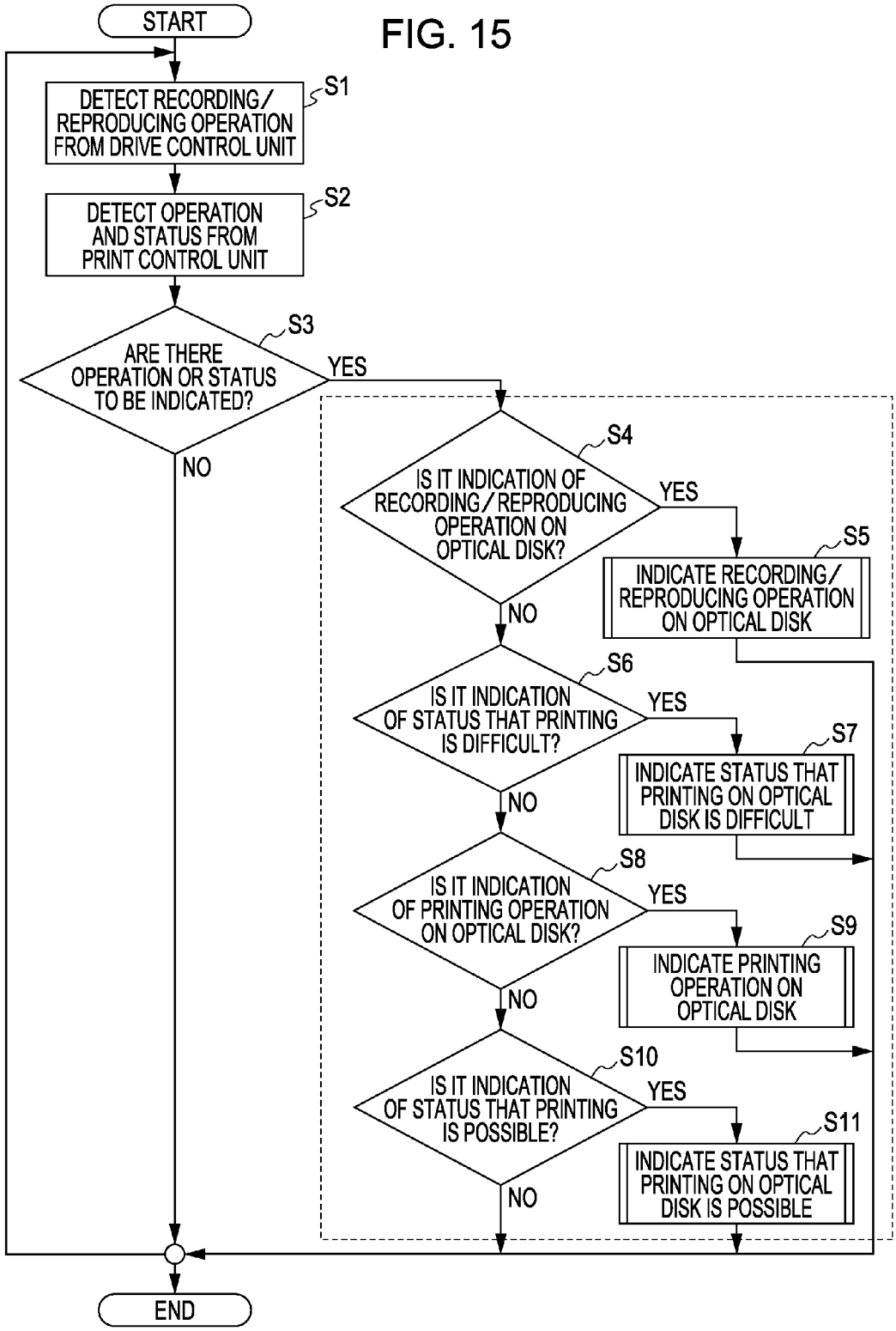
FIG. 15 is a flowchart that shows a first example embodiment of the process flow in the control unit of the optical disk apparatus according to the first embodiment of the printer-equipped disk recording and/or reproducing apparatus of the invention.

FIG. 15 is a flowchart that shows a first example embodiment of control of an ink level indication by the access lamp/ink level indicator unit 89. This example embodiment shows an example embodiment without the above described ink level information button 22. First, when power is turned on to start the process, in step S1, the access lamp/ink level indicator unit 89 is supplied from the drive control unit 83 with a signal for detecting a recording/reproducing operation mode of the disk drive 9. Next, in step S2, the access lamp/ink level indicator unit 89 is supplied from the print control unit 88 with signals for detecting a status of a printing operation of the printer 10 and a status of each ink level in the ink tank.

Next, in step S3, the access lamp/ink level indicator unit 89 determines whether there is an operation or a status to be indicated from among the operation and status of the optical disk apparatus 1, detected in step S1 and step S2. In step S3, when it is determined that there is no operation or status to be indicated, that is, there is no recording or reproducing operation on the optical disk 2 by the disk drive 9 or no inserting or ejecting operation of the optical disk 2, and there is no printing operation by the printer 10, the process ends. Then, the process of step S1 to step S3 is repeated until power is turned off. On the other hand, in step S3, when it is determined that there is an operation or a status to be indicated, the process proceeds to step S4.

In step S4, it is determined whether it is an indication of a recording/reproducing operation on the optical disk 2. In step S4, when it is determined that it is an indication of the recording/reproducing operation on the optical disk 2, the process proceeds to step S5 and then executes an indication of the recording/reproducing operation on the optical disk 2 using the indicator lamp 21. The process of indicating a recording/reproducing operation is, for example, executed by the process as shown in FIG. 16.

Figure 16:
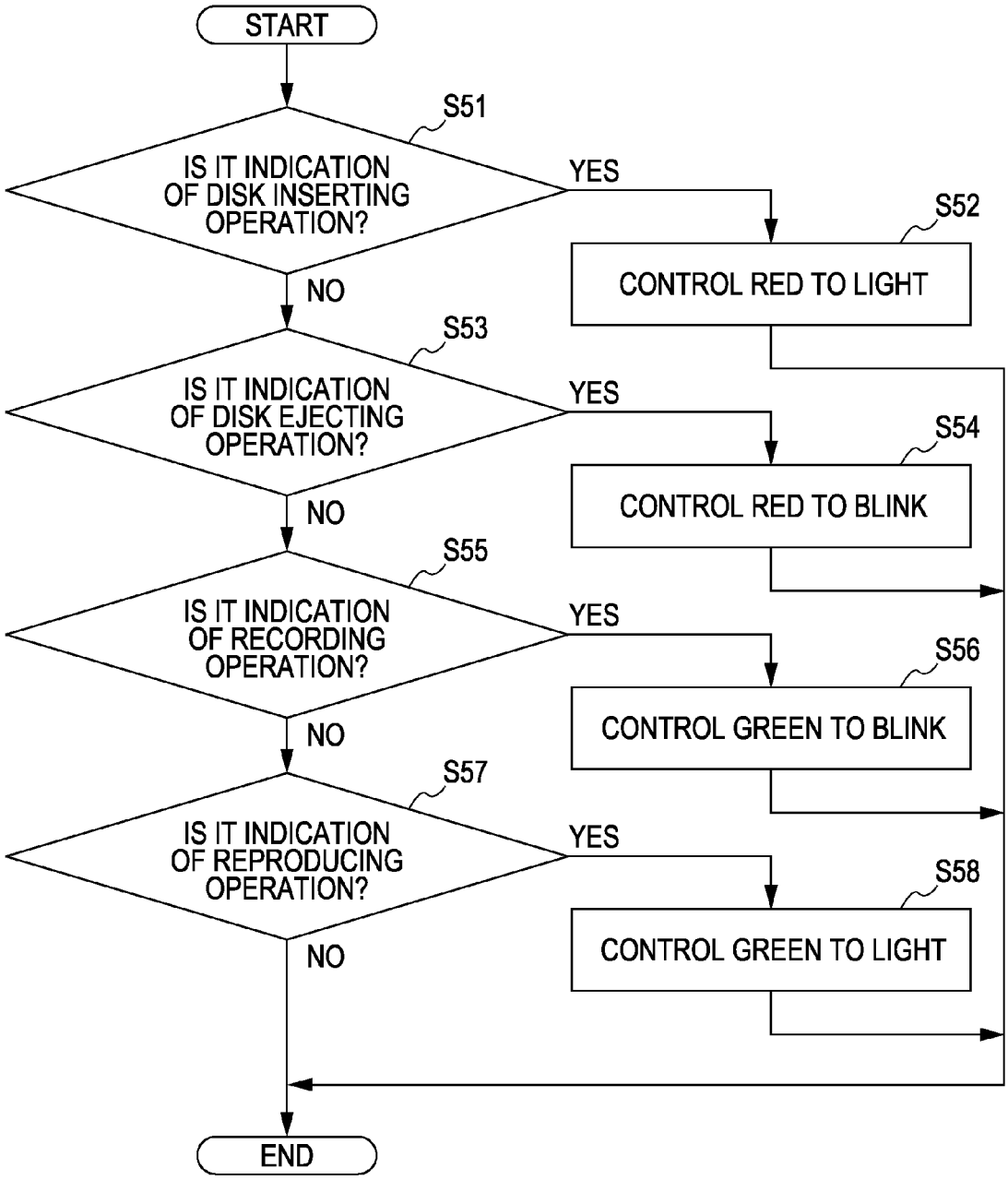
FIG. 16 is a flowchart that shows one example embodiment of a process of indicating a recording/reproducing operation (step S5) in the flowchart of FIG. 15.

In FIG. 16, first, in step S51, it is determined whether it is an indication of an operation that the optical disk 2 is inserted into the disk drive 9 and set to the disk setting portion. In step S51, when it is determined that it is an indication of the operation that the optical disk 2 undergoes an inserting operation, the process proceeds to step S52 and then outputs a control signal for lighting the indicator lamp 21 in red. Thus, the indicator lamp 21 lights up in red. After that, the process ends and returns to step S1, and then the process of step S1 to step S11 is repeated. Then, when power is turned off, the last process ends. On the other hand, in step S51, when it is determined that it is not an indication of the operation that the optical disk 2 is inserted, the process proceeds to step S53.

In step S53, it is determined whether it is an indication of an operation that the optical disk 2 is detached from the disk setting portion and is ejected from the disk drive 9. In step S53, when it is determined that it is an indication of the operation that the optical disk 2 undergoes an ejecting operation, the process proceeds to step S54 and then outputs a control signal for blinking the indicator lamp 21 in red. Thus, the indicator lamp 21 blinks in red. After that, the process ends and returns to step S1, and then the process of step S1 to step S11 is repeated. Then, when power is turned off, the last process ends. On the other hand, in step S53, when it is determined that it is not an indication of the operation that the optical disk 2 is ejected, the process proceeds to step S55.

In step S55, it is determined whether it is an indication of an operation that the disk drive 9 performs recording on the optical disk 2. In step S55, when it is determined that it is an indication of the operation that the optical disk 2 undergoes a recording operation, the process proceeds to step S56 and then outputs a control signal for blinking the indicator lamp 21 in green. Thus, the indicator lamp 21 blinks in green. After that, the process ends and returns to step S1, and then the process of step S1 to step S11 is repeated. Then, when power is turned off, the last process ends. On the other hand, in step S55, when it is determined that it is not an indication of the operation that the optical disk 2 undergoes a recording operation, the process proceeds to step S57.

In step S57, it is determined whether it is an indication of an operation that the disk drive 9 performs reproducing on the optical disk 2. In step S57, when it is determined that it is an indication of the operation that the optical disk 2 undergoes a reproducing operation, the process proceeds to step S58 and then outputs a control signal for lighting the indicator lamp 21 in green. Thus, the indicator lamp 21 lights up in green. After that, the process ends and returns to step S1. When power is turned off, the last process ends. On the other hand, in step S57, when it is determined that it is not an indication of the operation that the optical disk 2 undergoes a reproducing operation, the process ends and returns to step S1. After that, the process of step S1 to step S11 is repeated. Then, when power is turned off, the last process ends.

Next, referring back to FIG. 15, in step S4, when it is determined that it is not an indication of the operation that the optical disk 2 undergoes a recording/reproducing operation, the process proceeds to step S6. In step S6, it is determined whether it is an indication of a status that printing is difficult. That is, it is determined whether it is difficult for the printer 10 to normally perform printing because of, for example, the situation that ink is out in the ink tank. In step S6, when it is determined that it is an indication of the status that printing is difficult, the process proceeds to step S7 and then executes an indication of the status that printing on the optical disk 2 is difficult using the indicator lamp 21. The process of indicating the status that printing is difficult is, for example, executed as shown in FIG. 17.

Figure 17:
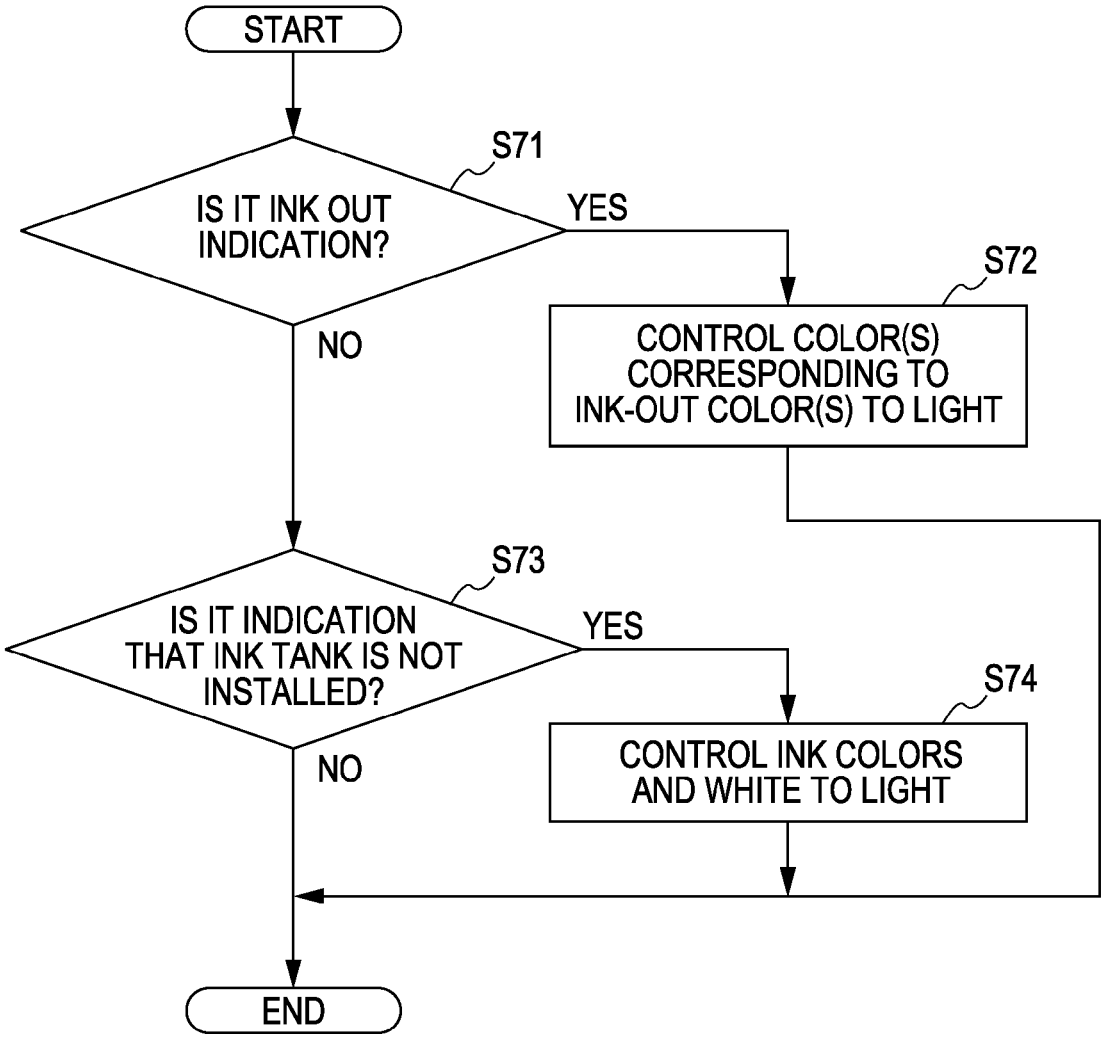
FIG. 17 is a flowchart that shows one example embodiment of a process of indicating a status that printing is difficult (step S7) in the flowchart of FIG. 15.

In FIG. 17, first, in step S71, it is determined whether it is an indication of the status that ink is out in the ink tank. In step S71, it is determined that it is an indication of the status that ink is out, the process proceeds to step S72 and then the indicator lamp 21 lights up in color corresponding to an ink-out color. For example, when only one color ink, that is, cyan (C) ink, is out, the indicator lamp 21 continuously lights up only in cyan. In addition, for example, when all three color inks, that is, cyan (C), magenta (M) and yellow (Y) inks, are out, the indicator lamp 21 sequentially lights up in all three colors, that is, cyan, magenta and yellow, at predetermined equal time intervals and then repeats the lighting. The process ends and returns to step S1, and then the process of step S1 to step S11 is repeated. Then, when power is turned off, the last process ends. On the other hand, in step S71, when it is determined that it is not an indication of the status that ink is out, the process proceeds to step S73.

In step S73, it is determined whether it is an indication of a status that ink is not installed, that is, whether the print head 31 having an ink tank is set in the printer 10. In step S73, when it is determined that it is an indication of the status that an ink tank (print head) is not installed, the process proceeds to step S74 and then outputs a control signal for sequentially lighting all the ink colors (in this example embodiment, three colors) contained in the ink tank in addition to white color for respective predetermined time intervals. Thus, the indicator lamp 21 successively lights up in four colors at predetermined time intervals. After that, the process ends and returns to step S1, and then the process of step S1 to step S11 is repeated. Then, when power is turned off, the last process ends. On the other hand, in step S73, it is determined that it is not an indication of the status that an ink tank (print head) is not installed, the process ends and returns to step S1, and then the process of step S1 to step S11 is repeated. Then, when power is turned off, the last process ends.

Next, referring back to FIG. 15, in step S6, when it is determined that it is not an indication of the status that printing is difficult, the process proceeds to step S8. In step S8, it is determined whether it is an indication of a printing operation on the optical disk 2. In step S8, the determination is made whether it is a cleaning operation, a printing operation, or not. In step S8, when it is determined that it is an indication of the printing operation on the optical disk 2, the process proceeds to step S9 and then executes an indication that the optical disk 2 undergoes a printing operation using the indicator lamp 21. The process of indicating a printing operation on the optical disk 2 is, for example, executed as shown in FIG. 18.

Figure 18:
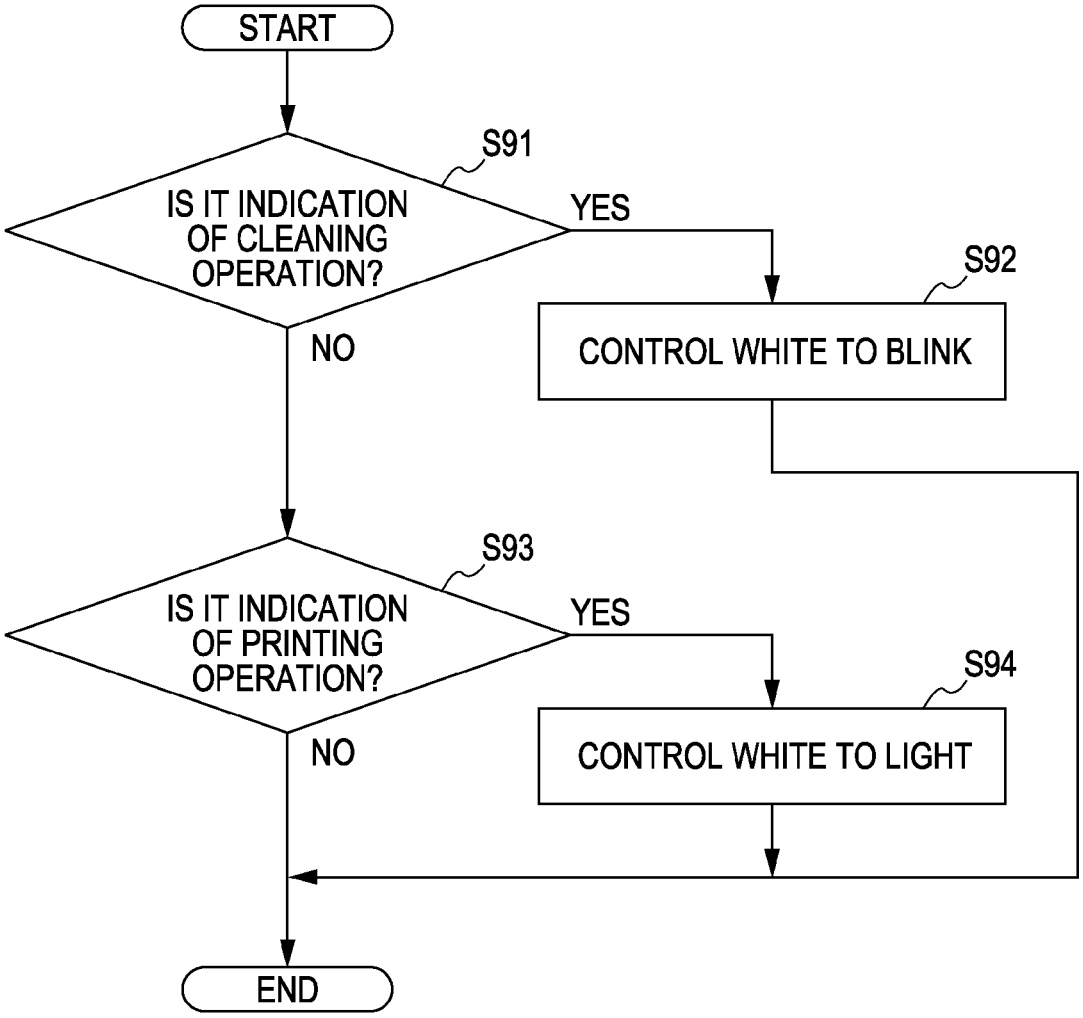
FIG. 18 is a flowchart that shows one example embodiment of a process of indicating a printing operation (step S9) in the flowchart of FIG. 15.

In FIG. 18, first, in step S91, it is determined whether it is an indication of a cleaning operation. In step S91, when it is determined that it is an indication of the cleaning operation, the process proceeds to step S92 and then blinks the indicator lamp 21 in white (this is generated by lighting three colors, that is, red, blue and green, at the same time). The process ends and returns to step S1, and then the process of step S1 to step S11 is repeated. Then, when power is turned off, the last process ends. On the other hand, in step S91, when it is determined that it is not an indication of the cleaning operation, the process proceeds to step S93.

In step S93, it is determined whether it is an indication of a printing operation by the printer 10. In step S93, when it is determined that it is an indication of the printing operation, the process proceeds to step S94 and then lights the indicator lamp 21 in white. The process ends and returns to step S1. When power is turned off, the last process ends. On the other hand, in step S93, when it is determined that it is not an indication of the printing operation, the process ends and returns to step S1. After that, the process of step S1 to step S11 is repeated. Then, when power is turned off, the last process ends.

Referring back to FIG. 15, in step S8, when it is determined that it is not an indication of the printing operation on the optical disk 2, the process proceeds to step S10. In step S10, it is determined whether it is an indication of a status that printing is possible. In step S10, the determination is made as to how much the amount of ink is contained in the ink tank. That is, it is determined whether the printer 10 currently is able to normally perform printing but it may be difficult to normally perform printing later because consumables such as ink may be out when the printer is continuously used due to a low ink level in the ink tank. In step S10, when it is determined that it is an indication of the status that printing is possible, the process proceeds to step S11 and then executes an indication that printing on the optical disk 2 is possible using the indicator lamp 21. The process of indicating a status that printing on the optical disk 2 is possible is, for example, executed as shown in FIG. 19.

Figure 19:
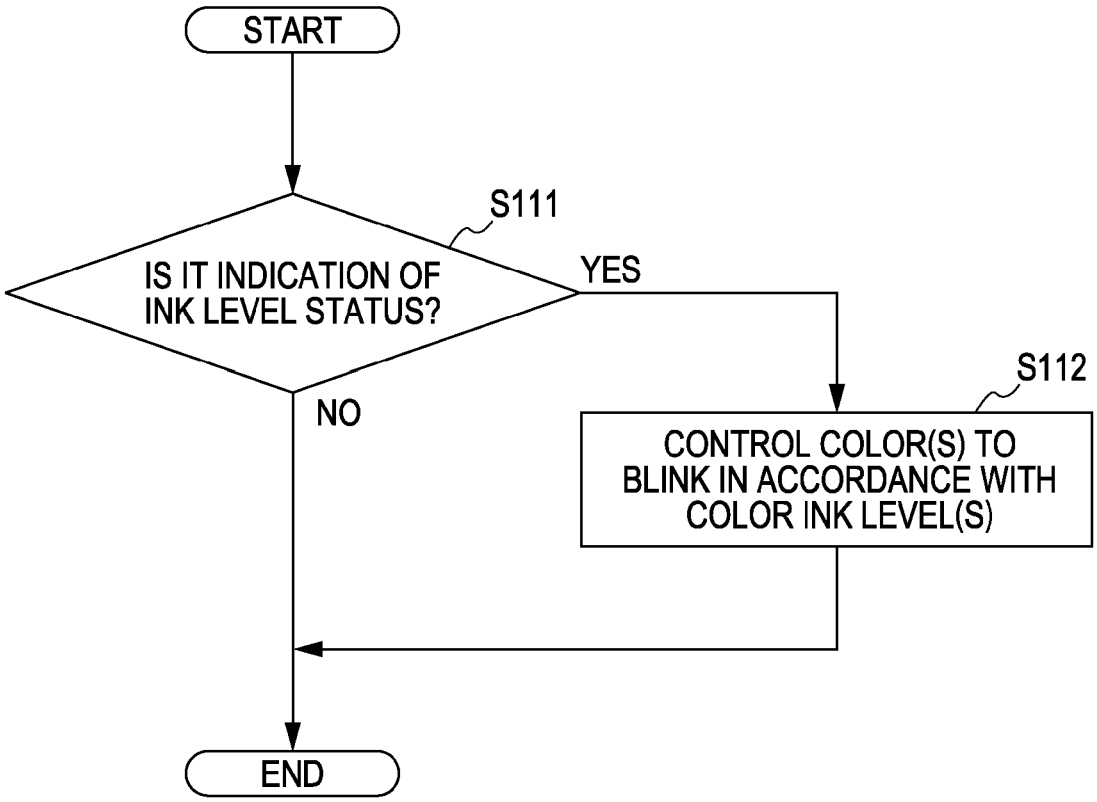
FIG. 19 is a flowchart that shows one example embodiment of a process of indicating a status that printing is possible (step S11) in the flowchart of FIG. 15.

In FIG. 19, first, in step S111, it is determined whether it is an indication of a status of an ink level. In step S111, when it is determined that it is an indication of the status of an ink level, the process proceeds to step S112 and then blinks the indicator lamp 21 in color(s) corresponding to the respective color ink level(s). For example, when only one color ink, that is, magenta (M) ink, is low, the indicator lamp 21 continuously blinks only in magenta. In addition, for example, when all three color inks, that is, cyan (C), magenta (M) and yellow (Y) inks, are low, the indicator lamp 21 alternately blinks in all three colors, that is, cyan, magenta and yellow. The process ends and returns to step S1, and then the process of step S1 to step S11 is repeated. Then, when power is turned off, the last process ends.

On the other hand, in step S111, when it is determined that it is not an indication of the status of an ink level, the process ends. Then, the process returns to step S1, and repeats the process of step S1 to step S11 until power is turned off. In addition, referring back to FIG. 15, in step S10, when it is determined that it is not an indication of the status that printing is possible, the process returns to step S1 and repeats the process of step S1 to step S11 until power is turned off.

Next, a series of flow when the user manipulates will be described with reference to the algorithms shown in FIG. 15 to FIG. 19. FIG. 20 to FIG. 24 are views that show an example embodiment without the ink level information button 22. Here, the description provides the case in which the user conducts recording contents into the information recording portions of four optical disks 2 and printing on the label surfaces of them. In this example embodiment, although it does not usually occur, it is assumed that, while printing the four optical disks 2, an ink level becomes low and then becomes out, and changes in the status of the ink level are described.

Figure 20:
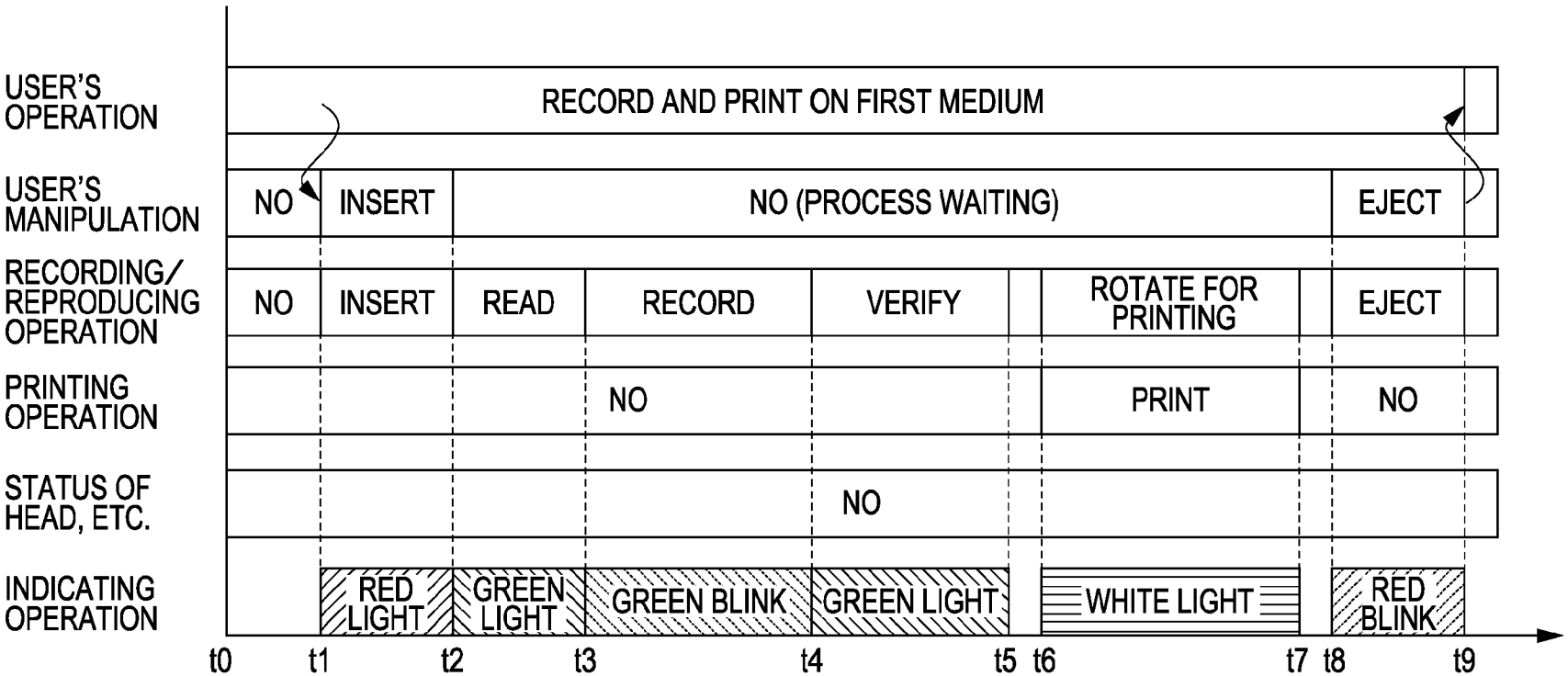
FIG. 20 is a view illustrating a first example embodiment of control without an ink level information button in the control unit of the optical disk apparatus according to the first embodiment of the printer-equipped disk recording and/or reproducing apparatus of the invention.

First, it is assumed when the user conducts manipulation for recording and printing on the first optical disk. At the initial point of this manipulation, the amounts of three color inks all are adequate. In FIG. 20, first, when the user inserts the first optical disk 2 into the disk drive 9 at time t1, an inserting operation of the recording/reproducing operation is performed and, at the same time, the indicator lamp 21 lights up in red as an indicating operation. At this time, a printing operation is not performed, and there is no change in the status of ink of the print head 31. Next, when the inserting operation ends and, subsequently, a reading operation starts at time t2, the indicator lamp 21 changes from red lighting into green lighting.

When the reading operation ends and, subsequently, a recording operation starts at time t3, the indicator lamp 21 changes from green lighting into green blinking. Next, when the recording operation ends and a verifying operation of that recording starts at time t4, the indicator lamp 21 switches from green blinking into green lighting. Then, when the verifying operation of the recording ends at time t5, the indicator lamp 21 turns off green lighting. At this time, a typical optical disk drive without printing function completes the recording/reproducing operation, such as the reading operation, the recording operation and the verifying operation. Next, when the disk drive 9 rotates the optical disk 2 for printing at time t6, the printer 10 starts a printing operation on the label surface. At this time, the indicator lamp 21 lights up in white.

Next, when the printing operation ends at time t7, the indicator lamp 21 turns off white lighting. At this time, the main function of the printer-equipped disk recording and/or reproducing apparatus according to the embodiment of the invention, that is, the recording/reproducing operation on the information recording surface of the optical disk 2 and the printing operation on the label surface, which is the printing surface, of the optical disk 2, is completed. Then, when the user selects ejection of the first optical disk at time t8, the disk drive 9 starts an ejecting operation of the optical disk 2. Thus, the indicator lamp 21 blinks in red, and at time t9 at which the optical disk 2 ends the ejecting operation, the indicator lamp 21 turns off red blinking.

Figure 21:
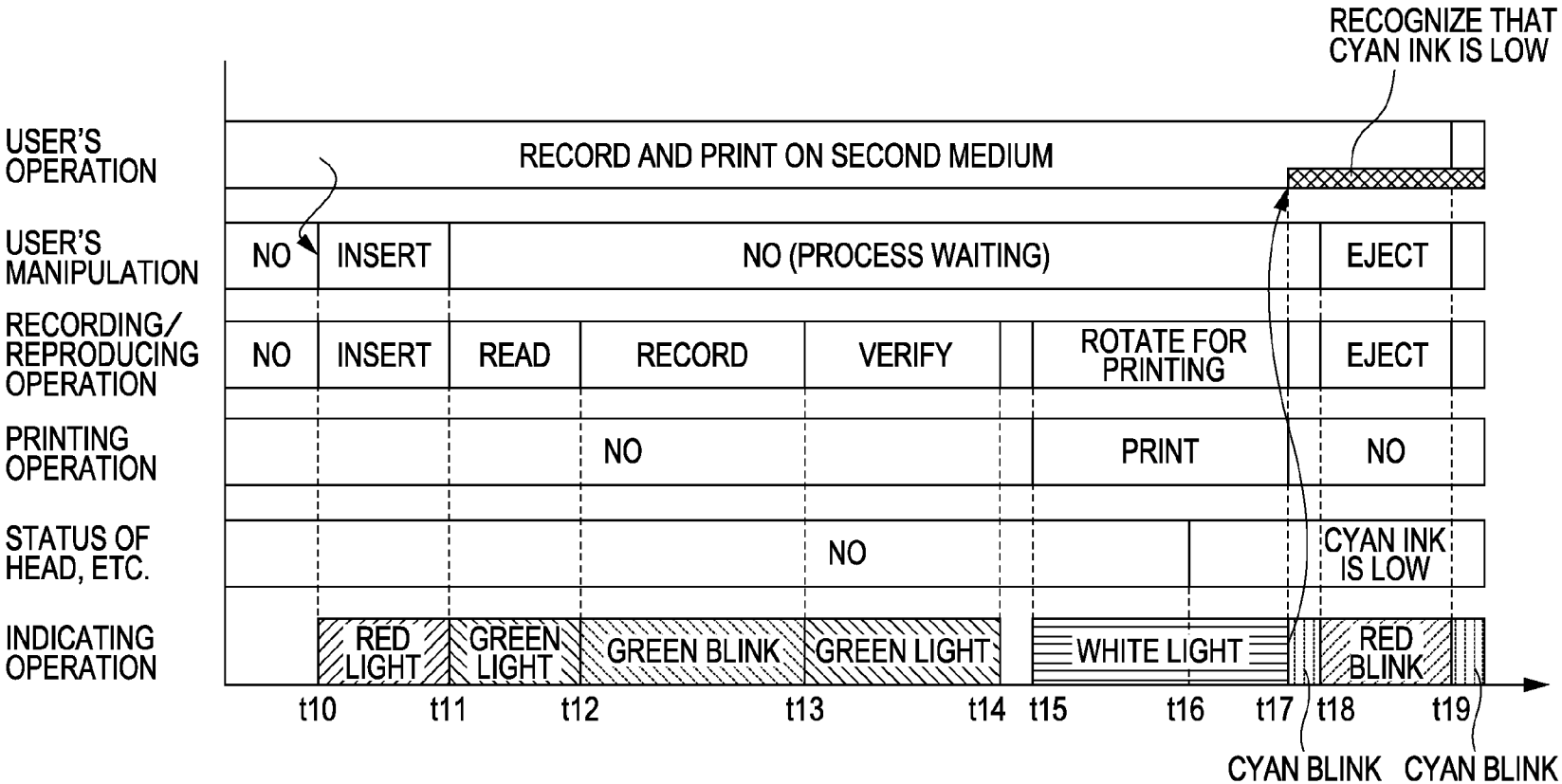
FIG. 21 is a view illustrating a second example embodiment of control without an ink level information button in the control unit of the optical disk apparatus according to the first embodiment of the printer-equipped disk recording and/or reproducing apparatus of the invention.

Next, it is assumed when the user conducts manipulation for recording and printing on the second optical disk. Here, the description provides the case in which the state where a certain amount of ink remains in the ink tank is changed into the state where the ink level is low after printing. In FIG. 21, when the user inserts the second optical disk 2 into the disk drive 9 at time t10, an inserting operation of the recording/reproducing operation is performed and, at the same time, the indicator lamp 21 lights up in red as an indicating operation. At this time, a printing operation is not performed, and there is no change in the status of ink of the print head 31. The next operations and indications from time t11 to time t15 are similar to those of the process from time t2 to time t6 in FIG. 20 as described above, so the description of them is omitted.

Next, when the cyan (C) ink is low at time t16 and it is detected that the cyan ink is low, the indicator lamp 21 does not change an indication at time t16, but the indicator lamp 21 continues to light up in white in correspondence with the printing operation. After that, when the printing operation ends at time t17, the indicator lamp 21 switches white lighting into cyan blinking that indicates that the cyan ink is low. Thus, the user is able to recognize that the cyan ink in the ink tank is low. Next, when the user selects ejection of the second optical disk at time t18, the disk drive 9 starts an ejecting operation of the optical disk 2. Thus, the indicator lamp 21 blinks in red, and at time t19 at which the optical disk 2 ends the ejecting operation, the indicator lamp 21 blinks in cyan again. In this way, the indicating operation of cyan blinking is performed at time t17 and at time t19, so the user can make preparations, such as getting a replacement ink tank, for supplying cyan ink later.

Figure 22:
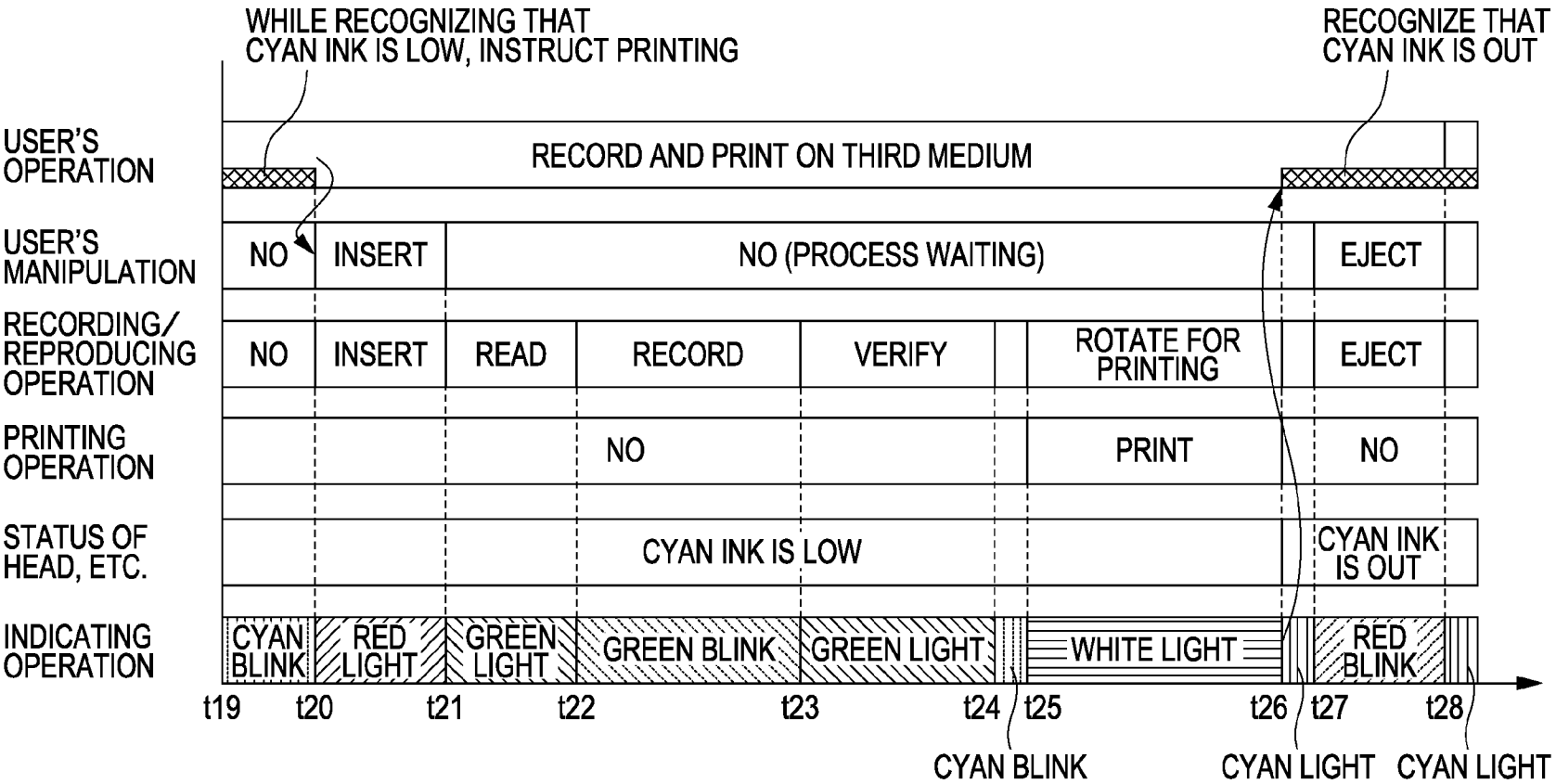
FIG. 22 is a view illustrating a third example embodiment of control without an ink level information button in the control unit of the optical disk apparatus according to the first embodiment of the printer-equipped disk recording and/or reproducing apparatus of the invention.

Furthermore, it is assumed when the user conducts manipulation for recording and printing on the third optical disk. Here, the description provides the case in which the status where ink still remains in the ink tank changes into the status where the ink is out after printing. In FIG. 22, because it has been already detected at time t19 that the cyan ink is low, the indicator lamp 21 blinks in cyan. In this state, the ink tank is not replaced, and the user instructs printing while recognizing that the cyan ink is low.

Next, when the user inserts the third optical disk 2 into the disk drive 9 at time t20, an inserting operation of the recording/reproducing operation is performed and, at the same time, the indicator lamp 21 lights up in red as an indicating operation. At this time, a printing operation is not performed, and inks of the print head 31 are in a status that the cyan ink is low. The next operations and indications from time t21 to time t24 are similar to those of the process from time t11 to time t14 in FIG. 21 as described above, so the description of them is omitted.

Next, when an verifying operation of the recording ends at time t24, the indicator lamp 21 switches from green lighting that indicates the verifying operation into cyan blinking again. Then, when the printer 10 starts the printing operation on the label surface at time t25, the indicator lamp 21 lights up in white. Next, when the printing operation ends and the ink level changes from "ink low status" into "ink out status" at time t26, the indicator lamp 21 lights up in cyan, indicating that the cyan ink is out. Thus, the user is able to recognize that the cyan ink in the ink tank is out.

Next, when the user selects ejection of the third optical disk at time t27, the disk drive 9 starts an ejecting operation of the optical disk 2. Thus, the indicator lamp 21 blinks in red, and at time t28 at which the optical disk 2 ends the ejecting operation, the indicator lamp 21 lights up in cyan again.

Figure 23:
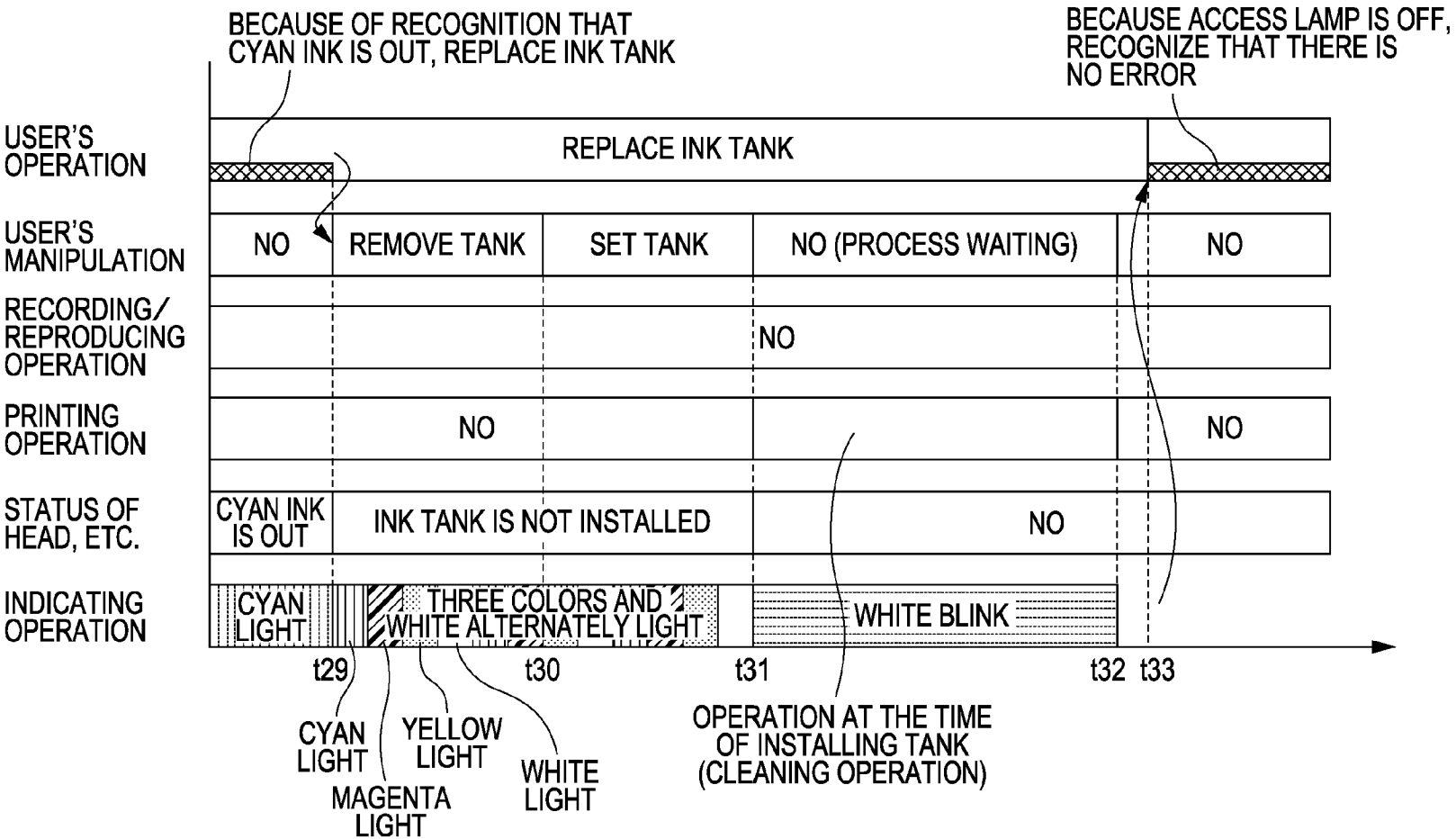
FIG. 23 is a view illustrating a fourth example embodiment of control without an ink level information button in the control unit of the optical disk apparatus according to the first embodiment of the printer-equipped disk recording and/or reproducing apparatus of the invention.

In addition, it is assumed when the user conducts manipulation for replacing ink when the ink is out. Here, the user recognizes that the cyan ink is out, the ink tank is replaced, and in association with the replacement work, the disk drive performs a cleaning operation at the time of installing an ink tank. In FIG. 23, when the user replaces the ink tank, because an ink tank is not installed from time t29 at which detachment of the ink tank is started, through time t30 at which the old ink tank is replaced with a new ink tank, to time t31 at which attachment of the new ink tank ends, the indicator lamp 21 alternately lights up in three colors and white, indicating a status that an ink tank is not installed. A specific example of an operation of alternate lighting of the three colors and white is, for example, such that, first, the indicator lamp 21 lights up in cyan for a second, lights up in magenta for a second, lights up in yellow for a second and then lights up in white for a second. This is repeated until replacement of the ink tank ends.

After that, from time t31 at which replacement of the ink tank ends, the cleaning operation at the time of ink tank installation is executed. At this time, the indicator lamp 21 blinks in white, indicating a status that the ink tank is installed and the cleaning operation is executed. Then, at time t32 at which the cleaning operation at the time of ink tank installation, the indicator lamp 21 turns off. Thus, because the indicator lamp 21 is turned off at the next time t33, the user is able to recognize that there is no error status, such as the status of ink in the printer 10 in regard to the optical disk apparatus 1.

Figure 24:
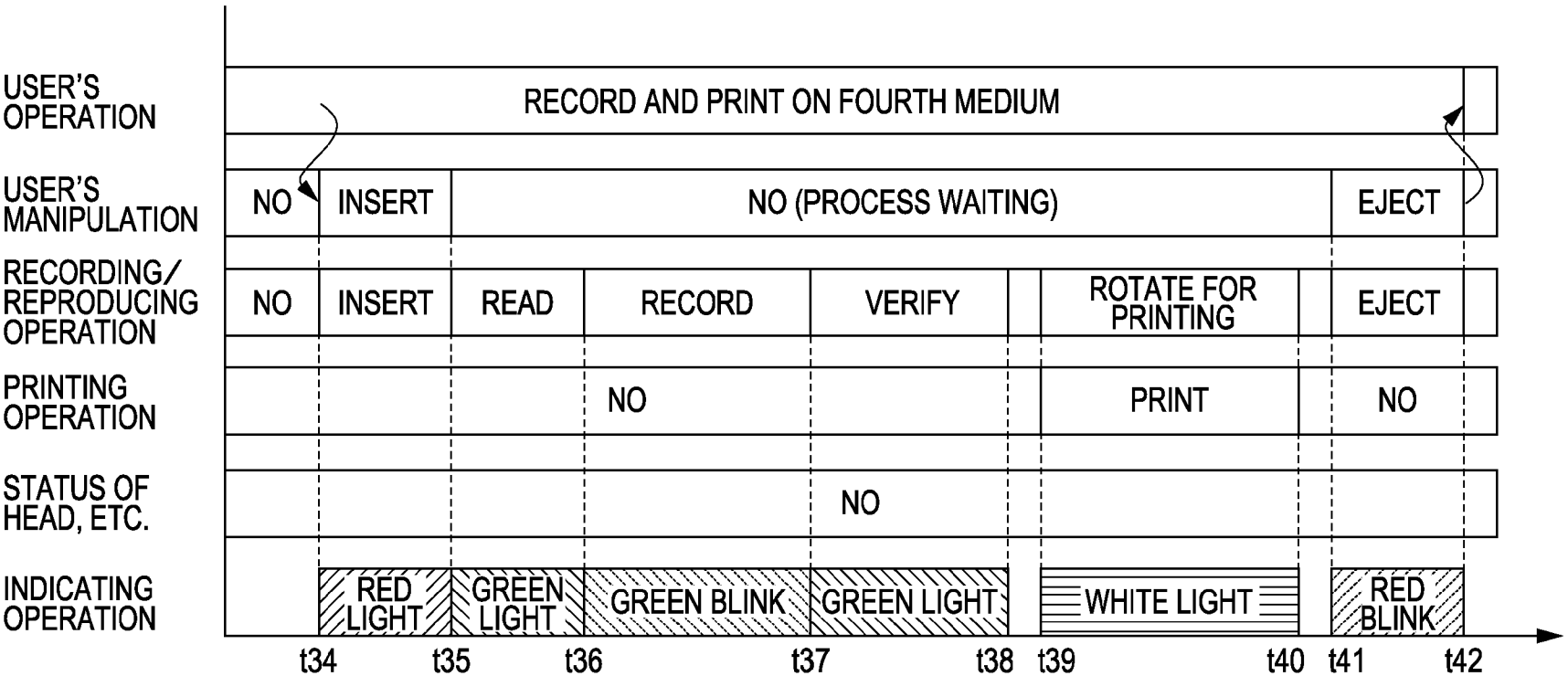
FIG. 24 is a view illustrating a fifth example embodiment of control without an ink level information button in the control unit of the optical disk apparatus according to the first embodiment of the printer-equipped disk recording and/or reproducing apparatus of the invention.

Finally, it is assumed when the user conducts manipulation for recording and printing on the fourth optical disk. Here, the inks sufficiently remain in the ink tank, so the user is able to perform printing on the optical disk using the inks. In FIG. 24, when the user inserts the fourth optical disk 2 into the disk drive 9 at time t34, an inserting operation of the recording/reproducing operation is performed and, at the same time, the indicator lamp 21 lights up in red as an indicating operation. The following operations and indications from time t34 to time t42 are similar to those of the process from time t1 to time t9 in FIG. 20 as described above, so the description of them is omitted. As described above, according to the example embodiment shown in FIG. 20 to FIG. 24, the user is able to repeat recording and printing on a plurality of optical disks 2 while appropriately recognizing the ink level.

According to this example embodiment, it is possible to indicate an operation of printing function and a status thereof using only the single indicator lamp 21 that is provided at the front face of the optical disk apparatus 1. Thus, it may be not necessary to provide an additional indicating component, and it is sufficient to just replace an existing indicating component. Thus, it is possible to reduce an increase in component cost. Furthermore, it may be not necessary to have a new indicating space on the front panel of the casing, so it may be not necessary to largely change the design and, therefore, it is possible to reduce design cost. In addition, the user is able to know the operation status of the disk drive through the indication pattern of the indicator lamp 21, so it is possible to improve recognizability of the status of the apparatus. Furthermore, an indication regarding the operation status of the disk drive is indicated by the single indicator lamp 21 that indicates a status regarding the function of the printer, so it is possible to enhance convenience of status recognition.

In addition, in regard to the recording/reproducing operation, it is possible to implement a similar indication status to an existing optical disk apparatus that is not provided with printing function. Thus, it is possible to reduce the possibility that the user may erroneously recognize the status of the apparatus. Furthermore, in regard to the printing function as well, if the user has used an existing printer-equipped optical disk apparatus, because the operation and status of the printing function are indicated by lighting or blinking of the access lamp, it is possible to improve user's recognizability of the operation and status. Yet furthermore, in regard to the ink level indication, because the access lamp lights up or blinks in the same color as the ink color, it is possible to improve recognizability of the ink level indication.

Figure 25:
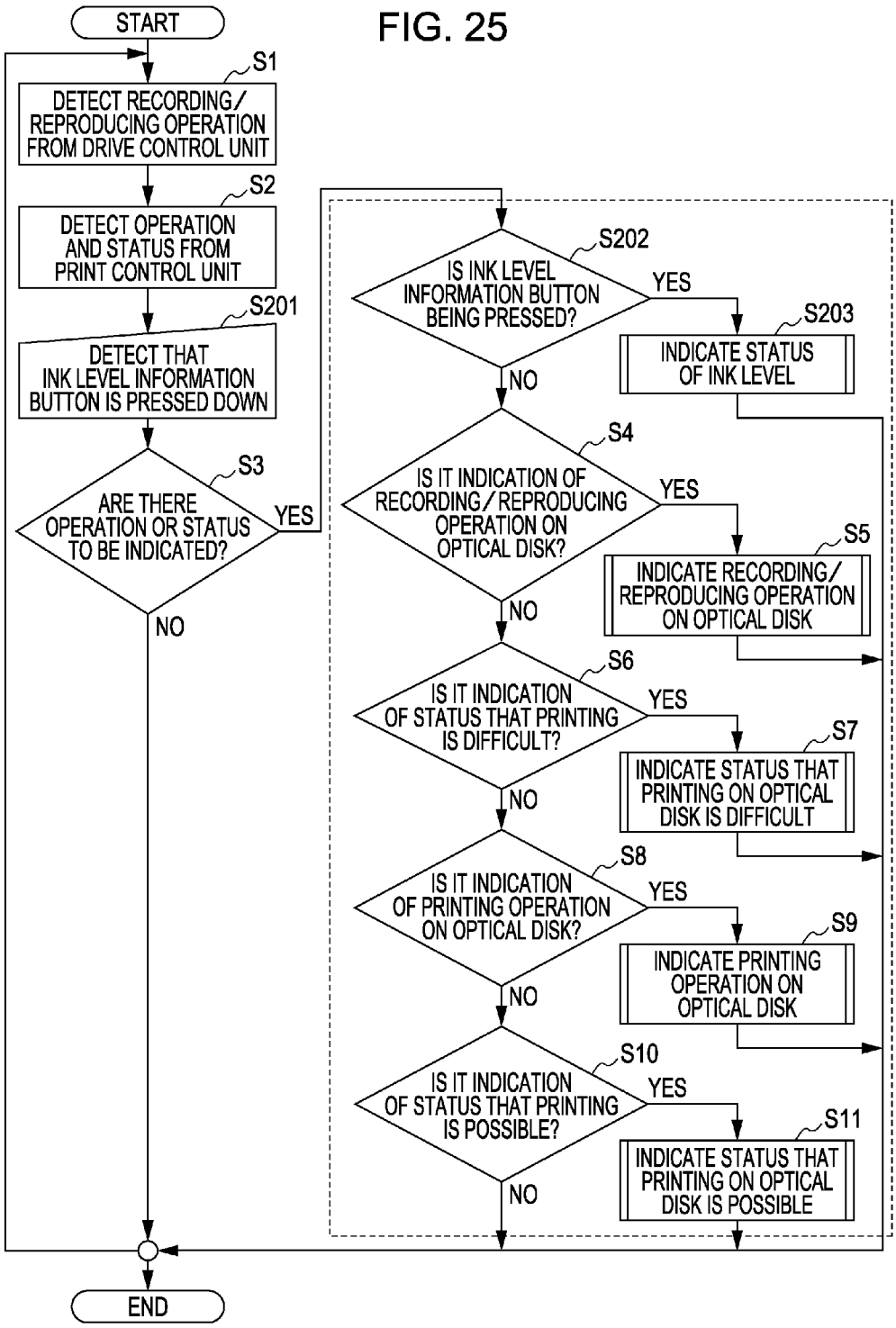
FIG. 25 is a flowchart that shows a second example embodiment of the process flow in the control unit of the optical disk apparatus according to the first embodiment of the printer-equipped disk recording and/or reproducing apparatus of the invention.

FIG. 25 is a flowchart that shows a second example embodiment of control of an ink level indication by the access lamp/ink level indicator unit 89. This example embodiment shows an example embodiment with the above described ink level information button 22. The process of this example embodiment is basically similar to that of the example embodiment shown in FIG. 15 as described above, and the second example embodiment differs from the first example embodiment in only three portions, that is, step S201 to step S203. Thus, in FIG. 25, like reference numerals denote like components, the overlapped description is omitted, and the different process, that is, step S201 to step S203, will be mainly described. Note that the priority of operation indication and status indication is "an indication of a status of ink level by pressing down the ink level information button 22", "an indication of a recording/reproducing operation", "an indication of a status that printing is difficult", "an indication of a printing operation", and "an indication of a status that printing is possible" in the stated order.

In FIG. 25, step S1 and step S2 are similar to those of the control of the ink level indication according to the first example embodiment, and step S201 is provided after step S2. In step S201, it is detected when the ink level information button 22 is pressed down. This process is automatically detected when the ink level information button 22 is pressed down. The next step S3 is similar to that of the above example embodiment, and in step S3, when it is determined that there is an operation or a status to be indicated, the process proceeds to the added step S202.

In step S202, it is determined whether the ink level information button 22 is being pressed. In step S202, when it is determined that the ink level information button 22 is not being pressed, the process proceeds to the determinations and processes described in the above example embodiment in step S4 and the following steps. On the other hand, in step S202, when it is determined that the ink level information button 22 is being pressed, the process proceeds to step S203. In step S203, the status of ink level is indicated. The process of indicating the status of ink level is, for example, executed as shown in FIG. 26.

Figure 26:
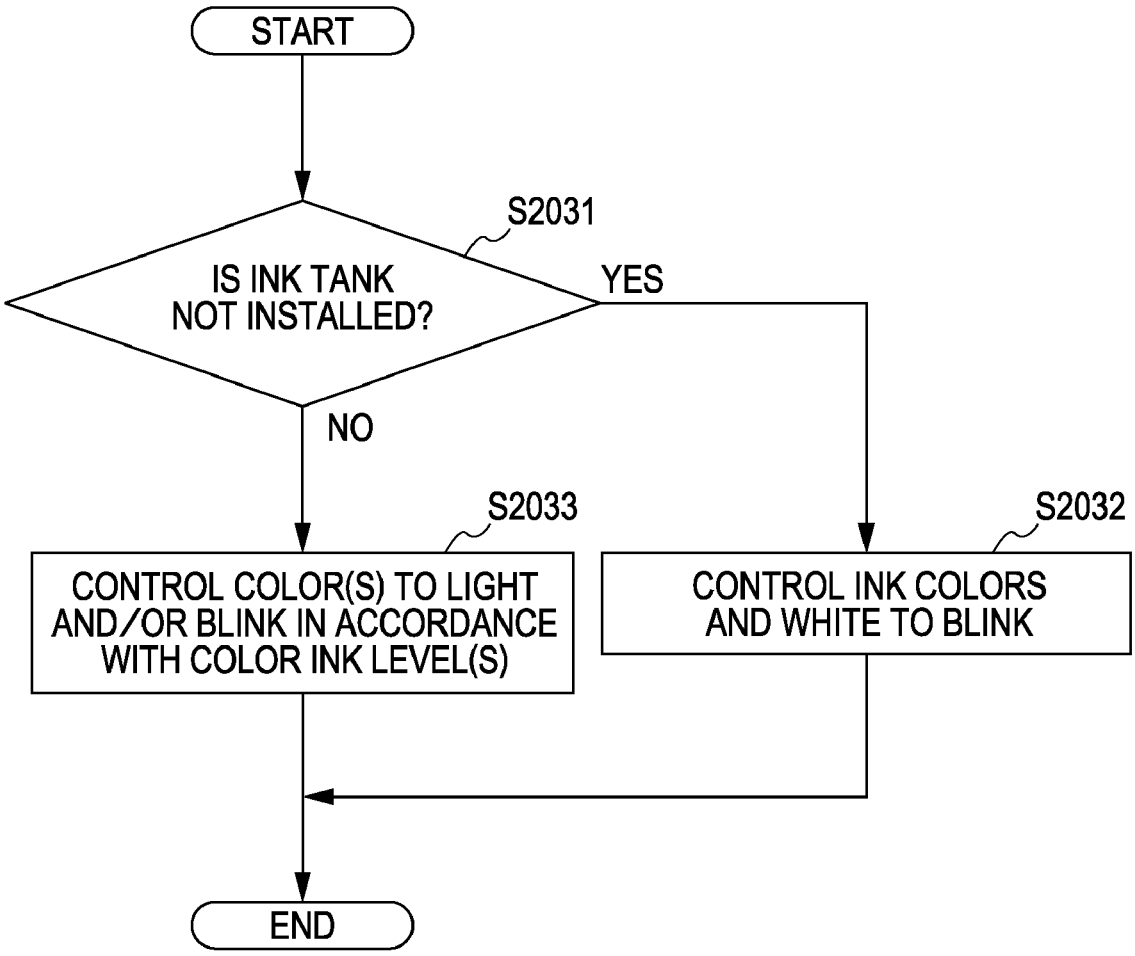
FIG. 26 is a flowchart that shows one example embodiment of a process of indicating the state of an ink level (step S203) in the flowchart of FIG. 25.

In FIG. 26, first, in step S2031, it is determined whether an ink tank is installed. This process in this example embodiment may be determined on the basis of whether the print head 31 in which the ink tank is accommodated is set at a predetermined position. In step S2031, when it is determined that an ink tank is not installed, the process proceeds to step S2032. In step S2032, an indication that an ink tank is not installed, that is, in this example embodiment, the indicator lamp 21 luminously indicates four colors that includes three colors of red (R), green (G) and blue (B), and white (W) respectively for a predetermined period of time in such a manner that the indicator lamp 21 sequentially switches lighting, that is, alternately lights up in three colors and white. The process ends and returns to step S1, and then the process of step S1 to step S11 is repeated. Then, when power is turned off, the last process ends.

On the other hand, in step S2031, when it is determined that the ink tank is installed, the process proceeds to step S2033. In step S2033, lighting and/or blinking control corresponding to the color ink levels are executed and the indicator lamp 21 luminously indicates the status of the ink levels. In this example embodiment, for example, when one color ink, that is, magenta (M) ink, is low, the indicator lamp 21 blinks in magenta, and when one color ink, that is, cyan (C) ink, is out, the indicator lamp 21 lights up in cyan. The process ends and returns to step S1, and then the process of step S1 to step S11 is repeated. Then, when power is turned off, the last process ends.

Next, a series of flow when the user manipulates will be described with reference to the algorithms shown in FIG. 25, FIG. 26 and above described FIG. 16 to FIG. 19. FIG. 27 to FIG. 31 are views that show an example embodiment with the ink level information button 22. Here, the description provides the case in which the user conducts recording contents into the information recording portions of four optical disks 2 and printing on the label surfaces of them. In this example embodiment, although it does not usually occur, it is assumed that, while printing the four optical disks 2, an ink level becomes low and then becomes out, and changes in the status of the ink level are described.

Note that FIG. 27 to FIG. 31 provide an indication mode in addition to the user operation, user manipulation, recording/reproducing operation, printing operation, status of the head, etc. and indicating operation of the example embodiment shown in FIG. 20 to FIG. 24. In FIG. 20 to FIG. 24, like reference numerals denote like components as those of the example embodiment shown in FIG. 20 to FIG. 24, and the overlapped description is omitted.

Figure 27:
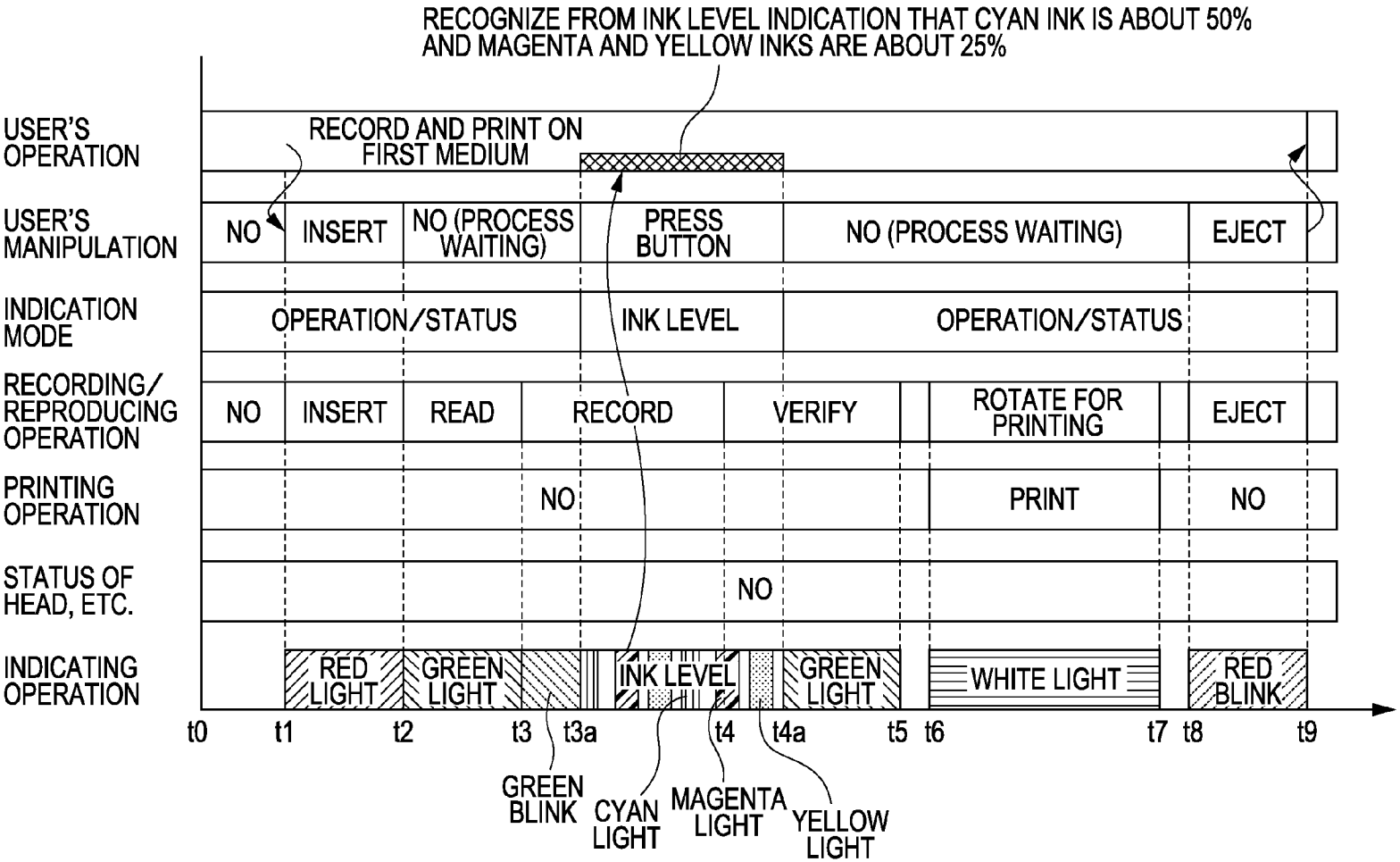
FIG. 27 is a view illustrating a first example embodiment of control with an ink level information button in the control unit of the optical disk apparatus according to the first embodiment of the printer-equipped disk recording and/or reproducing apparatus of the invention.

First, it is assumed when the user conducts manipulation for recording and printing on the first optical disk. At the initial point of this manipulation, the amounts of three color inks all are adequate. In FIG. 27, first, when the user inserts the first optical disk 2 into the disk drive 9 at time t1, an inserting operation of the recording/reproducing operation is performed. The indication mode at this time is "operation/status indication", and the indicator lamp 21 lights up in red as an indicating operation. At this time, a printing operation is not performed, and there is no change in the status of ink of the print head 31.

The process from time t1 to time t3 is the same. Next, when the user presses (turns on) the ink level information button 22 at time t3*a*, the process of step S202 and step S203 shown in FIG. 25 is executed. Then, the indication mode is switched to "ink level indication", and the indication of the indicator lamp 21 is changed to an ink level indication. At this time, for example, when cyan (C) ink is 50%, magenta (M) ink is 25%, and yellow (Y) ink is 25%, green blinking, which is a luminous indication till then, is switched to an ink level indication corresponding to each color ink level.

In this case, when applied to the above example embodiment, for example, the indicator lamp 21 lights up in cyan (blue and green) for 1.0 second and is then turned off for 1.0 second, the indicator lamp 21 lights up in magenta (red and blue) for 1.5 seconds and is then turned off for 0.5 seconds, and subsequently, the indicator lamp 21 lights up in yellow (red and green) for 1.5 seconds and is then turned off for 0.5 seconds. At these time intervals, the indicator lamp 21 repeats cyan lighting, turning off, magenta lighting, turning off, yellow lighting, and turning off. At this time, the user is able to roughly recognize the status of each color ink level on the basis of lighting time of each color and turn-off time therebetween. Note that when each ink level is specifically detected, the indicator lamp 21 performs an indication in such a manner that lighting time and turn-off time of the indicator lamp 21 are associated with the detected ink levels. Thus, it is possible to recognize that cyan ink is about 50%, and magenta and yellow inks are about 25%.

After that, when the user turns off the ink level information button 22 at t4*a*, the process in step S203 shown in FIG. 25 stops, and the indication mode switches from "ink level indication" to "operation/status indication". Thus, the indicator lamp 21 changes from the ink level indication to green lighting that indicates a recording/reproducing operation (recording verification operation in this example embodiment) at that time. The process from time t5 to time t9 after that is the same as that of the above example embodiment.

Next, it is assumed when the user conducts manipulation for recording and printing on the second optical disk. Here, the description provides the case in which the status where a certain amount of ink remains in the ink tank changes into the status where the ink level is low after printing. In FIG. 28, the process from time t10 to time t13 is the same as that of the above example embodiment. Next, when the user turns on the ink level information button 22 at time t13*a*, the indication mode is switched from "operation/status indication" to "ink level indication". Then, the indicator lamp 21 changes from green lighting, which indicates recording/reproducing operation at that time, to the ink level indication.

At this time, for example, when cyan (C) ink is 40%, magenta (M) ink is 20%, and yellow (Y) ink is 20%, green blinking, which is a luminous indication till then, is switched to an ink level indication corresponding to each color ink level. In this case, when applied to the above example embodiment, for example, the indicator lamp 21 lights up in cyan (blue and green) for 1.2 seconds and is then turned off for 0.8 seconds, the indicator lamp 21 lights up in magenta (red and blue) for 1.6 seconds and is then turned off for 0.4 seconds, and subsequently, the indicator lamp 21 lights up in yellow (red and green) for 1.6 seconds and is then turned off for 0.4 seconds. At this time, the user is able to roughly recognize the status of each color ink level on the basis of lighting time of each color and turn-off time therebetween. Note that when each ink level is specifically detected, it is possible to recognize that cyan ink is about 40%, and magenta and yellow inks are about 20%.

After that, when the user turns off the ink level information button 22 at t15*a*, the indication mode switches from "ink level indication" to "operation/status indication". Thus, the indicator lamp 21 changes from the ink level indication to white lighting that indicates a recording/reproducing operation (rotation for printing in this example embodiment) at that time. Next, when, for example, magenta ink becomes low at time t16 and the printing operation ends at time t17, the indication of the indicator lamp 21 is switched to magenta blinking that indicates that the magenta ink is low. In this way, the indicating operation according to "ink level indication" mode is performed from time t13*a* to time t15*a* and/or the indicating operation by magenta blinking is performed at time t17 and at time t19. Thus, the user can make preparations, such as getting a replacement ink tank, for supplying magenta ink and/or yellow ink later.

Next, when the user selects ejection of the optical disk 2 at time t18, the recording/reproducing operation is switched to an ejecting operation. Thus, the indication of the indicator lamp 21 is switched from magenta blinking to red blinking that indicates the ejecting operation of the optical disk 2. Then, when the ejection of the optical disk 2 ends at time t19, the indication of the indicator lamp 21 is switched again from red blinking to magenta blinking that indicates that the magenta ink is low.

Figure 29:
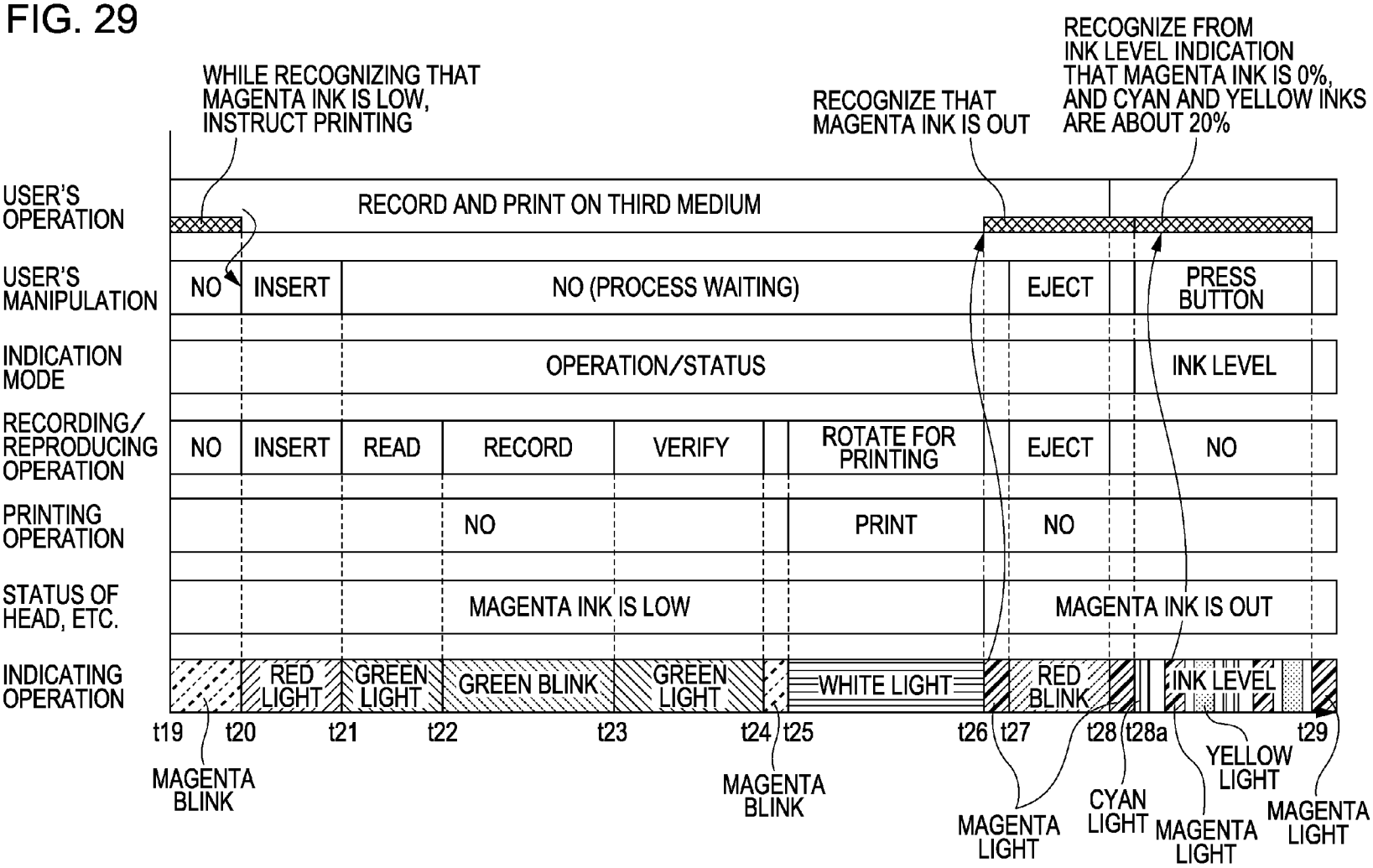
FIG. 29 is a view illustrating a third example embodiment of control with an ink level information button in the control unit of the optical disk apparatus according to the first embodiment of the printer-equipped disk recording and/or reproducing apparatus of the invention.

Furthermore, it is assumed when the user conducts manipulation for recording and printing on the third optical disk. Here, the description provides the case in which the status where ink still remains in the ink tank changes into the status where the ink is out after printing. It is assumed that the user instructs printing while recognizing that the magenta ink is low. In FIG. 29, the process from time t19 to time t26 is similar to the above example embodiment except that which color ink is low, that is, whether cyan ink is low or magenta ink is low. Next, when it is detected, for example, that magenta (M) ink changes from the status "ink is low" to the status "ink is out" when the printing operation ends at time t26, the indication of the indicator lamp 21 is switched from white lighting that indicates the printing status to magenta lighting that indicates that the magenta ink is out. Thus, the user is able to recognize that the magenta (M) ink is out.

Next, when the user selects ejection of the optical disk 2 at time t27, the recording/reproducing operation is switched to an ejecting operation. Thus, the indication of the indicator lamp 21 is switched from magenta lighting to red blinking that indicates the ejecting operation of the optical disk 2. Then, when the ejection of the optical disk 2 ends at time t28, the indication of the indicator lamp 21 is switched again from red blinking to magenta lighting that indicates that the magenta ink is out. After that, when the user turns on the ink level information button 22 at time t28*a*, the indication mode is switched from "operation/status indication" to "ink level indication". Then, the indication of the indicator lamp 21 is switched from magenta lighting, which indicates the status "magenta ink is out" at that time, to the ink level indication. Thus, at time t26 and at time t28, the user is able to recognize that the magenta (M) ink is out. Then, the user turns on the ink level information button 22 in order to check the ink levels in further detail.

At this time, for example, when cyan (C) ink is 20%, magenta (M) ink is 0%, and yellow (Y) ink is 20%, magenta lighting, which is a luminous indication till then, is switched to an ink level indication corresponding to each color ink level. In this case, when applied to the above example embodiment, for example, the indicator lamp 21 lights up in cyan (blue and green) for 1.6 seconds and is then turned off for 0.4 seconds, the indicator lamp 21 lights up in magenta (red and blue) for 2.0 seconds and, without turn-off time, the indicator lamp 21 lights up in yellow (red and green) for 1.6 seconds and is then turned off for 0.4 seconds. At these time intervals, the indicator lamp 21 repeats cyan lighting, turning off, magenta lighting, yellow lighting, and turning off. At this time, the user is able to roughly recognize the status of each color ink level on the basis of lighting time of each color and turn-off time therebetween. Note that when each ink level is specifically detected, it is possible to recognize that cyan ink is about 20%, magenta ink is 0%, and yellow ink is about 20%.

After that, when the user turns off the ink level information button 22 at t29, the indication mode switches from "ink level indication" to "operation/status indication". Thus, the indicator lamp 21 changes from the ink level indication to magenta lighting that indicates the status "magenta ink is out", which has been already detected. As a result, from time t28*a* to time t29, the user is able to recognize that the magenta (M) ink is out. Note that when each ink level is specifically detected, it is possible to recognize that magenta ink is 0%, cyan ink is about 20%, and yellow ink is about 20%.

Figure 30:
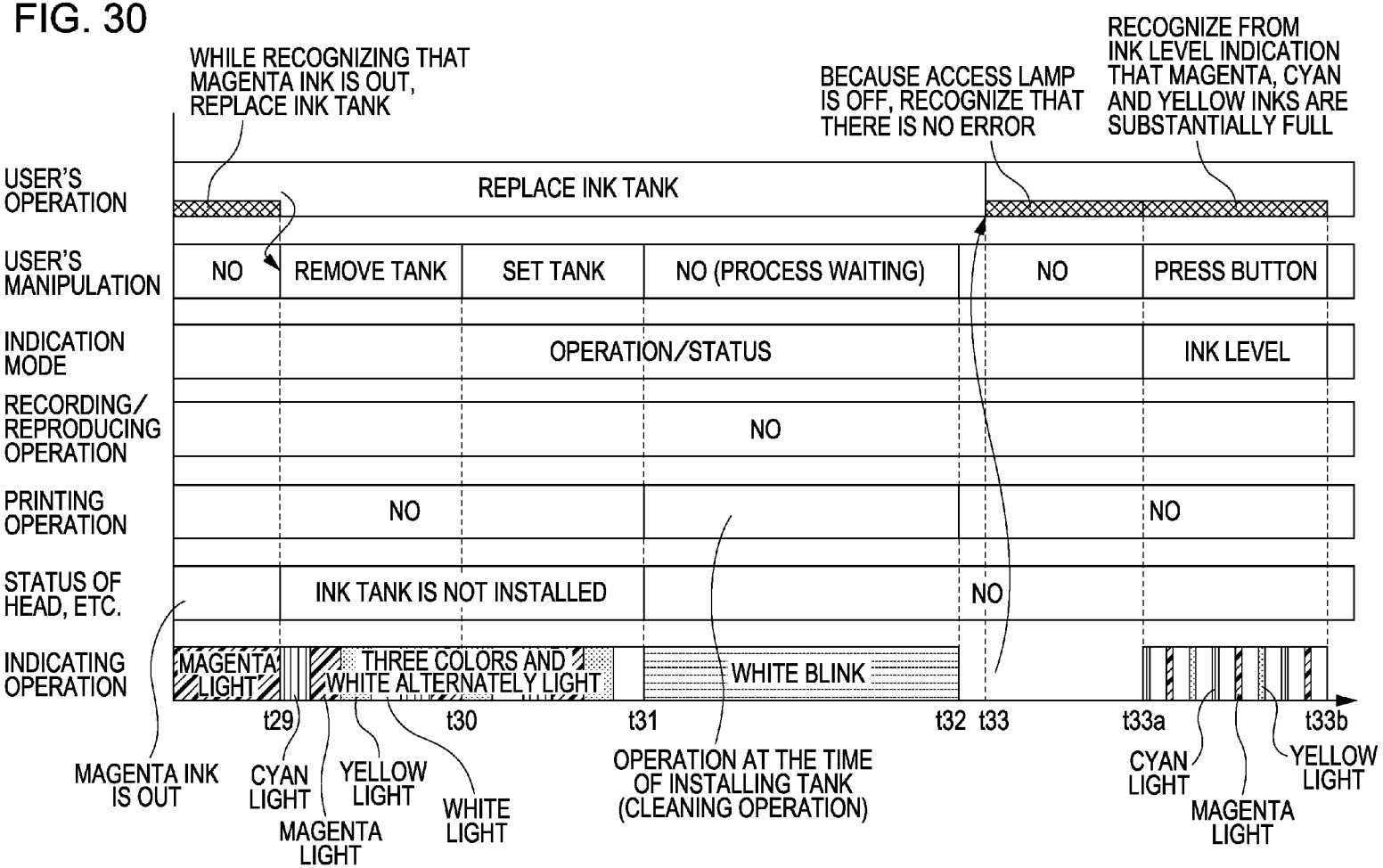
FIG. 30 is a view illustrating a fourth example embodiment of control with an ink level information button in the control unit of the optical disk apparatus according to the first embodiment of the printer-equipped disk recording and/or reproducing apparatus of the invention.

In addition, it is assumed when the user conducts manipulation for replacing ink when the ink is out. Here, the user recognizes that the cyan ink is out, the ink tank is replaced, and in association with the replacement work, the disk drive performs a cleaning operation at the time of installing an ink tank. In FIG. 30, the process from time t29 to time t33 is the same as that of the above example embodiment. Next, when the user turns on the ink level information button 22 at time t33*a*, the indication mode is switched from "operation/status indication" to "ink level indication". Thus, the indicator lamp 21, which has been turned off till then, starts an ink level indication.

At this time, because a new ink tank is installed in the printer 10, the status of the print head, etc. is not changed. In addition, because it is detected that all color inks, that is, cyan, magenta and yellow inks, are substantially full, the indicator lamp 21 performs an ink level indication corresponding to this status. For example, the indicator lamp 21 lights up in cyan (blue and green) for 0.5 seconds and is then turned off for 1.5 seconds, the indicator lamp 21 lights up in magenta (red and blue) for 0.5 seconds and is then turned off for 1.5 seconds, and subsequently, the indicator lamp 21 lights up in yellow (red and green) for 0.5 seconds and is then turned off for 1.5 seconds. At these time intervals, the indicator lamp 21 repeats cyan lighting, turning off, magenta lighting, turning off, yellow lighting, and turning off. At this time, the user is able to roughly recognize the status of each color ink level, that is, the status that all color inks are substantially full, on the basis of lighting time of each color and turn-off time therebetween.

Next, when the user turns off the ink level information button 22 at t33*b*, the indication mode switches from "ink level indication" to "operation/status indication". Thus, the ink level indication of the indicator lamp 21 is turned off. Hence, the user is able to recognize that all three color inks are substantially full between time t33*a* and time t33*b*.

Figure 31:
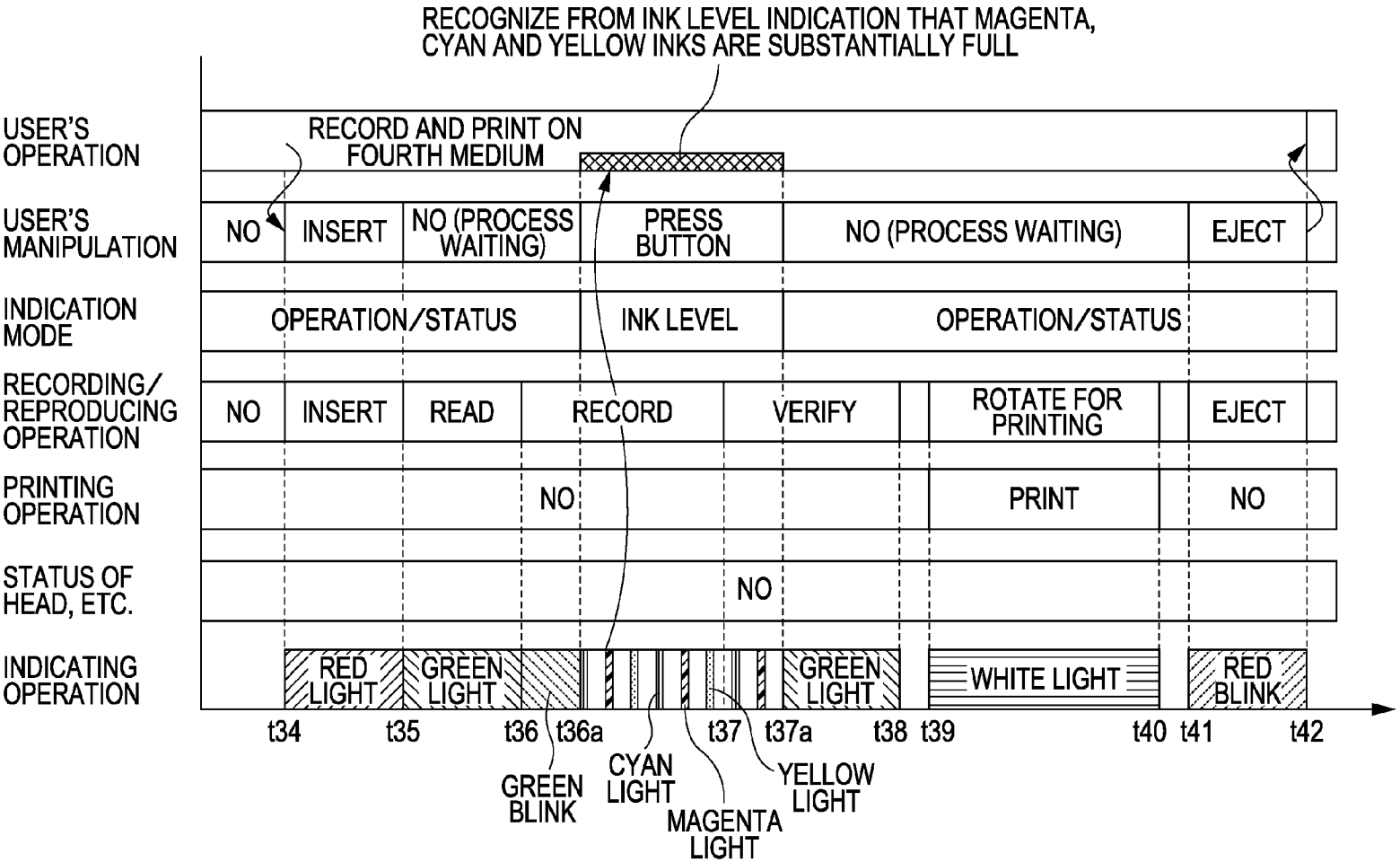
FIG. 31 is a view illustrating a fifth example embodiment of control with an ink level information button in the control unit of the optical disk apparatus according to the first embodiment of the printer-equipped disk recording and/or reproducing apparatus of the invention.

Finally, it is assumed when the user conducts manipulation for recording and printing on the fourth optical disk. Here, the inks sufficiently remain in the ink tank, so the user is able to perform printing on the optical disk using the inks. In FIG. 31, the process from time t34 to time t36 and from time t38 to time t42 is the same as that of the above example embodiment. When the user turns on the ink level information button 22 at time t36*a*, the indication mode is switched from "operation/status indication" to "ink level indication" and, at the same time, the indication of the indicator lamp 21 is switched to the ink level indication. At this time, the inks sufficiently remain in the ink tank, so the indicator lamp 21 performs an ink level indication corresponding to this status.

The ink level indication of the indicator lamp 21 does not change after the recording operation ends and then the verifying operation starts at time t37. Next, when the user turns off the ink level information button 22 at time t37, the indication mode is switched from "ink level indication" to "operation/status indication" and, at the same time, the ink level indication of the indicator lamp 21 is switched to green lighting that indicates the verifying operation of the recording. Hence, the user is able to recognize that all three color inks are substantially full between time t36*a* and time t37*a*. As described above, according to the example embodiment shown in FIG. 27 to FIG. 31, the user is able to repeat recording and printing on a plurality of optical disks 2 while appropriately recognizing the ink levels.

As described in this example embodiment, by performing the ink level indication through the ink level information button 22, it is possible to detect the ink levels quantitatively and notify the user. In addition, it may be merely required to provide a press button as an additional component. This does not lead to a significant increase in cost. According to this example embodiment, irrespective of the recording/reproducing operation, the user is able to recognize the ink level quantitatively at selected time, and it is easy to determine how long replacement of ink may be necessary, or the like. Thus, it is possible to enhance convenience of preparations for printing, ink replacement, and the like. Furthermore, the indicator lamp 21 may be installed in a small space even in the narrow front panel, so it does not cause an increase in size of the apparatus and, therefore, it is possible to reduce design cost.

The invention is not limited to the embodiments described above and shown in the drawings; it may be modified in various forms within the scope of the invention. For example, the DVD-RW is used as a recording medium in the example embodiments. Instead, the embodiment of the invention may be applied to a printer-equipped optical disk apparatus that uses a recording medium in another recording mode, such as a magneto-optical disk and a magnetic disk. Furthermore, the disk recording and/or reproducing apparatus according to the embodiment of the invention is not limited to an optical disk recording/reproducing apparatus that is capable of both recording and reproducing, but it may be applied to a disk recording apparatus, a disk reproducing apparatus, or another disk recording and/or reproducing apparatus, which is able to use this type of printer.

It should be understood by those skilled in the art that various modifications, combinations, sub-combinations and alterations may occur depending on design requirements and other factors insofar as they are within the scope of the appended claims or the equivalents thereof.

What is claimed is:

1. A printer-equipped disk recording and/or reproducing apparatus comprising:

a disk drive that sets a disk-shaped recording medium and that records information signals into and/or reproduces information signals from an information recording portion of the disk-shaped recording medium by rotating the disk-shaped recording medium;

a printer that performs printing by discharging ink droplets onto a label surface of the disk-shaped recording medium, which is on a side opposite to the information recording portion;

a single light-emitting indicator unit that is able to luminously indicate a plurality of colors;

an ink tank that contains color inks of which a number of inks corresponds to a number of colors the light-emitting indicator unit is able to indicate;

an ink level detection unit that detects levels of a plurality of color inks contained in the ink tank for the respective ink colors and that outputs respective detected ink signals;

a printing operation detection unit that detects a print operation of the printer and that outputs a detected print signal;

a drive operation detection unit that detects a drive operation of the disk drive and that outputs a detected drive signal; and a first light emission control unit that controls a luminous color and a luminous state of the light-emitting indicator unit in accordance with the print operation of the printer, the drive operation of the disk drive and the levels of the color inks on the basis of the detected ink signals from the ink level detection unit, the detected print signal from the printing operation detection unit and the detected drive signal from the drive operation detection unit.

2. The printer-equipped disk recording and/or reproducing apparatus according to claim 1, further comprising a second light emission control unit that controls a luminous color and a luminous state of the light-emitting indicator unit in accordance with the levels of the color inks only on the basis of the detected ink signals from the ink level detection unit.

3. The printer-equipped disk recording and/or reproducing apparatus according to claim 1, wherein the light-emitting indicator unit is an indicator lamp that is able to separately or mixedly indicate three color lights of cyan, magenta and yellow.

4. The printer-equipped disk recording and/or reproducing apparatus according to claim 1, wherein the first light emission control unit instructs the light-emitting indicator unit to light when the ink is out, and instructs the light-emitting indicator unit to blink when the ink level is lower than a predetermined level.

5. The printer-equipped disk recording and/or reproducing apparatus according to claim 1, wherein the second light emission control unit sets a period of turn-on time during which the light-emitting indicator unit is turned on and a period of turn-off time during which the light-emitting indicator unit is turned off in accordance with the ink levels to indicate the ink levels using the duration of the turn-on time and the duration of the turn-off time.

* * * * *